US012404596B2

(12) United States Patent
Vecitis et al.

(10) Patent No.: US 12,404,596 B2
(45) Date of Patent: Sep. 2, 2025

(54) ELECTROCHEMICAL METAL DEPOSITION SYSTEM AND METHOD

(71) Applicant: NTH CYCLE, INC., Beverly, MA (US)

(72) Inventors: Chad David Vecitis, Acton, MA (US); Christopher James Moore, Somerville, MA (US); Emily Willett Jennings, Medford, MA (US); Megan O'Connor, Salem, MA (US)

(73) Assignee: Nth Cycle, Inc., Beverly, MA (US)

( * ) Notice: Subject to any disclaimer, the term of this patent is extended or adjusted under 35 U.S.C. 154(b) by 0 days.

(21) Appl. No.: 17/830,280

(22) Filed: Jun. 1, 2022

(65) Prior Publication Data

US 2022/0389601 A1 Dec. 8, 2022

Related U.S. Application Data

(60) Provisional application No. 63/273,840, filed on Oct. 29, 2021, provisional application No. 63/195,567, filed on Jun. 1, 2021.

(51) Int. Cl.
*C25C 5/02* (2006.01)
*C25C 7/02* (2006.01)
(Continued)

(52) U.S. Cl.
CPC ..... *C25C 5/02* (2013.01); *C25C 7/02* (2013.01); *C25C 7/04* (2013.01); *C25D 17/002* (2013.01); *C25D 17/12* (2013.01)

(58) Field of Classification Search
None
See application file for complete search history.

(56) References Cited

U.S. PATENT DOCUMENTS 1,569,994 A 1/1926 Martin
2,334,790 A 11/1943 Roffy
(Continued)

FOREIGN PATENT DOCUMENTS

CA 1132089 A 9/1982
CA 1257222 A 7/1989
(Continued)

OTHER PUBLICATIONS

Pilone et al. "Model of Multiple Metal Electrodeposition in Porous Electrodes" J. Electrochem. Soc. 153 D85 '2006' (Year: 2006).*
(Continued)

*Primary Examiner* — Wojciech Haske
(74) *Attorney, Agent, or Firm* — Marco Santmaria; Deborah Peacock

(57) ABSTRACT

An electrochemical deposition apparatus and method for the selective recovery of metal. The electrochemical deposition apparatus comprises a porous cathodic material, an anode, an inter-electrode region formed by the anode and cathode, and a gas release channel. The method may comprise passing a solution comprising a metal into a cavity, changing an oxidation state of a metal, and selectively depositing the metal onto a porous cathodic material. The electrochemical deposition apparatus may recover metal from metal feed in the form of metal hydroxides. The recovered metal may be from any source including, but not limited to, minerals, electronic waste, and black mass.

10 Claims, 57 Drawing Sheets

(51) Int. Cl.

| | |
|---|---|
| ***C25C 7/04*** | (2006.01) |
| ***C25D 17/00*** | (2006.01) |
| ***C25D 17/12*** | (2006.01) |

(56) References Cited

U.S. PATENT DOCUMENTS

| | | | | |
|---|---|---|---|---|
| 2,834,722 | A | 5/1958 | Mclaren et al. | |
| 3,049,478 | A | 8/1962 | Wilhelm | |
| 3,260,658 | A | 7/1966 | Churchward | |
| 3,772,056 | A | 11/1973 | Polichette et al. | |
| 3,832,443 | A | 8/1974 | Hass | |
| 3,891,741 | A | 6/1975 | Carlin et al. | |
| 4,167,468 | A | 9/1979 | Juckniess et al. | |
| 4,226,695 | A | 10/1980 | Matson | |
| 4,648,945 | A | 3/1987 | Isenberg | |
| 4,670,115 | A | 6/1987 | Prior et al. | |
| 4,789,444 | A | 12/1988 | Watanabe et al. | |
| 4,857,159 | A | 8/1989 | Davis et al. | |
| 4,911,804 | A | 3/1990 | Dickson | |
| 5,043,048 | A | 8/1991 | Muralidhara | |
| 5,332,485 | A | 7/1994 | Thompson | |
| 5,584,981 | A | 12/1996 | Turner et al. | |
| 5,636,437 | A | 6/1997 | Kaschmitter et al. | |
| 5,670,035 | A | 9/1997 | Virnig et al. | |
| 5,690,806 | A | 11/1997 | Sunderland et al. | |
| 5,720,867 | A | 2/1998 | Anastasijevic et al. | |
| 5,956,242 | A | 9/1999 | Majid et al. | |
| 5,958,242 | A | 9/1999 | Fennell | |
| 6,086,733 | A | 7/2000 | Carey et al. | |
| 9,827,517 | B2 | 11/2017 | Vecitis et al. | |
| 10,723,626 | B1 | 7/2020 | Chapman | |
| 2003/0019756 | A1 | 1/2003 | Yoshida et al. | |
| 2003/0089237 | A1 | 5/2003 | Jagtoyen et al. | |
| 2003/0136728 | A1 | 7/2003 | Jagtoyen et al. | |
| 2004/0012913 | A1 | 1/2004 | Andelman | |
| 2005/0249917 | A1 | 11/2005 | Trentacosta et al. | |
| 2007/0042122 | A1 | 2/2007 | Orihashi | |
| 2009/0131858 | A1 | 5/2009 | Fissell et al. | |
| 2009/0143227 | A1 | 6/2009 | Dubrow et al. | |
| 2009/0173634 | A1 | 7/2009 | Aksu et al. | |
| 2010/0072075 | A1 | 3/2010 | Shindo et al. | |
| 2011/0120879 | A1* | 5/2011 | Buschmann | C25C 1/12 205/348 |
| 2012/0067737 | A1* | 3/2012 | Zhang | H01M 6/52 977/773 |
| 2012/0193224 | A1 | 8/2012 | Suk | |
| 2012/0211367 | A1 | 8/2012 | Vecitis | |
| 2012/0234694 | A1 | 9/2012 | Vecitis et al. | |
| 2013/0259903 | A1 | 10/2013 | Mortenson et al. | |
| 2016/0247589 | A1 | 8/2016 | Miyamoto et al. | |
| 2017/0197999 | A1 | 7/2017 | Kumar et al. | |
| 2017/0327961 | A1 | 11/2017 | Suenaga et al. | |
| 2018/0013185 | A1 | 1/2018 | Adamson et al. | |
| 2018/0187320 | A1 | 7/2018 | Chung et al. | |
| 2018/0298504 | A1 | 10/2018 | Riveros Urzua et al. | |
| 2019/0017145 | A1 | 1/2019 | Nelson et al. | |
| 2022/0389601 | A1 | 12/2022 | Vecitis et al. | |

FOREIGN PATENT DOCUMENTS

| | | | |
|---|---|---|---|
| CA | 1309315 | C | 10/1992 |
| CA | 2169482 | A1 | 3/1995 |
| CA | 3022150 | A1 | 1/2018 |
| CA | 3012674 | A1 | 1/2020 |
| CN | 101265589 | A | 9/2008 |
| GB | 191124562 | A | 12/1912 |
| JP | H01162790 | A | 6/1989 |
| JP | 2006298870 | A | 11/2006 |
| JP | 2017088920 | A | 5/2017 |
| WO | 03097903 | A1 | 11/2003 |
| WO | 2010126686 | A2 | 11/2010 |
| WO | 2016110597 | A1 | 7/2016 |
| WO | 2022256457 | A1 | 12/2022 |

OTHER PUBLICATIONS

Wiggins-Camacho , et al., "Effect of Nitrogen Concentration on Capacitance, Density of States, Electronic Conductivity, and Morphology of N-Doped Carbon Nanotube Electrodes", J. Phys. Chem. C 2009, 113, 19082-19090.

Yang, Kun , et al., "Competitive Adsorption of Naphthalene with 2,4-Dichlorophenol and 4-Chloroaniline on Multiwalled Carbon Nanotubes", Environ. Sci. Technol.2010, 44, 3021-3027.

Yang, So Young , et al., "Electrocatalytic water treatment using carbon nanotube filters modified with metal oxides", Environ Sci Pollut Res (2019) 26:1036-1043.

Yang, Ji , "Improvement of Electrochemical Wastewater Treatment through Mass Transfer in a Seepage Carbon Nanotube Electrode Reactor", Environ. Sci. Technol. 2009, 43, 3796-3802.

Yuan, Wei , "Deposition of Silver Nanoparticles on Multiwalled Carbon Nanotubes Grafted with Hyperbranched Poly (amidoamine) and Their Antimicrobial Effects", J. Phys. Chem. C 2008, 112, 18754-18759.

Zhang, Qiaoyang , et al., "Interlaced CNT Electrodes for Bacterial Fouling Reduction of Microfiltration Membranes", Environ. Sci. Technol. 2017, 51, 9176-9183.

Zhang, Qiaoying , et al., "Semiquantitative Performance and Mechanism Evaluation of Carbon Nanomaterials as Cathode Coatings for Microbial Fouling Reduction", Applied and environmental microbiology 81.14, 2015, 4744-4755.

"Biological Buffers", CRC Handbook of Chemistry and Physics, 2022.

"Buffer Solutions Giving Round Values oh pH at 25 C", CRC Handbook of Chemistry abd Physics, 2022.

"Carbon Nanotube Membrane Stack for Flow-through Sequential Regenerative Electro-Fenton", Environ. Sci. Technol. 2015, 49, 2375-2383.

"Electrochemical Carbon Nanotube Filter Oxidative Performance as a Function of Surface Chemistry", Environ. Sci. Technol. 2011, 45, 9726-9734.

"Industrial Solutions Chlor-Alkali Electrolysis Three Best-in-Class Technologies Thyssenkrupp", Sep. 24, 2021.

"PH Scale for Aqueous Solutions", CRC Handbook of Chemistry and Physics, 2022.

"Solubility Product Constants", CRC Handbook of Chemistry and Physics, 2022.

"Solubility Product Constants of Inorganic Salts", CRC Handbook of Chemistry and Physics, 2022.

Al-Johani, H. , et al., "Kinetics and thermodynamic study of aniline adsorption by multi-walled carbon nanotubes from aque-ous solution", J. Colloid Interface Sci. 2011, 360 (2), 760-767.

Botte, Gerardine G., "Electrochemical Manufacturing in the Chemical Industry", The Electrochemical Society Interface, 23(3), 49, 2014.

Brady-Estevez, A. S., et al., "A single-walled-carbon-nanotube filter for removal of viral and bacterial pathogens", Small 2008, 4 (4), 481-484.

Cho , et al., ". 'Sorption of aqueous Zn[II] and Cd[II] by multiwall carbon nanotubes: The relative roles of oxygen containing functional groups and graphenic carbon'", Langmuir 2010, 26 (2), 967-981.

Cho, Hyun-Hee , et al., "Influence of Surface oxides on the Adsorption of Naphthalene onto Multiwalled Carbon Nanotubes", Environ. Sci. Technol. 2008, 42, 2899-2905.

Di , et al., "Chromium adsorption by aligned carbon nanotubes supported ceria nanoparticles", Chemosphere 2006, 62, 861-865.

Dos Santos Cunha, Gustavo , et al., "Insights into estrogenic activity removal using carbon nanotube electrochemical filter", Science of the Total Environment 678 (2019) 448-456.

Fugetsu , et al., "Caged Multiwalled Carbon Nanotubes as the Adsorbents for Affinity-Based Elimination of Ionic Dyes", Environ. Sci Technol. 2004, 38, 6890-6896.

Gao, Guandao , et al., "CNT-PVDF composite flow-through electrode for single-pass sequential reduction-oxidation", J. Mater. Chem. A, 2014, 2, 6185.

(56) References Cited

OTHER PUBLICATIONS

Gao, Guandao , "Doped Carbon Nanotube Networks for Electrochemical Filtration of Aqueous Phenol: Electrolyte Precipitation and Phenol Polymerization", ACS Appl. Mater. Interfaces 2012, 4, 1478-1489.
Gao, Guandao , et al., "Effect of the oxidation approach on carbon nanotube surface functional groups and electrooxidative filtration performance", J. Mater. Chem. A, 2015, 3, 7575.
Gao, Guandao , et al., "Reactive depth and performance of an electrochemical carbon nanotube network as a function of mass transport", ACS applied materials & interfaces 4.11 (2012): 6096-6103.
Gui , et al., "Soft, highly conductive nanotube sponges and composites with controlled compressibility", ACS Nano 4, 2010, 2320-2326.
Hoon , et al., "Natural Organic Matter (NOM) Adsorption to Multi-Walled Carbon Nanotubes: Effect of NOM Characteristics and Water Quality Parameters", Environ. Sci. Technol. 2008, 42, 4416-4421.
Kuichang, Zuo , et al., "A Single-Use Paper-Shaped Microbial Fuel Cell for Rapid Aqueous Biosensing", ChemSusChem 2015, 8, 2035-2040.
Liu, Yanbiao , et al., "A graphene-based electrochemical filter for water purification", J. Mater. Chem. A, 2014, 2, 16554.
Liu, Han , "Bismuth-Doped Tin Oxide-Coated Carbon Nanotube Network: Improved Anode Stability and Efficiency for Flow-Through Organic Electrooxidation", ACS Appl. Mater. Interfaces 2013, 5, 10054-10066.
Liu, Yanbiao , et al., "Degradation of the Common Aqueous Antibiotic Tetracycline using a Carbon Nanotube Electrochemical Filter", Environ. Sci. Technol. 2015, 49, 7974-7980.
Liu, Yanbiao , et al., "Electrochemical wastewater treatment with carbon nanotube filters coupled with in situ generated H2O2", Environ. Sci.: Water Res. Technol., 2015, 1, 769.
Liu, Yanbiao , et al., "Prospects of an electroactive carbon nanotube membrane toward environmental applications", Accounts of Chemical Research 53.12 (2020): 2892-2902.
Liu, Han , "Reactive transport mechanism for organic oxidation during electrochemical filtration: mass-transfer, physical adsorption, and electron-transfer", The Journal of Physical Chemistry C 116.1 (2012): 374-383.
Liu, Han , et al., "Titanium dioxide-coated carbon nanotube network filter for rapid and effective arsenic sorption.", Environmental science & technology 48.23 (2014): 13871-13879.
Matsunaga, Tadashi , et al., "Disinfection of Drinking Water by Using a Novel Electrochemical Reactor Employing Carbon-Cloth Electrodes", Applied and Environmental Microbiology, Feb. 1992, p. 686-689.
Matsunaga , et al., "Electrochemical disinfection of bacteria in drink-ing water using activated carbon fibers", Biotechnol. Bioeng. 1994, 43:429-433.
Moon , et al., "High-yield purification process of single-walled carbon nanotubes", J. Phys. Chem. B 2001, 105 (24):5677-5681.
Mukhopadhyay, I. , "Electrochemical Li Insertion in B-Doped Multiwall Carbon Nanotubes", Journal of The Electrochemical Society, 149 (1) A39-A44 (2002).
O'Connor, Megan P., et al., "Electrochemical deposition for the separation and recovery of metals using carbon hanotube-enabled filters", Environ. Sci.: Water Res. Technol., 2018, 4, 58.
Peigney , et al., "Specific surface area of carbon nanotubes and bundles of carbon nanotubes", Carbon 2001, 39 (4), 507-514.
Peng, Xianjia , "Ceria nanoparticles supported on carbon nanotubes for the removal of arsenate from water", Materials letters, 59(4), 399-403, 2004.
Rahaman, MD. Saifur , et al., "Electrochemical Carbon-Nanotube Filter Performance toward Virus Removal and Inactivation in the Presence of Natural Organic Matter", Environ. Sci. Technol. 2012, 46, 1556-1564.
Remillard, Marielle E., et al., "A Direct Comparison of Flow-By and Flow-Through Capacitive Deionization", Desalination, 444, 169-177, 2018.
Roux, L. M., et al., "Comparison of Solvent Extraction and Selective Precipitation for the Purification of Cobalt Electrolytes at the Luilu Refinery, DRC", The South African Institute of Mining and Metallurgy Base Metal Conference. 2007.
Schnoor, Mary H., et al., "Quantitative examination of aqueous ferrocyanide oxidation in a carbon nanotube electrochemical filter: effects of flow rate, ionic strength, and cathode material", The Journal of Physical Chemistry C 117.6 (2013): 2855-2867.
Shujuan , et al., "Adsorption of Aromatic Compounds by Carbonaceous Adsorbents: A Comparitive Study on Granular Activated Carbon, Activated Carbon Fiber, and Varbon Nanotubes", Environ. Sci. Technol. 2010, 44, 6377-6383.
Vanysek, Petr , "Electrochemical Series", CRC handbook of chemistry and physics 87 (1998).
Vaughan , et al., "Chemical Aspects of Mixed Nickel-Cobalt Hydroxide Precipitation and Refining", Proceedings of the ALTA Ni/Co/Cu Conference. 2011.
Vecitis, Chad D., et al., "Electrochemical Carbon Nanotube Filter for Adsorption, Desorption, and Oxidation of Aqueous Dyes and Anions", J. Phys. Chem. C 2011, 115, 3621-3629.
Vecitis, Chad D., et al., "Electrochemical Multiwalled Carbon Nanotube Filter for Viral and Bacterial Removal and Inactivation", Environ. Sci. Technol. 2011, 45, 3672-3679.
Vecitis, Chad D., et al., "Electronic-Structure-Dependent Bacterial Cytoxicity of Single-Walled Carbon Nanotubes", vol. 4, No. 9, 5471-5479, 2010, ASCNANO.
Wang, Xiaoming , et al., "Effect of surface oxygen containing groups on the catalytic activity of multi-walled carbon nanotube supported Pt catalyst", Applied Catalyst B: Environmental 101 (2010) 21-30.
Wang, Jun-Xia , et al., "Multiwalled carbon nanotubes coated fibers for solid-phase microextraction of polybrominated diphenyl ethers in water and milk samples before gas chromatography with electron-capture detection", Journal of Chromatography A 1137.1 (2006): 8-14.
Wen, Zhenhai , "In Situ Growth of Mesoporous SnO2 on Multiwalled Carbon Nanotubes: A Novel Composite with Porous-Tube Structure as Anode for Lithium Batteries", Adv. Funct. Mater., 2007, 17, 2772-2778.
Arai , et al., Journal of The Electrochemical Society, 2010, 157, (3), D147-D153.
Banks, C. E., et al., "Electrocatalysis at graphite and carbon nanotube modified electrodes: edge-plane sites and tube ends are the reactive sites", Chem. Commun. 2005, 7, 829-841.
Bermejo, M. R., et al., "Electrochemistry of terbium in the eutectic LiCl—KCl", Electrochim. Acta 2008, 53 (16), 5106-5112.
Borras, N. , et al., "Degradation of Atrazine by Electrochemical Advanced Oxidation Processes Using a Boron-Doped Diamond Anode", J. Phys. Chem. A 2010, 114 (24), 6613-6621.
Brady-Estevez, A. S., et al., "Impact of solution chemistry on viral removal by a single-walled carbon nanotube filter", Water Res. 2010, 44, 3773-3780.
Brady-Estevez , et al., "Multiwalled Carbon Nanotube Filter: Improving Viral Removal at Low Pressure", Langmuir 2010, 26 (18), 14975-14982.
Brett, C. M. A., et al., "On the adsorption and electrochemical oxidation of DNA at glassy carbon electrodes", J. Electroanal. Chem. 1994, 366 (1-2), 225-231.
Canizares, P. , et al., "Combined adsorption and electrochemical processes for the treatment of acidic aqueous phenol wastes", Journal of Applied Electrochemistry 2004, 34, (1), 111-117.
Canizares, P. , et al., "Electrochemical oxidation of aqueous phenol wastes using active and nonactive electrodes", Journal of the Electrochemical Society 2002, 149, (8), D118-D124.
Carroll, D. L., et al., "Effects of Nanodomain Formation on the Electronic Structure of Doped Carbon Nanotubes", Phys. Rev. Lett. 1998, 81 (11), 2332-2335.
Colmati, F. , et al., "Surface structure effects on the electrochemical oxidation of ethanol on platinum single crystal electrodes", Faraday Discuss. 2008, 140, 379-397.

(56) References Cited

OTHER PUBLICATIONS

Comninellis, Ch. and Pulgarin, C , "Anodic oxidation of phenol for waste water treatment", J. Appl. Electrochem. 1991, 21 (8), 703-708.
Conway, B. E. and Tilak, B. V. , "Interfacial processes involving electrocatalytic evolution and oxidation of H2, and the role of chemisorbed H", Electrochim. Acta 2002, 47 (22-23), 3571-3594.
Cook , et al., "Solar Energy Supply and Storage for the Legacy and Nonlegacy Worlds", Chem. Rev., 110, 2010, 6474-6502.
Czerw, R. , et al., "Identification of Electron Donor States in N-Doped Carbon Nanotubes", Nano Lett. 2001, 1 (9), 457-460.
Ebbesen, T. W., et al., "Electrical conductivity of individual carbon nanotubes", Nature. 1996, 382 (6586), 54-56.
Fabbri , et al., "Oxygen Evolution Reaction—The Enigma in Water Electrolysis", ACS Catal., 8, 2018, 9765-9774.
Fan, Y. , et al., "Identifying and counting point defects in carbon nanotubes", Nat. Mater. 2005, 4 (12), 906-911.
Gao , et al., "Mechanism of enhanced electrochemical oxidation of 2,4-dichlorophenoxyacetic acid with in situ microwave activated boron-doped diamond and platinum anodes", Phys. Chem. A 2009, 113, 10466-10473.
Gattrell and Kirk , "A Study of Electrode Passivation during Aqueous Phenol Electrolysis", Journal of the Electrochemical Society 1993, 140, (4), 903-911.
Girish Kumar , et al., "Carbon nanostructures in portable fuel cells: Single-walled carbon nanotube electrodes for methanol oxidation and oxygen reduction", J. Phys. Chem. B 2004, 108 (52), 19960-19966.
Gooding , et al., "Protein electrochemistry using aligned carbon nanotube arrays", J. Am. Chem. Soc. 2003, 125, 9006-9007.
Graham, D. , "Characterization of physical adsorption systems. III. The separate effects of pore size and surface acidity upon the adsorbent capacities of activated carbons", J. Phys. Chem. 1955, 59, 896-900.
Guldi , et al., "CNT-CdTe versatile donor-acceptor nanohybrids", J. Am. Chem. Soc. 2006, 128 (7), 2315-2323.
Hansen , et al., "Is There Anything Better than Pt for HER?", ACS Energy Lett., 6, 2021, 1175-1180.
Hansen , et al., "Supplementary Information: Is There Anything Better than Pt for HER?", ACS Energy Lett., 6, 2021.
Hu , et al., "DNA functionalized single-walled carbon nanotubes for electrochemical detection", J. Phys. Chem. B 2005, 109 (43), 20072-20076.
Hu , et al., "Nitric acid purification of single-walled carbon nanotubes", J. Phys. Chem. B 2003, 107 (50), 13838-13842.
Hu , et al., "Removal of Aqueous Phenol by Adsorption and Oxidation with Doped Hydrophobic Cryptomelane-Type Manganese Oxide (K-OMS-2) Nanofibers", Journal of Physical Chemistry C 2010, 114, (21), 9835-9844.
Hunter , et al., "Earth-Abundant Heterogeneous Water Oxidation Catalysts", Chem. Rev., 116, 2016, 14120-14136.
Hyung, Hoon , et al., "Natural organic matter (NOM) adsorption to multi-walled carbon nanotubes: effect of NOM characteristics and water quality parameters.", Environmental science & technology 42.12, 2008, 4416-4421.
Iijima, S. , et al., "Helical microtubes of graphitic carbon", Nature 1991, 354 (6348), 56-58.
Iniesta , et al., "Electrochemical oxidation of phenol at boron-doped diamond electrode", Electrochim. Acta 2001, 46 (23), 3573-3578.
Jame, Sadia A., et al., "Electrochemical carbon nanotube filters for water and wastewater treatment", 5 Nanotechnol Rev., 41, 2016, 41-50.
Jung , et al., "Effect of molecular weight of polymeric additives on formation, permeation properties and hypochlorite treatment of asymmetric polyacrylonitrile membranes", Journal of Membrane Science (2004) 243:45-57.
Kang , et al., "Antibacterial effects of carbon nanotubes: Size does matter", Langmuir 2008, 24 (13), 6409-6413.
Kang , et al., "Physicochemical determinants of multiwalled carbon nanotube bacterial cytotoxicity", Environ. Sci. Technol. 2008, 42 (19), 7528-7534.
Kang , et al., "Single-walled carbon nanotubes exhibit strong antimicrobial activity", Langmuir 2007, 23, 8670-8673.
Katz and Willner , "Biomolecule-functionalized carbon nanotubes: applications in nanobioelectronics", ChemPhysChem 2004, 5 (8), 1084-1104.
Khattab , et al., "Electrochemical removal of copper ions from dilute solutions using packed bed electrode", Part I, 22 Egypt. J. Petrol., 2013, 199, 199-203.
Khattab , et al., "Electrochemical removal of copper ions from dilute solutions using packed bed electrode", Part II, 22 Egypt, J. Petrol., 2013, 205, 205-210.
Kim , et al., "Raman and IR spectroscopy of chemically processed single-walled carbon nanotubes", J. Am. Chem. Soc. 2005, 127 (44), 15437-15445.
Kotz , et al., "Electrochemical waste water treatment using high overvoltage anodes. Part 1: Physical and electrochemical properties of SnO2 anodes", J. Appl. Electrochem. 1991, 21 (1), 14-20.
Kundu , et al., "Electrocatalytic activity and stability of nitrogen-containing carbon nanotubes in the oxygen reduction reaction", J. Phys. Chem. C 2009, 113 (32), 14302-14310.
Li , et al., "Compression-modulated tunable-pore carbon-nanotube membrane filters", Small 2007, 3, 595-599.
Li, et al., "Constructing stake structured TiO2-NTs/Sb-doped SnO2 electrode simultaneously with high electrocatalytic and photocatalytic performance for complete mineralization of refractory aromatic acid", J. Phys. Chem. C 2009, 113 (6), 2375-2383.
Li , et al., "Novel three-dimensional electrodes: Electrochemical properties of carbon nanotube ensembles", J. Phys. Chem. B 2002, 106 (36), 9299-9305.
Liu, Han , "CNT-based Electrochemical Filter for Water Treatment: Mechanisms and Applications", Ph.D. dissertation, Harvard University, 2015.
Liu , et al., "Highly ordered TiO2 nanotube arrays with controllable length for photoelectrocatalytic degradation of phenol", J. Phys. Chem. C 2008, 112, 253-259.
Liu , et al., "Quantitative 2D electrooxidative carbon nanotube filter model: Insight into reactive sites", 80 Carbon, 2014, 651, 651-664.
Luo , et al., "Investigation of the electrochemical and electrocatalytic behavior of single-wall carbon nanotube film on a glassy carbon electrode", Anal. Chem. 2001, 73 (5), 915-920.
Martinez-Huitle and Brillas , "Electrochemical alternatives for drinking water disinfection", Angew. Chem., Int. Ed. 2008, 4 7 (11 ), 1998-2005.
Mashat, Afnan , "Functional Materials Based on Surface Modification of Carbon Nanotubes for Biomedical and Environmental Applications", Ph.D. dissertation, King Abdullah University of Science and Technology, 2015.
Masheter , et al., "Investigating the reactive sites and the anomalously large changes in surface pKa values of chemically modified carbon nanotubes of different morphologies", J. Mater. Chem. 2007, 17 (25), 2616-2626.
O'Conner, Megan , "Strategies to Enable a Circular in the Electronics Industry: Electrochemical Recovery of Metals", Ph.D. Dissertation, Duke University, 2017, 169 pages.
Ohnuki , et al., "Permselectivity of films prepared by electrochemical oxidation of phenol and amino-aromatic compounds", J. Electroanal. Chem. 1983, 158 (1 ), 55-67.
Pan and Xing , "Adsorption mechanisms of organic chemicals on carbon nanotubes", Environ. Sci. Technol. 2008, 42 (24), 9005-9013.
Pantano , et al., "Mechanics of deformation of single- and multi-wall carbon nanotubes", J. Mech. Phys. Solids 2004, 52 ( 4 ), 789-821.
Park , et al., "Electrochemical water splitting coupled with organic compound oxidation: The role of active chlorine species", J. Phys. Chem. C 2009, 113 (18), 7935-7945.
Park and Choi , "TiO2-nafion photoelectrode hybridized with carbon nanotubes for sensitized photochemical activity", J. Phys. Chem. C 2009, 113, 20974-20979.

(56) References Cited

OTHER PUBLICATIONS

Remillard, E. Marielle, et al., "A Direct Comparison of Flow-By and Flow-Through Capacitive Deionization", Desalination, vol. 444, Feb. 1, 2018.
Sadakante , et al., "Electrochemical Properties of Polyoxometalates as Electrocatalysts", Chem. Ref., 98, 1998, 219-237.
Shi , et al., "Purification of single-wall carbon nanotubes", Solid State Commun. 1999, 112 (1), 35-37.
Sinha and Yeow , "Carbon nanotubes for biomedical applications", IEEE Trans. Nanobiosci. 2005, 4 (2), 180-195.
Stucki , et al., "Electrochemical waste water treatment using high overvoltage anodes. Part II: Anode performance and applications", J. Appl. Electrochem. 1991, 21 (2), 99-104.
Takeshita , et al., "Solvent extraction separation of Cd (II) and ZN(II) with the organphosphorus extractant D2EHPA and the aqueous nitrogen-donor ligand TPEN", Hydrometallurgy, 70, Jul. 2003, 63-71.
Tilak and Conway , "Overpotential decay behavior—I.Complex electrode reactions involving adsorption", Electrochim. Acta 1976, 21 (10), 745-752.
Tiraferri , et al., "Covalent Binding of Single-Walled Carbon Nanotubes to Polyamide Membranes for Antimicrobial Surface Properties", ACS Appl. Mater. Interfaces 3, (8), 2869-2877.
Tong , et al., "Fabrication and high electrocatalytic activity of three-dimensional porous nanosheet PT/boron-doped diamond hybrid film", J. Phys. Chem. C 2009, 113 (31 ), 13787-13792.
Tsai , et al., "Treatment of perfluorinated chemicals by electro-microfiltration", Environ. Sci. Technol. 2010, 44, 7914-7920.
Walter , et al., "Solar Water Splitting Cells", Chem. Rev., 110, 2010, 6446-6473.
Wang , et al., "Electrocatalytic oxidation of norepinephrine at a glassy carbon electrode modified with single wall carbor nanotubes", Electroanal. 2002, 14 (3), 225-230.
Yang , et al., "Improvement of Electrochemical Wastewater Treatment through Mass Transfer in a Seepage Carbon Nanotube Electrode Reactor", Environ. Sci. Technol. 2009, 43 (10), 3796-3802.
Ye , et al., "Hydrogen adsorption and cohesive energy of single-walled carbon nanotubes", Appl. Phys. Lett. 1999, 74, 2307-2309.
Zhan , et al., International Journal of Electrochemistry, vol. 2011, 2011, Article ID 572862, 8 pages.
Zhang , et al., "Adsorption of aromatic compounds by carbonaceous absorbents: a comparative study on granular activated carbon, activated carbon fiber, and carbon nanotubes", Environ. Sci. Technol., 2010, 44 (16), 6377-6383.
Zhang , et al., "Controllable synthesis and highly efficient electrocatalytic oxidation performance of SnO2/CNT core-shell structures", Appl. Surf. Sci. 2009, 255 (9), 4907-4912.
Zhang , et al., "Preparation and electrocatalytic application of high dispersed Pt nanoparticles/ordered mesoporous carbon composites", Electrochim. Acta 2011, 56 ( 17), 5849-5854.

* cited by examiner

ELECTROCHEMICAL METAL DEPOSITION SYSTEM AND METHOD

CROSS-REFERENCE TO RELATED APPLICATIONS

This application claims the benefit of the filing of U.S. Provisional Patent Application No. 63/195,567, entitled "Electrochemical Metal Deposition Apparatus and Method", filed on Jun. 1, 2021, and U.S. Provisional Patent Application No. 63/273,840, entitled "Electrochemical Metal Deposition Apparatus and Method", filed on Oct. 29, 2021 and both specifications thereof are incorporated herein by reference.

BACKGROUND OF THE INVENTION

Field of the Invention (Technical Field)

The present invention relates to an electrochemical system, apparatus and method for the selective precipitation and deposition of metals from a solution.

Description of Related Art

Technological advancements have produced an ever-increasing need for metals, materials and compounds. Political and climate concerns also promote a need for environmentally conscious metal recovery processes. Recycling metal and metal compounds is critical for the development of green and energy transition technologies, including energy storage/batteries, electric vehicles ("EVs"), windmills, and solar cells. Metals, including minerals and rare earth ("RE") metals, are critical materials that have been referred to as the oil of the alternative energy age, with copper and RE metal demand anticipated to increase dramatically in the coming decades. There is also a significant need for recycling of end-of-life batteries and other metal-containing products. Specifically, these metals include lithium, cobalt, nickel, and manganese. Cobalt, nickel, and manganese often serve as cathode material for lithium-ion batteries. A single electric vehicle contains more than 1 kg of RE and other metals as well as lithium-ion batteries. Additionally, countries often rely on imports for their production needs, particularly for critical minerals and metals.

What is needed is an economical, energy efficient, and climate conscious process to enable the creation of a sustainable source of metals. The present invention selectively separates mixed metal resources into individual metal products at reduced cost and environmental impact. The present invention provides a high-throughput electrochemical process for metal recovery and separation from conventional and unconventional domestic resources as an alternative to the classical energy-intensive hydrometallurgic and pyrometallurgic metal extraction and refining processes such as electrowinning or solvent extraction.

BRIEF SUMMARY OF EMBODIMENTS OF THE PRESENT INVENTION

The present invention is directed to an electrochemical deposition system, the electrochemical deposition system comprising: at least one porous cathodic material; at least one anode; said at least one porous cathodic material and said at least one anode forming an inter-electrode region; a housing disposed around said at least one porous cathodic material and said at least one anode; at least one gas release channel; at least one inlet; and at least one outlet. In one embodiment, the electrochemical deposition system comprises a plurality of electrochemical deposition systems arranged in series. In another embodiment, the electrochemical deposition system comprises a plurality of electrochemical deposition systems arranged in parallel.

In another embodiment, the electrochemical deposition system further comprises a filter. In another embodiment, the electrochemical deposition system further comprises a current collector. In another embodiment, the at least one porous cathodic material comprises carbon nanotubes. In another embodiment, the at least one anode is porous. In another embodiment, the at least one porous cathodic material comprises an electroactive area of about 25 $cm^2$ to about 10 $m^2$. In another embodiment, the at least one porous cathodic material comprises a catalyst. In another embodiment, the electrochemical deposition system further comprises at least one selective membrane.

The present invention is also directed to a method for electrochemically depositing metal, the method comprising: passing a solution comprising a metal into a cavity; applying a charge to a porous cathodic material at least partially disposed within the cavity; contacting the solution with a porous cathodic material having the applied charge; changing an oxidation state of the metal; and selectively depositing at least a portion of the metal onto the porous cathodic material. In one embodiment, the method further comprises contacting the solution with an anode. In another embodiment, the method further comprises contacting the porous cathodic material with an acid. In another embodiment, the method further comprises contacting the porous cathodic material with a buffer. In another embodiment, the method further comprises generating a gas. In another embodiment, the method further comprises leaching. In another embodiment, changing the oxidation state of the metal comprises increasing the oxidation state of the metal. In another embodiment, contacting the solution with a porous cathodic material comprises passing the solution across the porous cathodic material. In another embodiment, contacting the solution with a porous cathodic material comprises passing the solution through the porous cathodic material. In another embodiment, the method further comprises removing the selectively deposited metal from the porous cathodic material.

The present invention is also directed to an apparatus for the selective deposition of metals and metal compounds from a solution onto a conductive porous cathodic material. The present invention also relates to a method for selectively depositing metals and metal compounds from a solution onto a conductive porous cathodic material.

The system, apparatus, and method of the present invention may be used for the selective deposition of metal from a solution. The terms "system" and "apparatus" are used interchangeably through the specification and claims.

The solution may originate from a variety of sources including, but not limited to, recycling facilities, scrap facilities, mining operations, waste deposits from mining, oil, and gas production and/or refinement, chemical production facilities, electronic waste facilities, manufacturing plants, water treatment plants, scientific research facilities, or a combination thereof. The apparatus and method of the present invention may be used to remove a metal of choice from a solution. The removed metal may be used in the manufacture of other products including, but not limited to, batteries, semiconductors, purified metal, electronic components, magnets, or a combination thereof. Metal may be removed from a solution by deposition onto a part of the apparatus or as a pass-through product where unwanted metal is deposited, thereby leaving the metal of interest for collection. The apparatus and method may be used as a pre- or post-processing step in a larger process to remove, extract, or purify a solution or a metal. One benefit of the apparatus and method is the improved selectivity and collection efficacy for a desired metal from a solution without the need for substantial pre-processing, i.e., with multiple chemical reaction steps, of the solution. The apparatus and method of the present invention allow for the selective deposition of one or more metals of interest at lower and with greater efficiency compared to other apparatuses and methods.

The present invention is also directed to a use of a chemical deposition apparatus and system for the selective deposition of at least one metal onto a porous cathodic material. The present invention is further directed to a use of a method for electrochemically depositing at least one metal on a porous cathodic material.

The present invention may be used to extract metal from a solution and/or a compound comprising one or more metal through redox reactions that form metal compounds more amendable to extraction. The present invention may form metal hydroxides and deposit the metal hydroxides onto a porous cathodic material. The present invention may also be used to form metal oxides at or in proximity to a porous anodic material. Metal and/or metal compound products recovered by the present invention may be removed and collected. The present invention may be used to extract metal from materials including, but not limited to, black mass, ore, concentrates, tailings, batteries, magnets, non-ferrous scrap, and used electronics.

The present invention comprises an electrochemical deposition apparatus and system. The electrochemical deposition apparatus/system may comprise a flow-through electrochemical deposition system to selectively recover metals. The selectively recovered metals may comprise, but are not limited to, RE metals. The selectively recovered metals may comprise, but are not limited to, neodymium ("Nd"), praseodymium ("Pr"), dysprosium ("Dy), copper ("Cu"), lithium ("Li"), sodium ("Na"), magnesium ("Mg"), potassium ("K"), calcium ("Ca"), titanium ("Ti"), vanadium ("V"), chromium ("Cr"), manganese ("Mn"), iron ("Fe"), cobalt ("Co"), nickel ("Ni"), cadmium ("Cd"), zinc ("Zn"), aluminum ("Al"), silicon ("Si"), silver ("Ag"), tin ("Sn"), platinum ("Pt"), gold ("Au"), bismuth ("Bi"), lanthanum ("La"), europium ("Eu"), gallium ("Ga"), scandium ("Sc"), strontium ("Sr"), yttrium ("Y"), zirconium ("Zr"), niobium ("Nb"), molybdenum ("Mo"), ruthenium ("Ru"), rhodium ("Rh"), palladium ("Pd"), indium ("In"), hafnium ("Hf"), tantalum ("Ta"), tungsten ("W"), rhenium ("Re"), osmium ("Os"), iridium ("Ir"), mercury ("Hg"), lead ("Pb"), polonium ("Po"), cerium ("Ce"), samarium ("Sm"), erbium ("Er"), ytterbium ("Yb"), thorium ("Th"), uranium ("U"), plutonium ("Pu"), terbium ("Tb"), promethium ("Pm"), tellurium ("Te"), or a combination thereof. Metals may be recovered from conventional (e.g., virgin ore) or unconventional resources (e.g., end-of-life magnets and batteries or coal fly ash or mine tailings). The present invention can be implemented in existing facilities to process metal or metals on-site. The present invention can reduce operating costs, energy requirements, and $CO_2$ emissions by up to at least about 50% compared to raw ore mining. The present invention can also reduce greenhouse gas emissions (e.g., by about 280 kg $CO_2$ per kg of metal product produced) as compared to raw ore mining.

The electrochemical deposition apparatus and system may comprise a porous cathodic material. Cathodic alkali production may be used to deposit metal hydroxides onto the porous cathodic material. Alternative mechanisms of metal deposition may include direct cathodic reduction or direct anodic oxidation or indirect oxidation or indirect reduction. The electrochemistry may not be limited by slow diffusive mass transfer. The electrochemical deposition apparatus may comprise a flow-through system. The flow-through systems may maintain rapid deposition kinetics. The deposition kinetics may occur at a rate of about at least 200 g $hr^{-1}$ $m^{-2}$. Deposited metals may be, but are not limited to, of the chemical formula $M^{n+}(OH)_n$, $(M^{n+})_m O_{(n\times m)/2}$, or $M^0$. Deposited metals may also be, but not limited to, metal carbonates or sulfates. The electrochemical deposition apparatus and system may comprise a modular membrane-like format. There may be a plurality of electrochemical deposition apparatuses/systems. The plurality of electrochemical deposition apparatuses or systems may operate in parallel. The plurality of electrochemical deposition apparatuses or systems may also operate in series. Operating the plurality of electrochemical deposition apparatuses or systems in series may facilitate sequential redox processes.

Objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practice of the invention.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings.

DETAILED DESCRIPTION OF THE INVENTION

Figure 1:
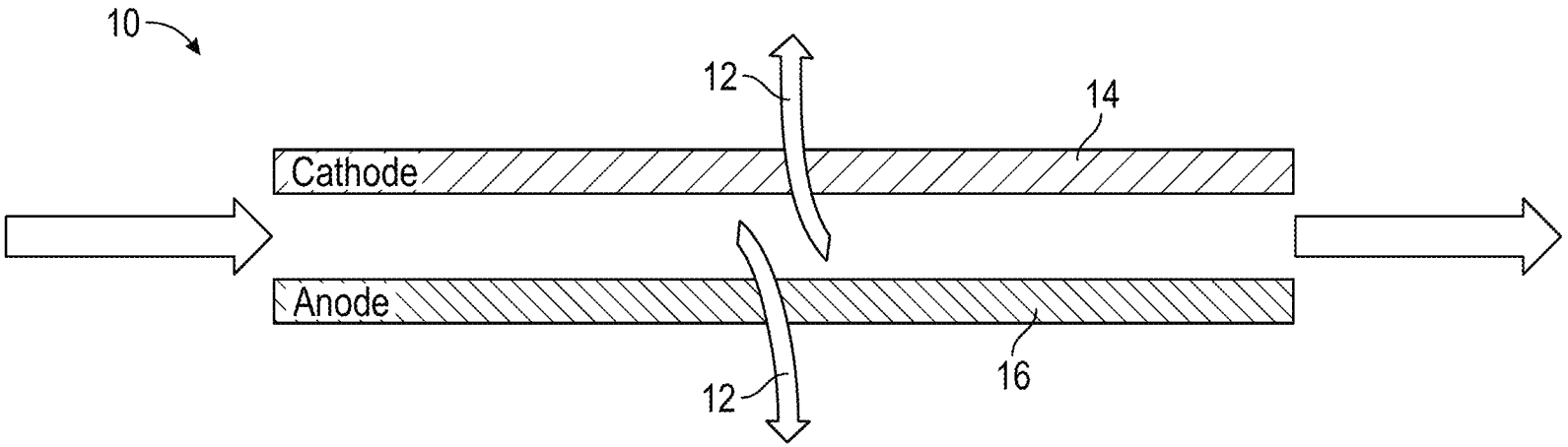
FIG. 1 is an illustration of the electrochemical deposition of the present invention depicting feed flowing through the porous cathodic material and anode.

The present invention is directed to an electrochemical deposition apparatus, system, and method. The present invention may be used to extract metal from a solution and/or a compound comprising one or more metals through redox reactions that form metal compounds and are amendable to extraction. The redox reactions may change the charge of a given metal, for example, from a 2+ charge to a 1+ or 3+ charge. The present invention may form metal hydroxides and deposit the metal hydroxides onto a porous cathodic material. The present invention may also be used to form metal oxides at or in proximity to a porous anodic material. Metal hydroxides or oxides may be selectively formed to remove them as impurities and collect more high-value metal. Metal and/or metal compound products formed by the present invention may be removed from the present invention and collected. Removal from the present invention may be accomplished by changes in charge, flow, or chemistry within the present invention. Metal may be collected by a filter, membrane, column, or other separation method for a specific metal. The present invention may be used to extract metal from materials including, but not limited to, black mass, ore, concentrates, tailings, batteries, magnets, non-ferrous scrap, and used electronics. The present invention may be used to extract metal from e.g., coal fly ash and lithium batteries. The lithium batteries may comprise, but are not limited to, lithium nickel magnesium cobalt oxide batteries. The present invention may also be used in the production of lithium batteries from e.g., nickel, magnesium, and cobalt. The present invention may be further used to produce acids and bases, including, but not limited to, sulfuric acid and sodium hydroxide.

The term "metal" or "metals" is defined in the specification and claims as a compound, mixture, or substance comprising a metal atom. The term "metal" or "metals" includes, but is not limited to, metal hydroxides, metal oxides, metal salts, elemental metals, metal ions, non-ionic metals, minerals, or a combination thereof.

The term "acid" or "acids" is defined in the specification and claims as a solution with a pH below 7.

The term "buffer" or "buffers" is defined in the specification and claims as a chemical compound that, when added to a solution, causes that solution to resist changes in pH relative to the solution that does not comprise the chemical compound.

The term "leach" is defined in the specification and claims as a process used to liberate, extract, free, or remove metal or metals from a material.

The terms "redox", "redox reaction", or "reduction-oxidation reaction" are defined in the specification and claims as a chemical reaction that involves the reduction and/or oxidation of a chemical species.

The present invention is directed to an electrochemical deposition apparatus or system to precipitate and deposit metal. The electrochemical deposition apparatus may comprise: a housing; a porous cathodic material, which may act as a cathode, wherein a metal is deposited onto the surface of the porous cathodic material; an anode; an inlet; and an outlet. The porous cathodic material may comprise carbon, a metal, a metal compound, a porous polymer, a porous ceramic or a combination thereof. The porous cathodic material may also comprise heterogenous materials, e.g., a mixed carbon, metal, polymer, or ceramic material. The porous cathodic material may also comprise a metal or a metal oxide catalyst, a protective layer, a polymer binder or a combination therefor. The porous cathodic material may also comprise a material or media made into a porous structure, e.g., grains, fibers, or flasks. The housing may comprise, but is not limited to, clear plastic, polycarbonate, polypropylene, polyvinylchloride, polytetrafluoroethylene, acrylic, and/or metal support such that the electrochemical deposition process can be visually observed. The electrochemical deposition apparatus may further comprise a current collector. The current collector may comprise, but is not limited to, Ti. The electrochemical deposition apparatus may further comprise an O-ring seal. The electrochemical deposition apparatus may further comprise a hole to avoid the current collector from breaking the O-ring seal. The electrochemical deposition apparatus may be used in combination with traditional metal extraction methods, for example, calcination and/or chemical precipitation.

The method of the present invention may comprise passing a feed through an electrochemical deposition apparatus; contacting the feed with a porous cathodic material; depositing a metal onto the surface of the porous cathodic material to form a permeate, passing the permeate out of the electrochemical deposition apparatus; removing the deposited metal from the surface of the porous cathodic material to form a concentrate; and passing the concentrate through the electrochemical deposition apparatus. The method may be used in combination with traditional metal concentration methods, for example, calcination and/or chemical precipitation.

Turning now to the figures, which show non-limiting and alternative embodiments, of the invention, FIG. 1 illustrates electrochemical deposition apparatus 10 of the present invention, where permeate flows 12 simultaneously across and/or through porous cathodic material 14 and anode 16.

Figure 2:
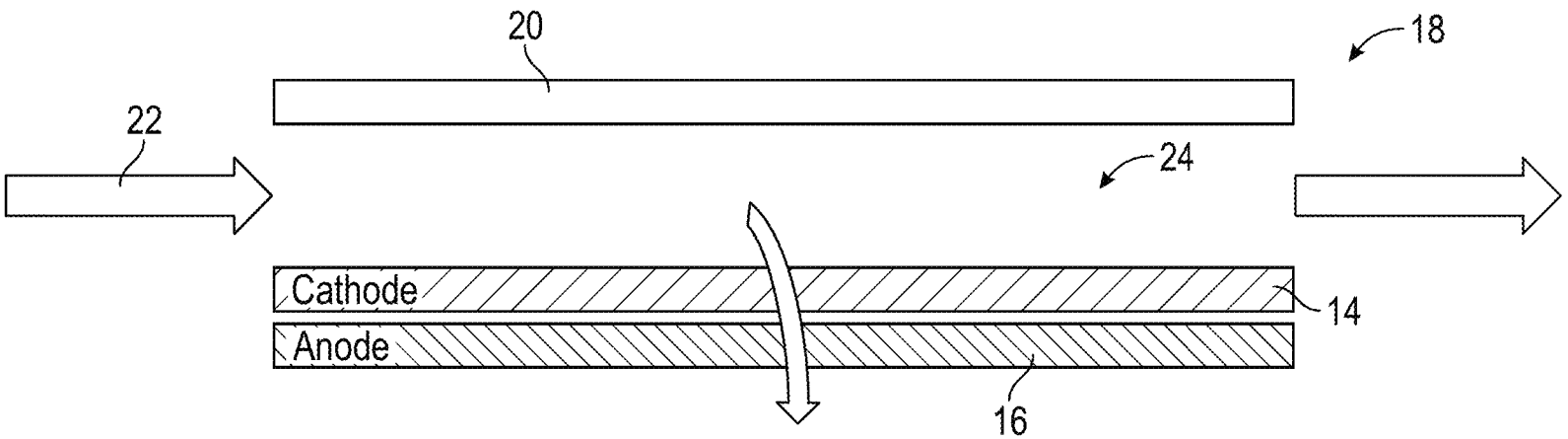
FIG. 2 is an illustration of the electrochemical deposition apparatus of the present invention comprising an impermeable boundary.

FIG. 2 illustrates electrochemical deposition apparatus 18 of the present invention comprising an impermeable boundary 20 that forces feed 22 into cavity 24 and across and/or through porous cathodic materials 14 and anode 16.

Figure 3:
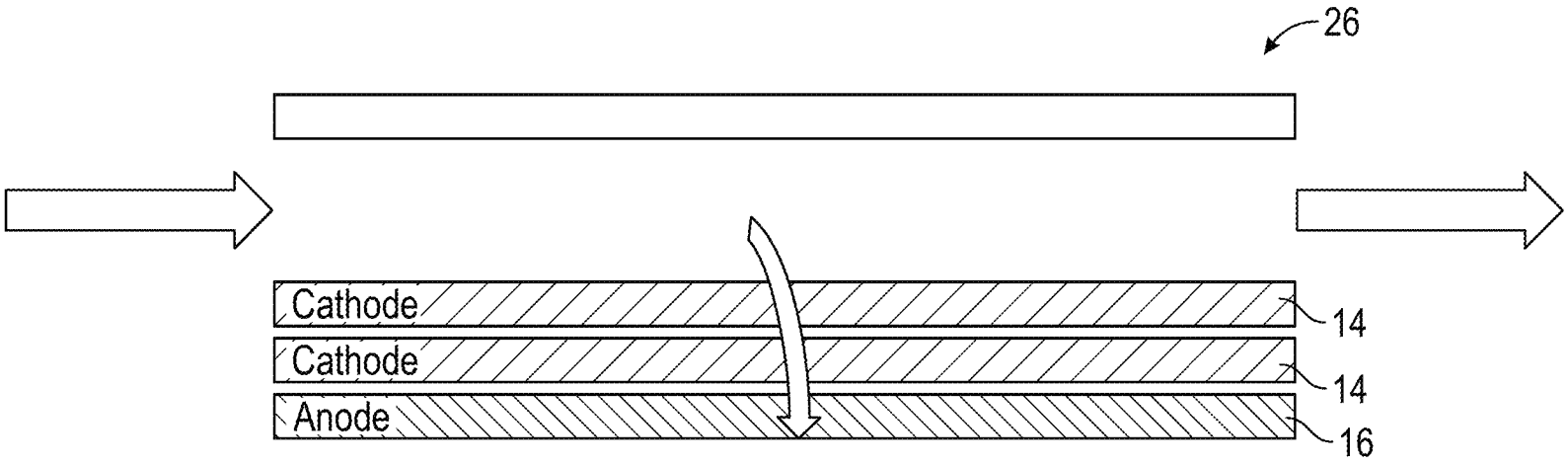
FIG. 3 is an illustration of the electrochemical deposition apparatus of the present invention comprising an impermeable boundary and two porous cathodic materials in a stacked configuration.

FIG. 3 illustrates electrochemical deposition apparatus 26 of the present invention, comprising two stacked porous cathodic materials 14. Although FIG. 3 illustrates three stacked electrodes, any number of porous cathodic materials 14 and anodes 16 may be stacked in any order.

Figure 4:
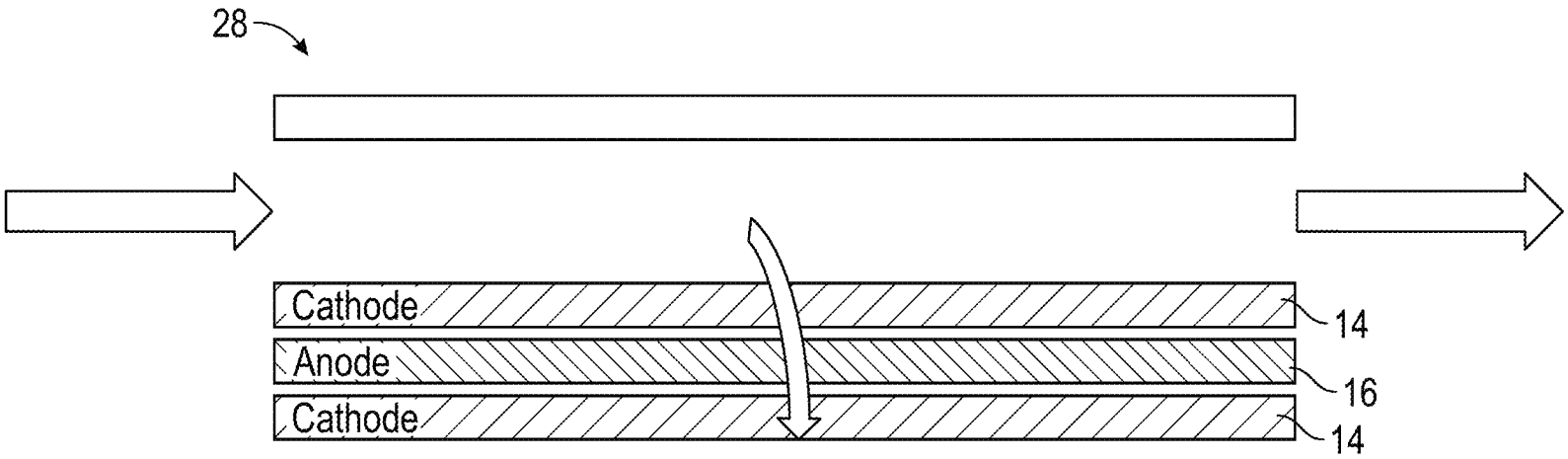
FIG. 4 is an illustration of the electrochemical deposition apparatus of the present invention comprising an impermeable boundary and an anode positioned between two porous cathodic materials.

FIG. 4 illustrates electrochemical deposition apparatus 28 of the present invention, comprising alternating porous cathodic materials 14 and anode 16. Although FIG. 4 illustrates three stacked electrodes, any number of porous cathodic materials 14 and anodes 16 may be stacked in any order.

Figure 5:
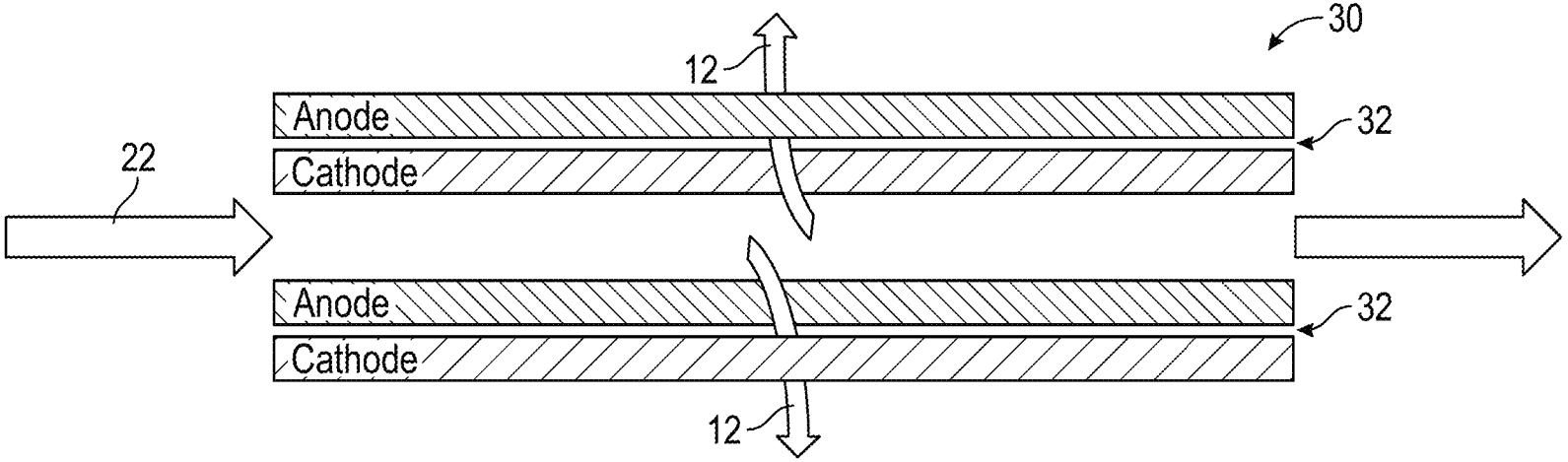
FIG. 5 is an illustration of the electrochemical deposition apparatus of the present invention comprising each permeate flow passing across and/or through a porous cathodic material and an anode.

FIG. 5 illustrates electrochemical deposition apparatus 30 of the present invention, where feed 22 enters inter-electrode region 32 and contacts porous cathodic material 14 and anode 16. Each permeate flow 12 then passes across and/or through porous cathodic material 14 and anode 16.

Figure 6:
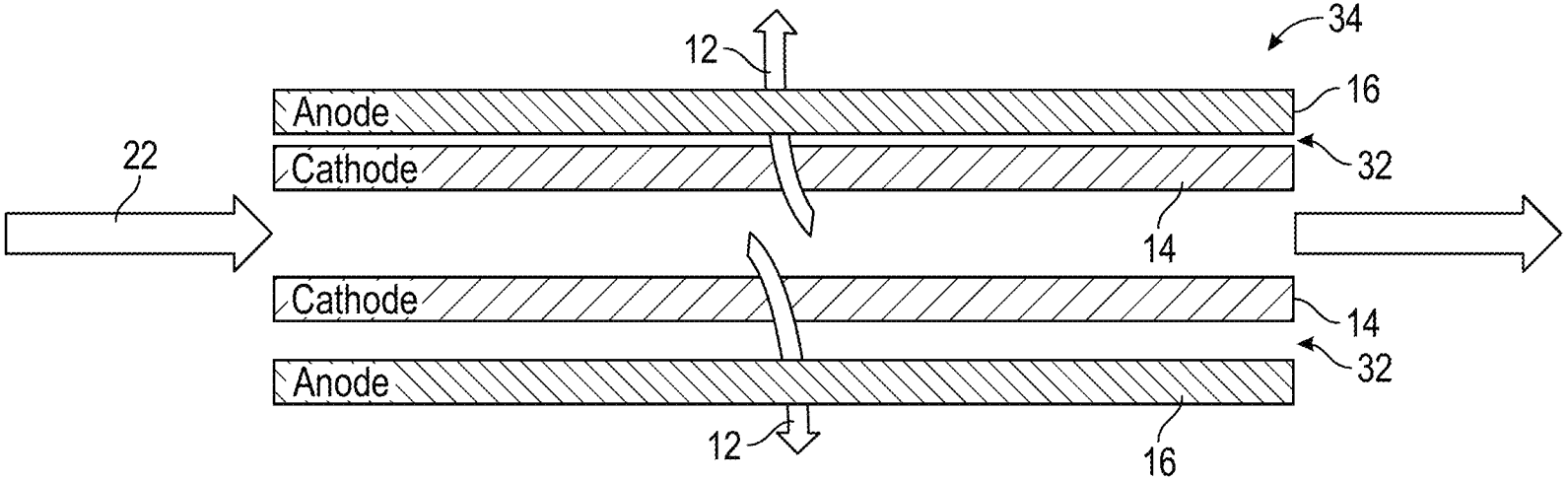
FIG. 6 is an illustration of the electrochemical deposition apparatus of the present invention comprising each permeate flow first passing across and/or through a porous cathodic material and then an anode.

FIG. 6 illustrates electrochemical deposition apparatus 34 of the present invention, where feed 22 enters inter-electrode region 32 and contacts porous cathodic materials 14. Permeate flows 12 must contact and pass across and/or through porous cathodic materials 14 before contacting and passing through anodes 16.

Figure 7:
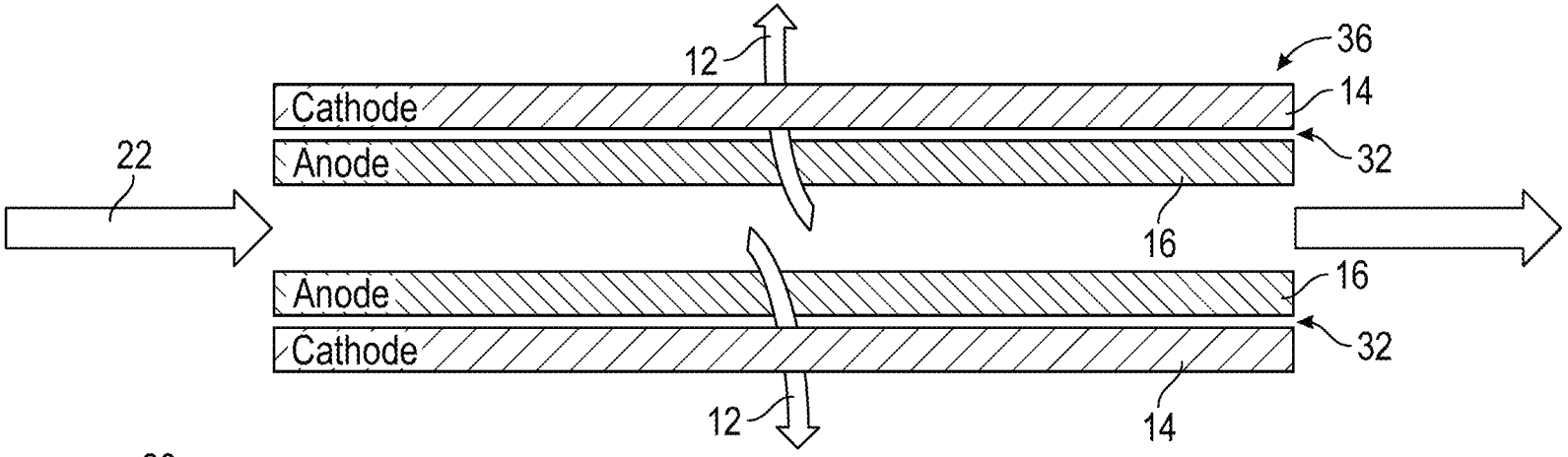
FIG. 7 is an illustration of the electrochemical deposition apparatus of the present invention comprising each permeate flow first passing across and/or through an anode and then a porous cathodic material.

FIG. 7 illustrates electrochemical deposition apparatus 36 of the present invention, where feed 22 enters inter-electrode region 32 and contacts anodes 16. Permeate flows 12 must contact and a pass across and/or through anodes 16 before contacting and passing through porous cathodic materials 14.

Figure 8:
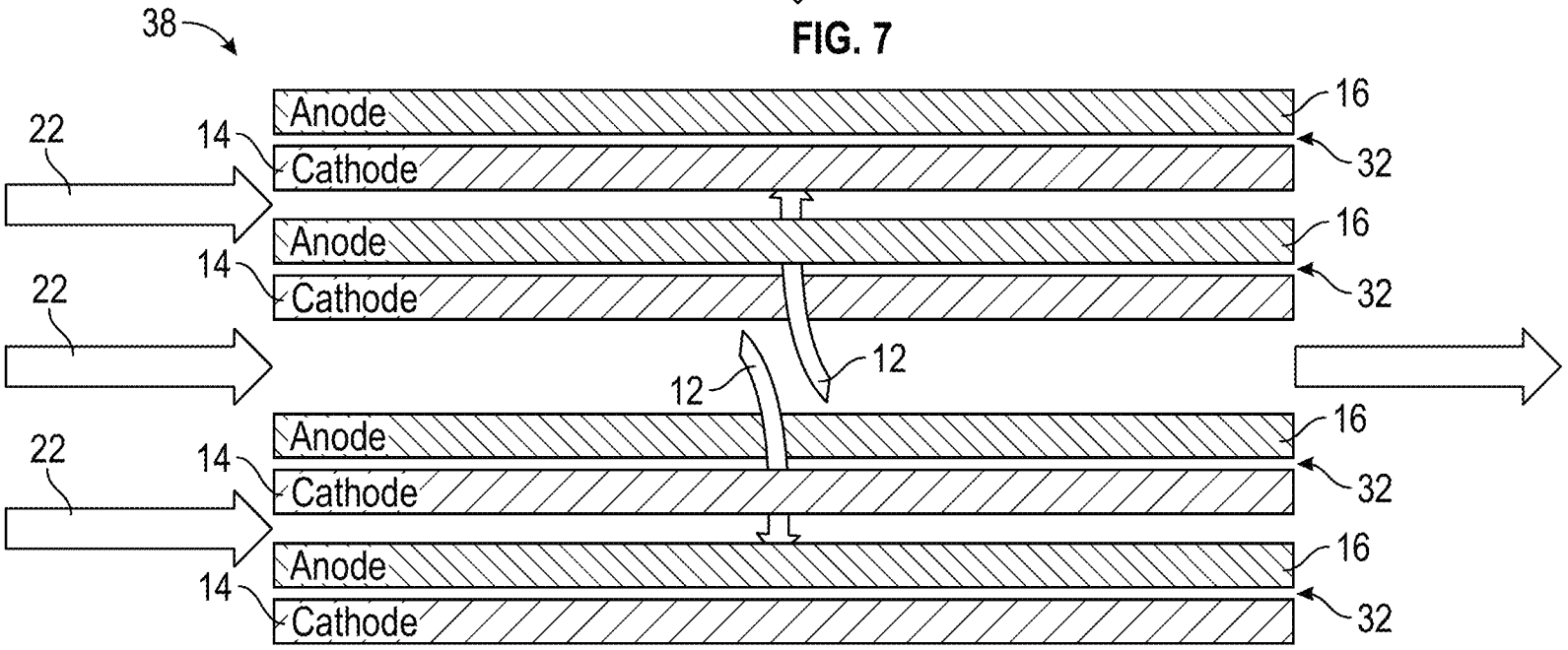
FIG. 8 is an illustration of the electrochemical deposition apparatus of the present invention depicting porous cathodic materials and anodes in a stacked configuration.

FIG. 8 illustrates electrochemical deposition apparatus 38 of the present invention. A plurality of feeds 22 enter a plurality of inter-electrode regions 32. Permeate flows 12 simultaneously pass out of the plurality of inter-electrode regions 32 and across and/or through a plurality of porous cathodic materials 14 and anodes 16 arranged in series.

Figure 9:
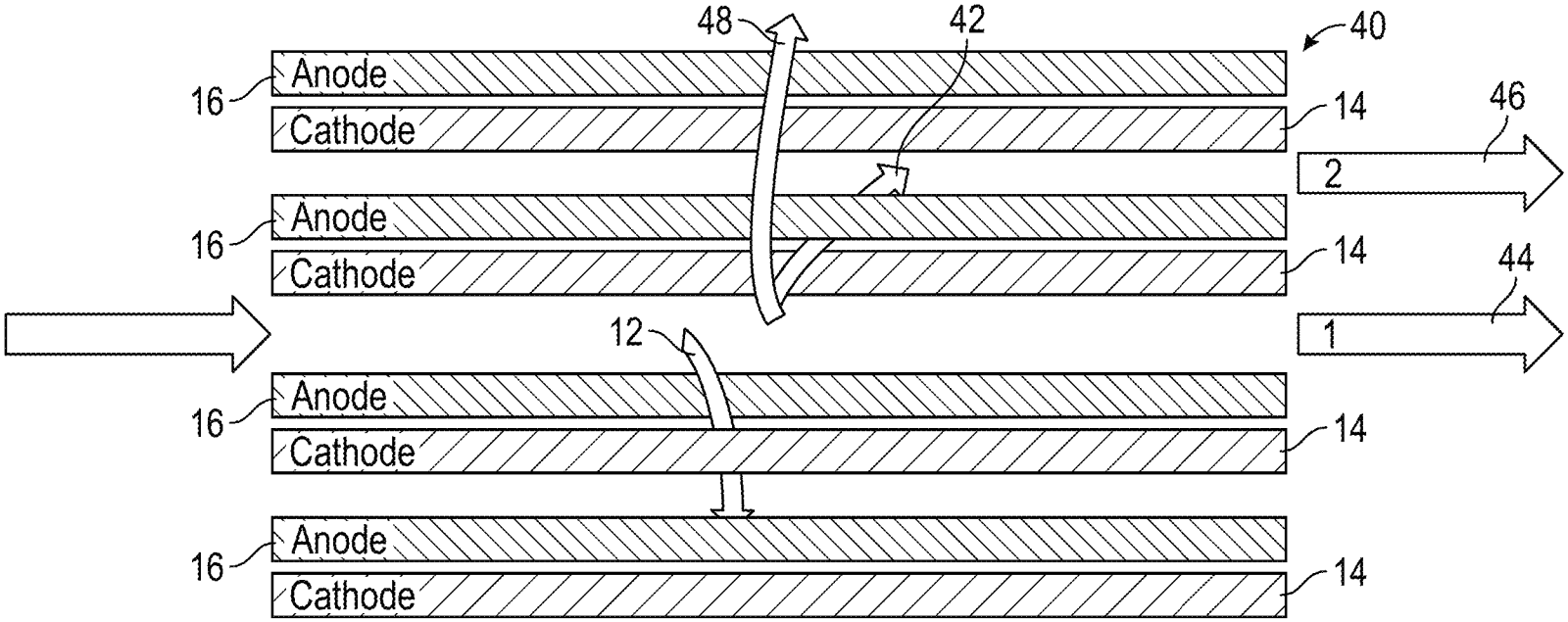
FIG. 9 is an illustration of the electrochemical deposition apparatus of the present invention depicting porous cathodic materials and anodes in a stacked configuration and with different feed and/or permeate flows.

FIG. 9 illustrates electrochemical deposition apparatus 40 of the present invention. Flow 42 shows the path of a second metal that is deposited onto porous cathodic material 14. A plurality of metals may be deposited on each porous cathodic material 14 when plurality of porous cathodic materials 14 and anodes 16 are arranged in series. A different metal may be deposited on each porous cathodic material 14. As shown in FIG. 9, two different metals may be released from two different porous cathodic materials 14 resulting in two different concentrates and/or extracts 44 and 46. The number of concentrates and/or raffinates comprising a metal or metal oxide depends on the number of porous cathodic materials 14, i.e. three, four, or five (or more) porous cathodic materials 14, may facilitate the deposition of e.g., three to five (or more) different metals, and yield three to five (or more) concentrates and/or raffinates. Although this Figure shows three to five metals, concentrates, and/or raffinates, any number of metals, concentrates, and/or raffinates can be extracted. Flow 48 shows the path of feed 22 passing freely through electrochemical deposition apparatus 40 metal depositing on porous cathodic material 14. Flow 48 may be used to recover metals indirectly by depositing metals that are not of interest.

Figure 10:
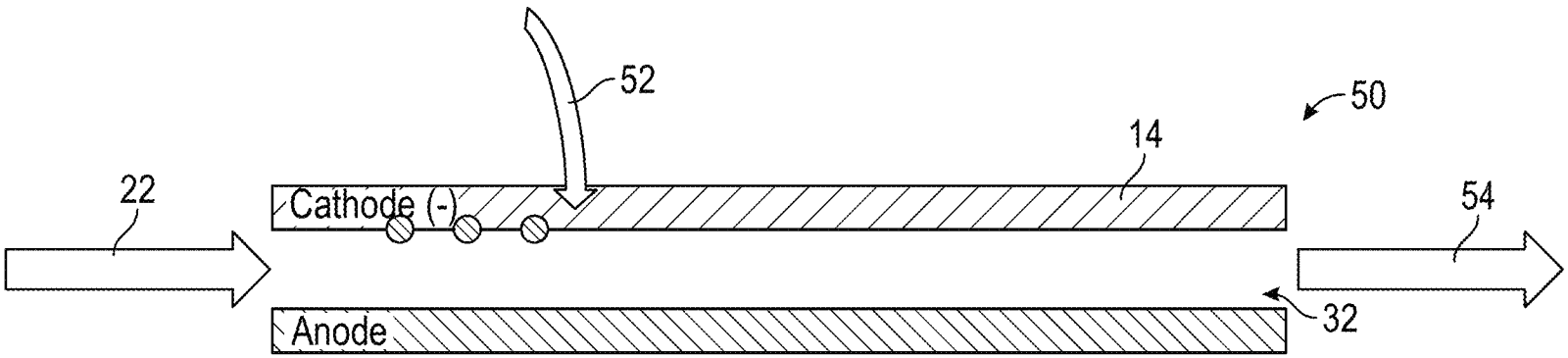
FIG. 10 is an illustration of the electrochemical deposition apparatus of the present invention depicting two feed sources.

FIG. 10 illustrates electrochemical deposition apparatus 50 of the present invention, where feed 22 is simultaneously passed with outside-in flow 52 into inter-electrode region 32 by passing feed 22 and outside-in flow 52 across porous cathodic material 14 and directly into inter-electrode region 32. Outside-in flow 52 may comprise feed 22 or recycled concentrate 54, or any other source of metal solution.

Figure 11:
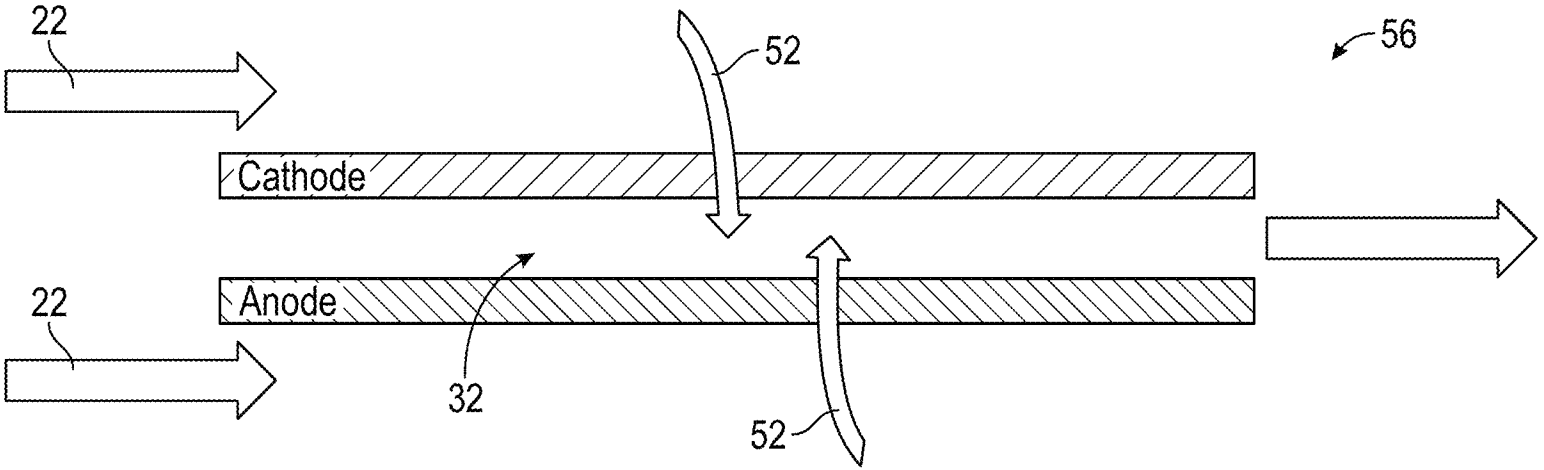
FIG. 11 is an illustration of the electrochemical deposition apparatus of the present invention comprising two feed sources merging in a central compartment to form a single permeate.

FIG. 11 illustrates electrochemical deposition apparatus 56 of the present invention, where feeds 22 and outside-in flows 52 simultaneously enter and mix within inter-electrode region 32. Feeds 22 and outside-in flows 52 of electrochemical deposition apparatus 56 may comprise the same solution or different solutions.

Figure 12:
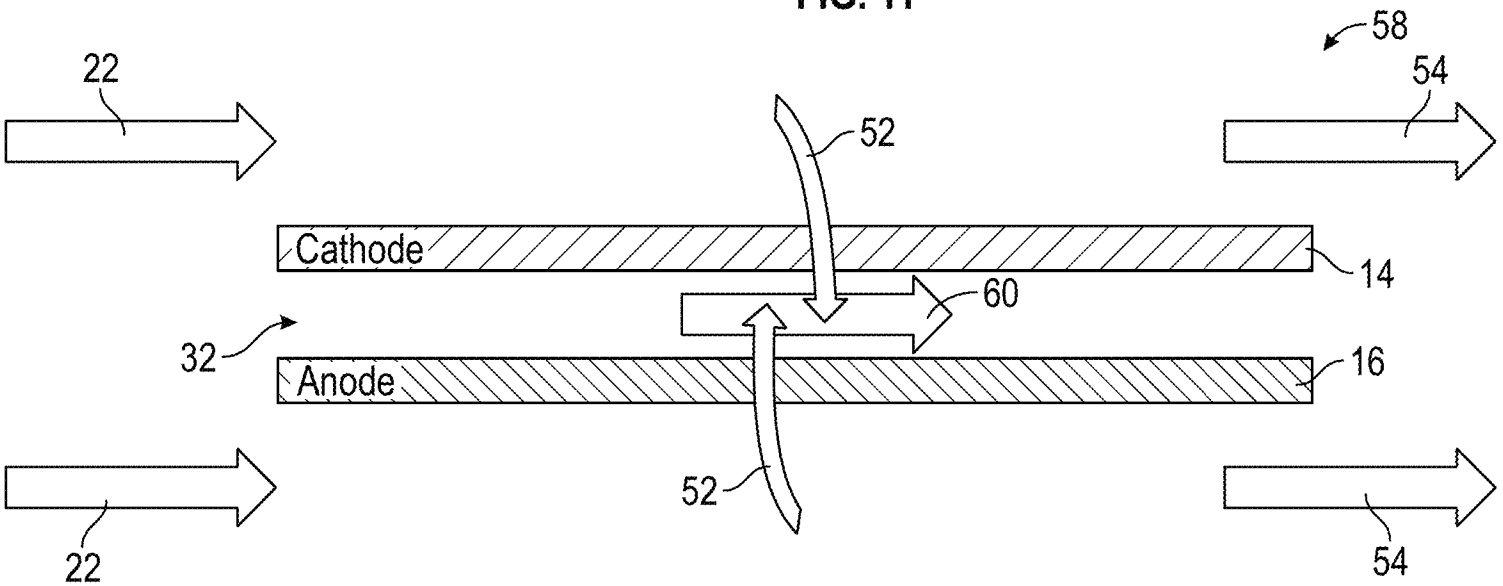
FIG. 12 is an illustration of the electrochemical deposition apparatus of the present invention comprising outside-in flows mixing in an inter-electrode region to form a mixed permeate.

FIG. 12 illustrates electrochemical deposition apparatus 58 of the present invention, where outside-in flows 52 mix within inter-electrode region 32 to form mixed permeate 60. Feeds 22 are also in contact with porous cathodic material 14 or anode 16 to form concentrate and/or raffinate 54.

Figure 13:
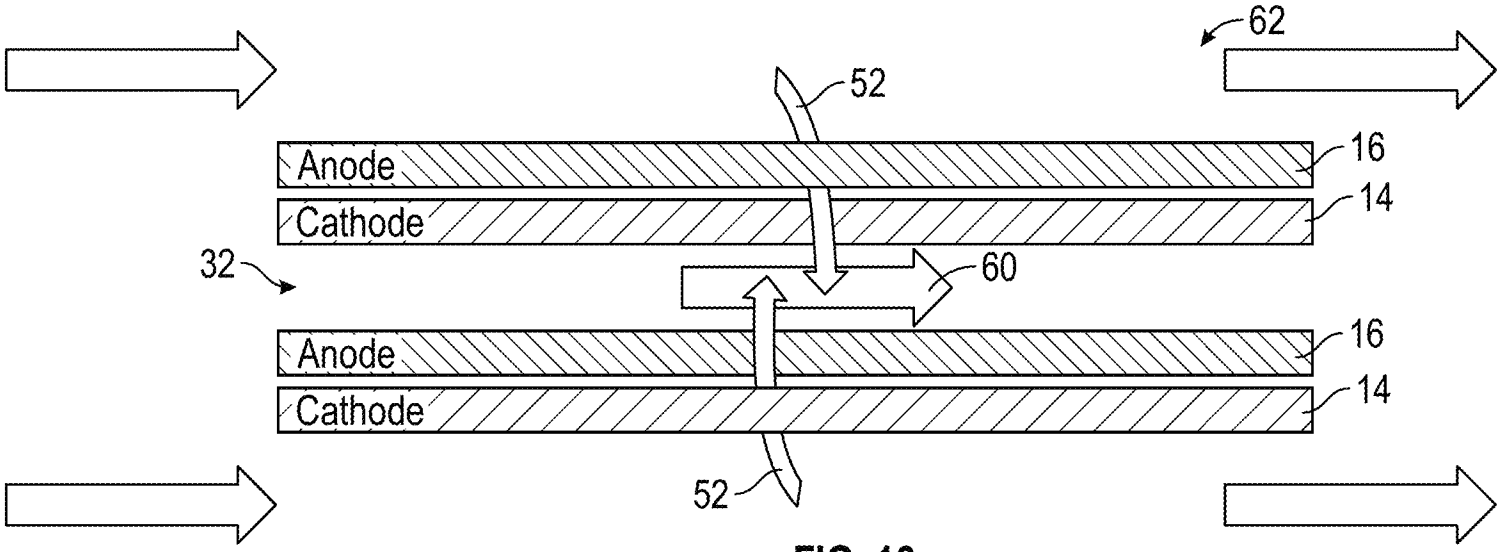
FIG. 13 is an illustration of the electrochemical deposition apparatus of the present invention comprising outside-in flows mixing in an inter-electrode region to form a mixed permeate, with each outside-in flow passing across and/or through a porous cathodic material and an anode.

FIG. 13 illustrates electrochemical deposition apparatus 62 of the present invention, where each outside-in flow 52 must contact and pass across and/or through porous cathodic material 14 and anode 16 to enter inter-electrode region 32 and form mixed permeate 60.

Figure 14:
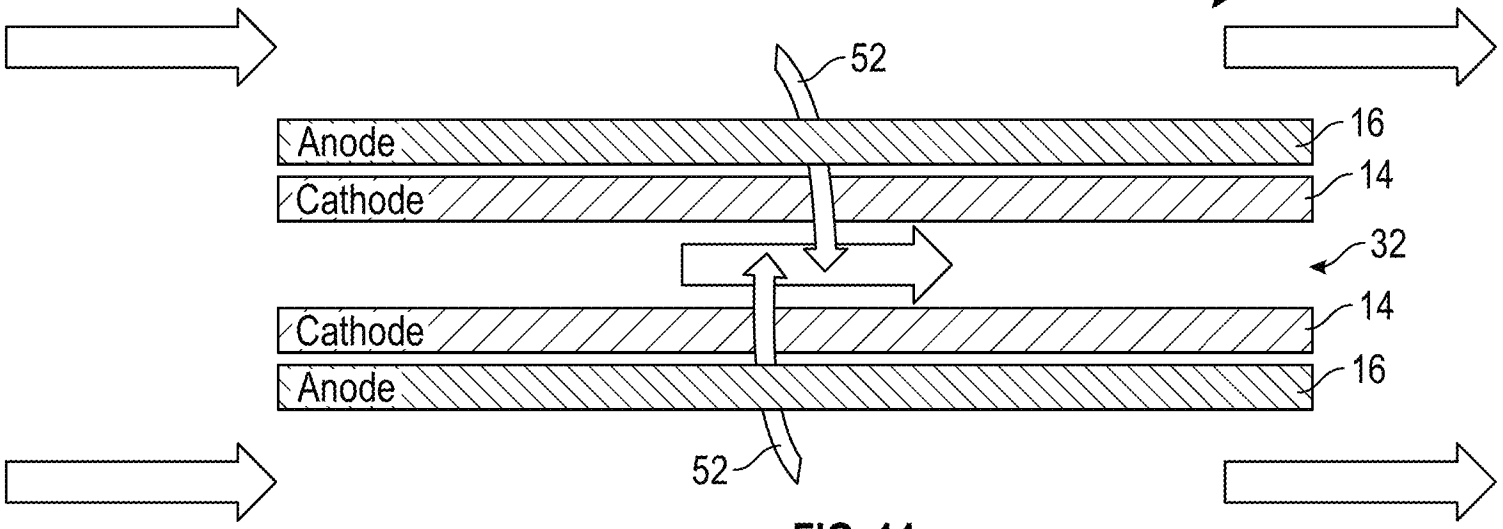
FIG. 14 is an illustration of the electrochemical deposition apparatus of the present invention comprising outside-in flows mixing in an inter-electrode region to form a mixed permeate, with each outside-in flow first passing across and/or through an anode and then a porous cathodic material.

FIG. 14 illustrates electrochemical deposition apparatus 64 of the present invention, where outside-in flows 52 must contact and pass across and/or through anodes 16 before contacting and passing through porous cathodic materials 14 and mixing within inter-electrode region 32.

Figure 15:
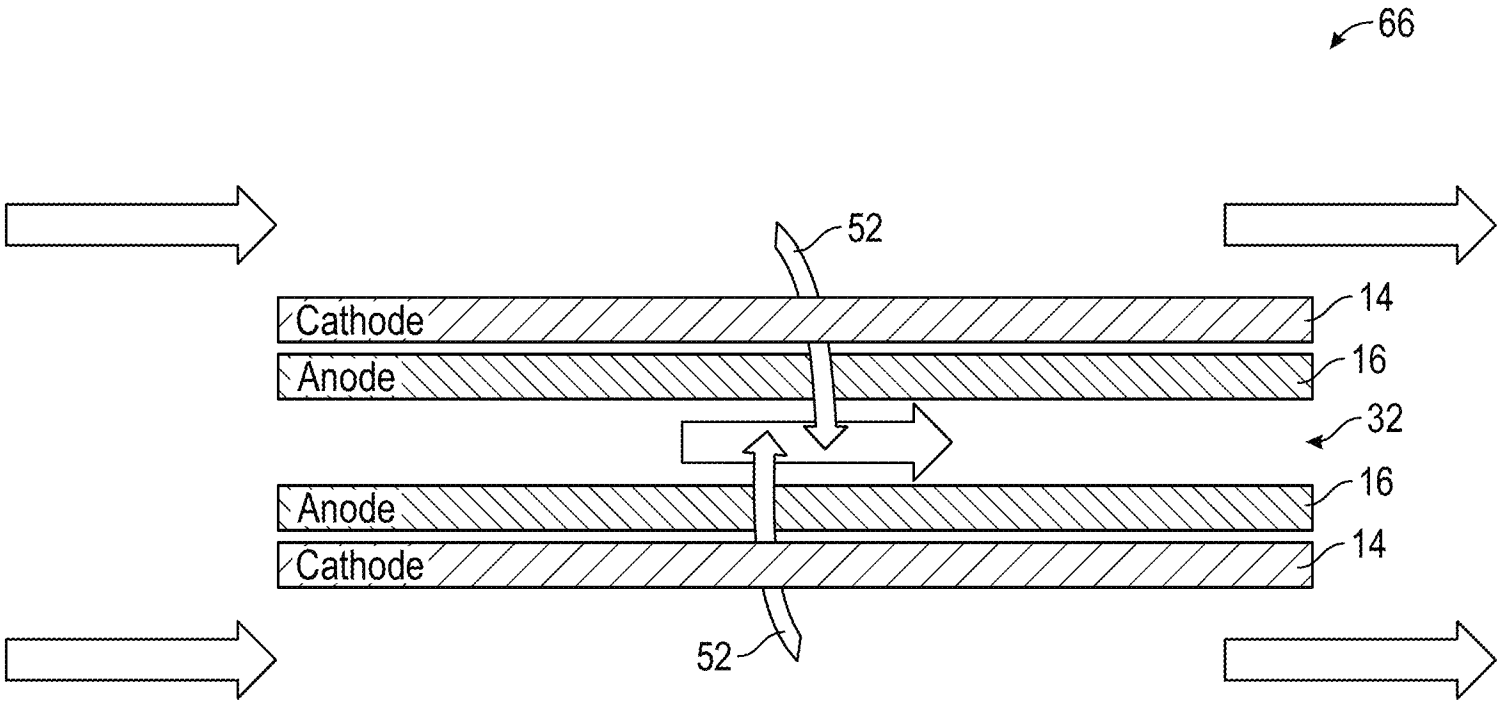
FIG. 15 is an illustration of the electrochemical deposition apparatus of the present invention comprising outside-in flows mixing in an inter-electrode region to form a mixed permeate, with each outside-in flow first passing across and/or through a porous cathodic material and then an anode.

FIG. 15 illustrates electrochemical deposition apparatus 66 of the present invention, where outside-in flows 52 must contact and pass across and/or through porous cathodic materials 14 before contacting and passing across and/or through anodes 16 and mixing within the inter-electrode region 32.

Figure 16:
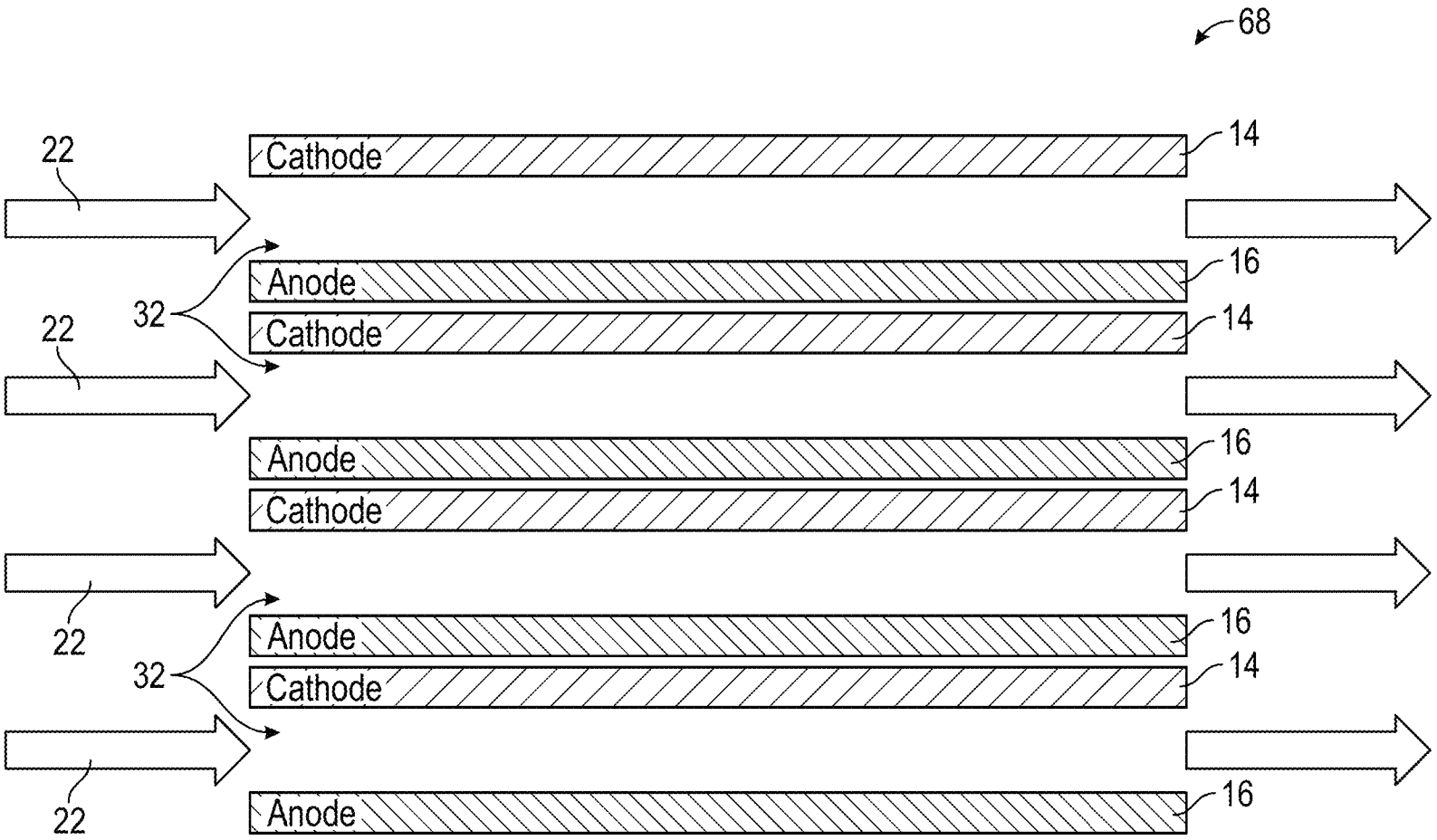
FIG. 16 is an illustration of the electrochemical deposition apparatus of the present invention comprising a plurality of porous cathodic materials and anodes operating in parallel and where a plurality of feeds is in contact with a porous cathodic material and anode.

FIG. 16 illustrates electrochemical deposition apparatus 68 of the present invention where metal deposition occurs in parallel. A plurality of feeds 22 enter a plurality of inter-electrode regions 32 in parallel. Each feed 22 contacts a porous cathodic material 14 and anode 16.

Figure 17:
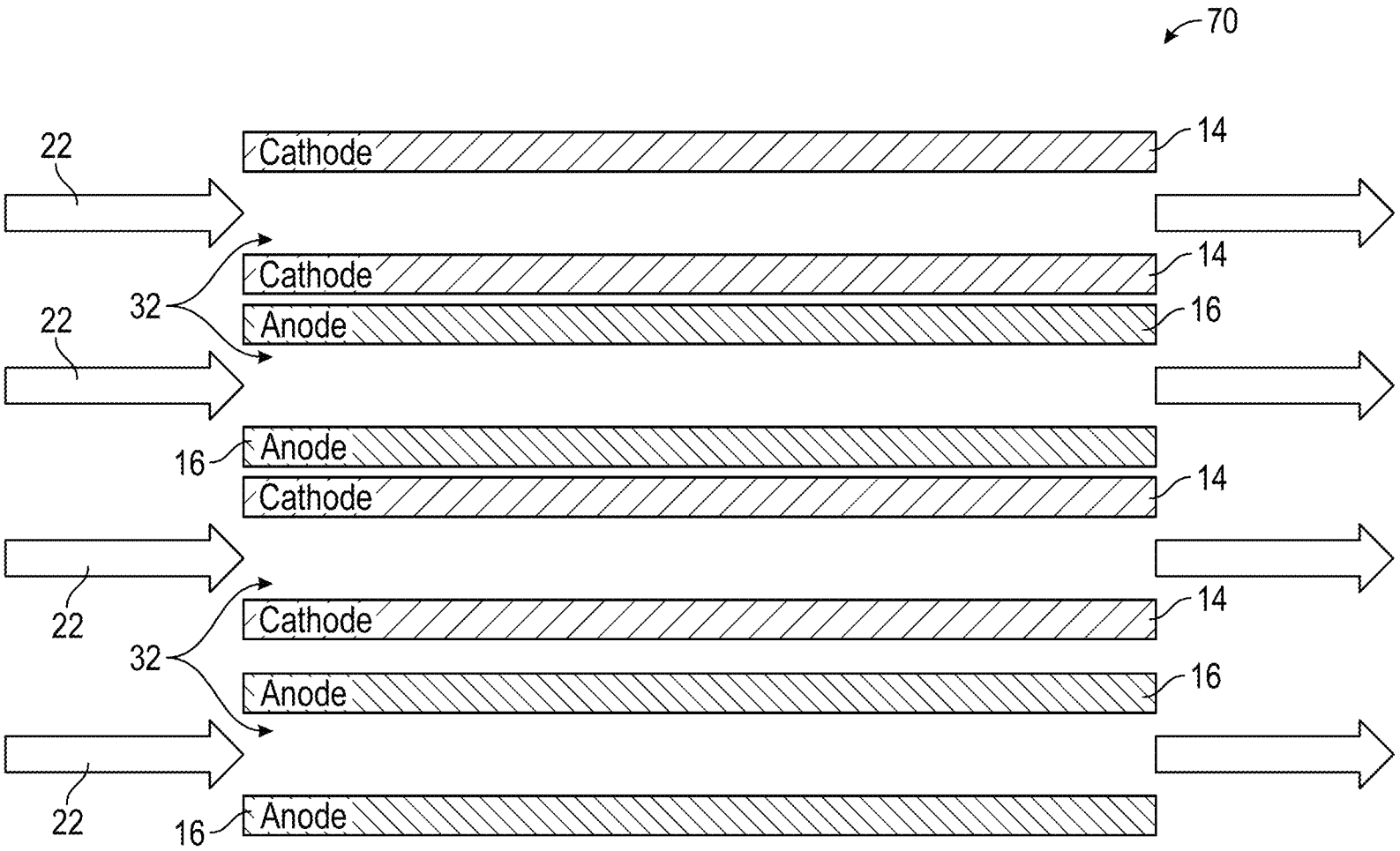
FIG. 17 is an illustration of the electrochemical deposition apparatus of the present invention comprising a plurality of porous cathodic materials and anodes operating in parallel and where a plurality of feeds is in contact with either porous cathodic materials or anodes.

FIG. 17 illustrates electrochemical deposition apparatus 70 of the present invention where a plurality of feeds 22 enter electrochemical deposition apparatus 70 in parallel and where each feed 22 contacts two porous cathodic materials 14 or two anodes 16.

Figure 18:
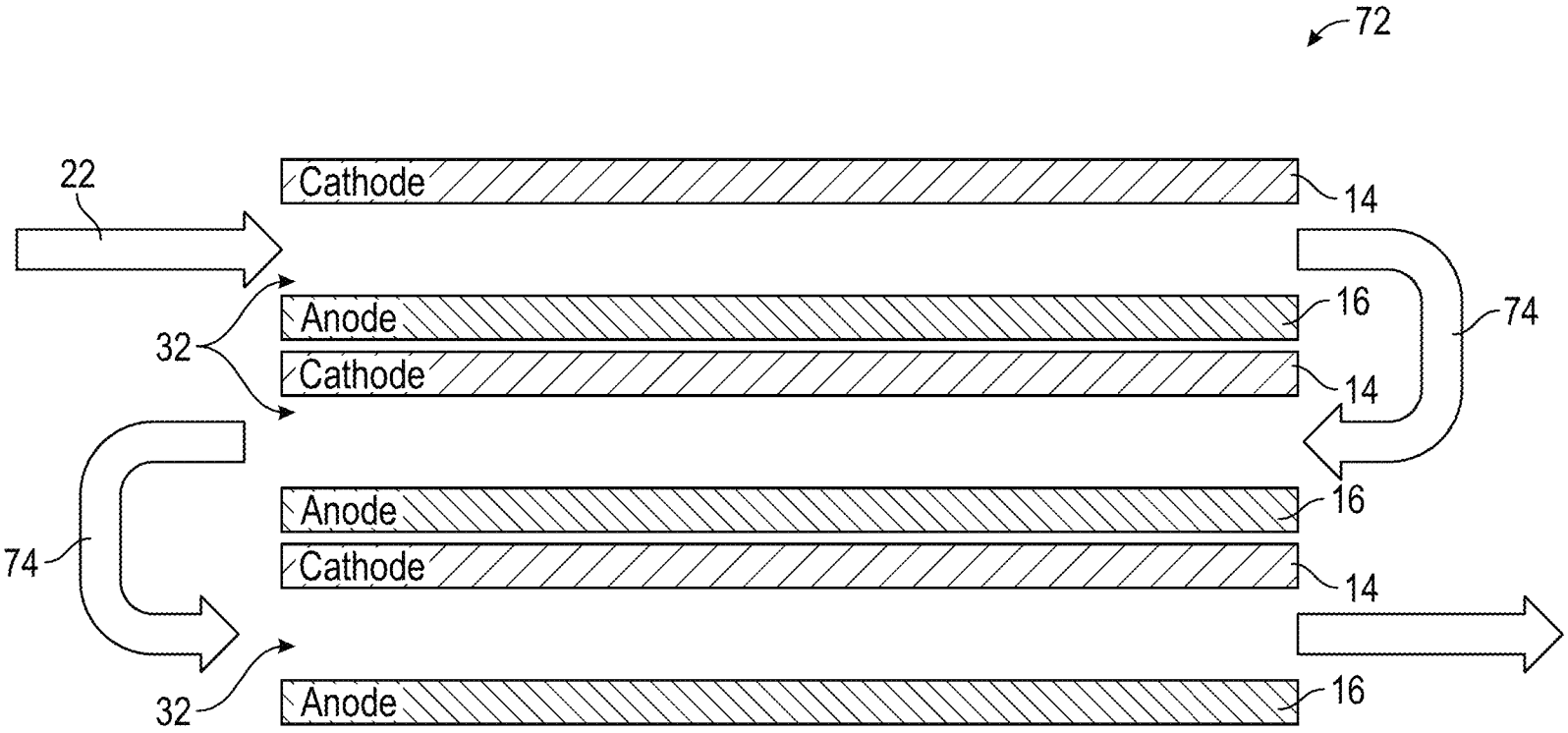
FIG. 18 is an illustration of the electrochemical deposition apparatus of the present invention comprising porous cathodic materials and anodes operating in series where a feed is in contact with a porous cathodic material and anode.

FIG. 18 illustrates electrochemical deposition apparatus 72 of the present invention where metal deposition occurs in series. Feed 22 enters into and passes out of a plurality of inter-electrode regions 32, by connecting flows 74. Feed 22 contacts porous cathodic material 14 and anode 16 in each of the plurality of inter-electrode regions 32.

Figure 19:
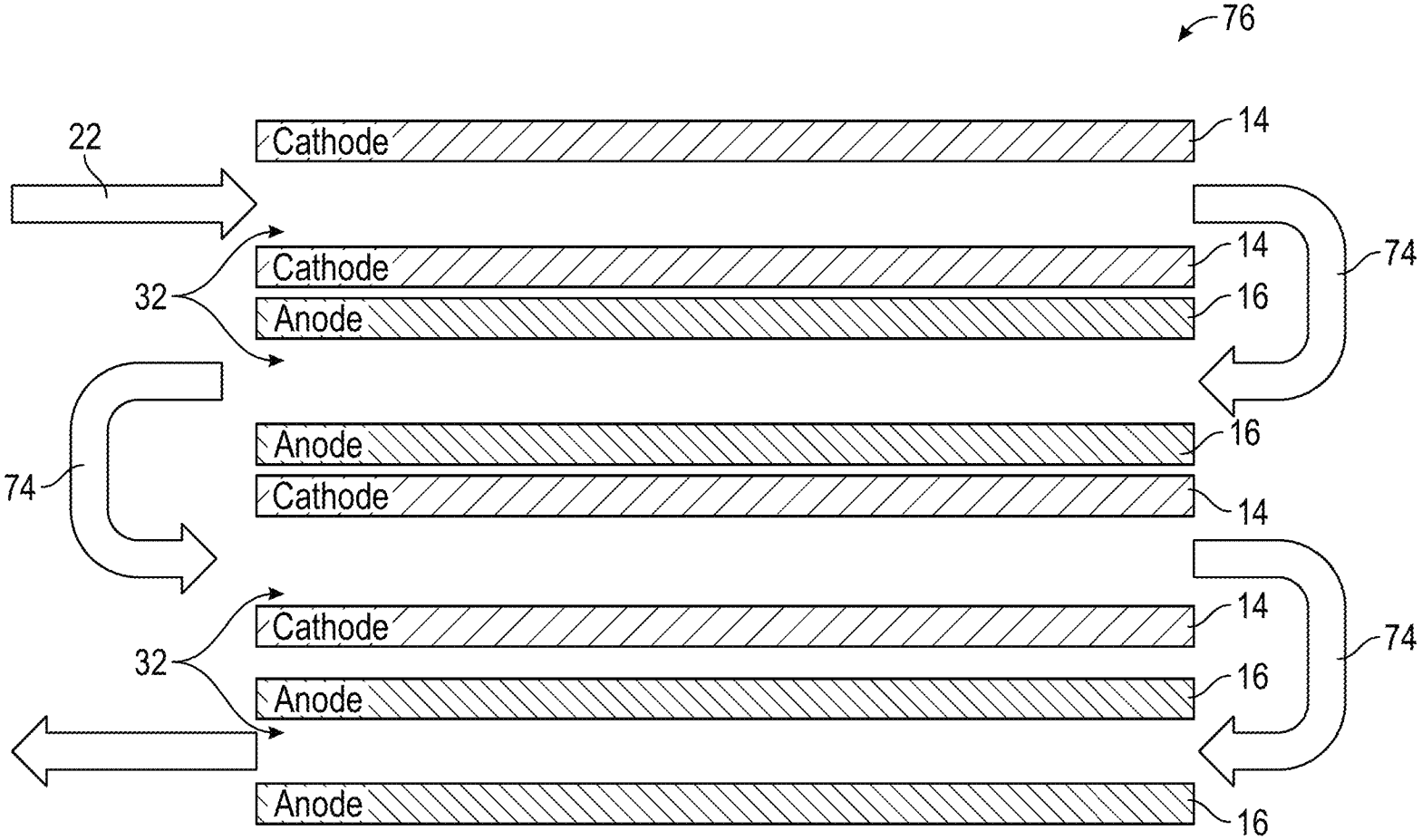
FIG. 19 is an illustration of the electrochemical deposition apparatus of the present invention comprising porous cathodic materials and anodes operating in series where a feed is in contact with a porous cathodic material or an anode.

FIG. 19 illustrates electrochemical deposition apparatus 76 of the present invention where feed 22 enters into and passes out of a plurality of inter-electrode regions 32 by connecting flows 74 and where feed 22 contacts two porous cathodic materials 14 and two anodes 16 in each inter-electrode region 32.

Figure 20:
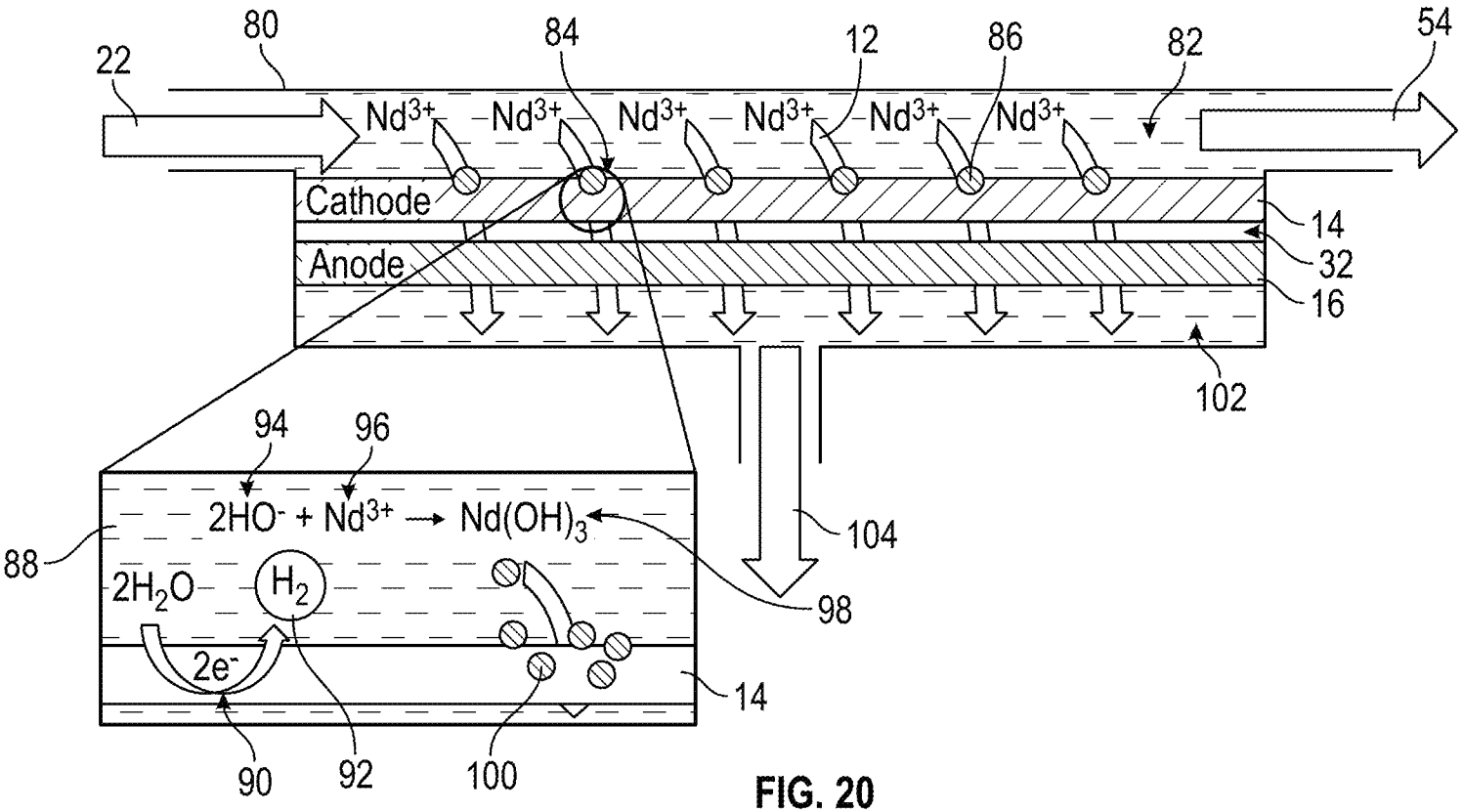
FIG. 20 is an illustration of the electrochemical deposition apparatus of the present invention for metal oxide deposition.

FIG. 20 shows electrochemical deposition apparatus 78 of the present invention comprising housing 80. Feed 22 enters cavity 82 and contacts porous cathodic material 14 to undergo a reduction-oxidation reaction. The reduction-oxidation reaction may occur at exemplary reaction area 84 to deposit metal 86. At reaction area 84, porous cathodic material 14 acts to electrolyze water 88 via redox reaction 90 to form hydrogen 92 and hydroxide ions 94. Hydroxide ions 94 react with metal ion 96 to form metal hydroxide 98. Metal hydroxide 98 deposits 100 onto the surface of porous cathodic material 14. Feed 22 passes along permeate flow 12 and traverses porous cathodic material 14, inter-electrode region 32, anode 16, and post-deposition region 102 before passing out of electrochemical deposition apparatus 78 as permeate 104. Permeate flow 12 is the path of feed 22 within a given electrochemical deposition apparatus. Flow 104 may be depleted of metal or may be free of metal. Metal 86 is released from porous cathodic material 14 to form concentrate and/or extract 54. Optionally, concentrate and/or raffinate 54 may be recycled into electrochemical deposition apparatus 78 as feed 22. Raffinate may be a solution where the valued metal has been removed from electrochemical deposition apparatus 78. Accordingly, the permeate in FIG. 20 may be raffinate.

Figure 21:
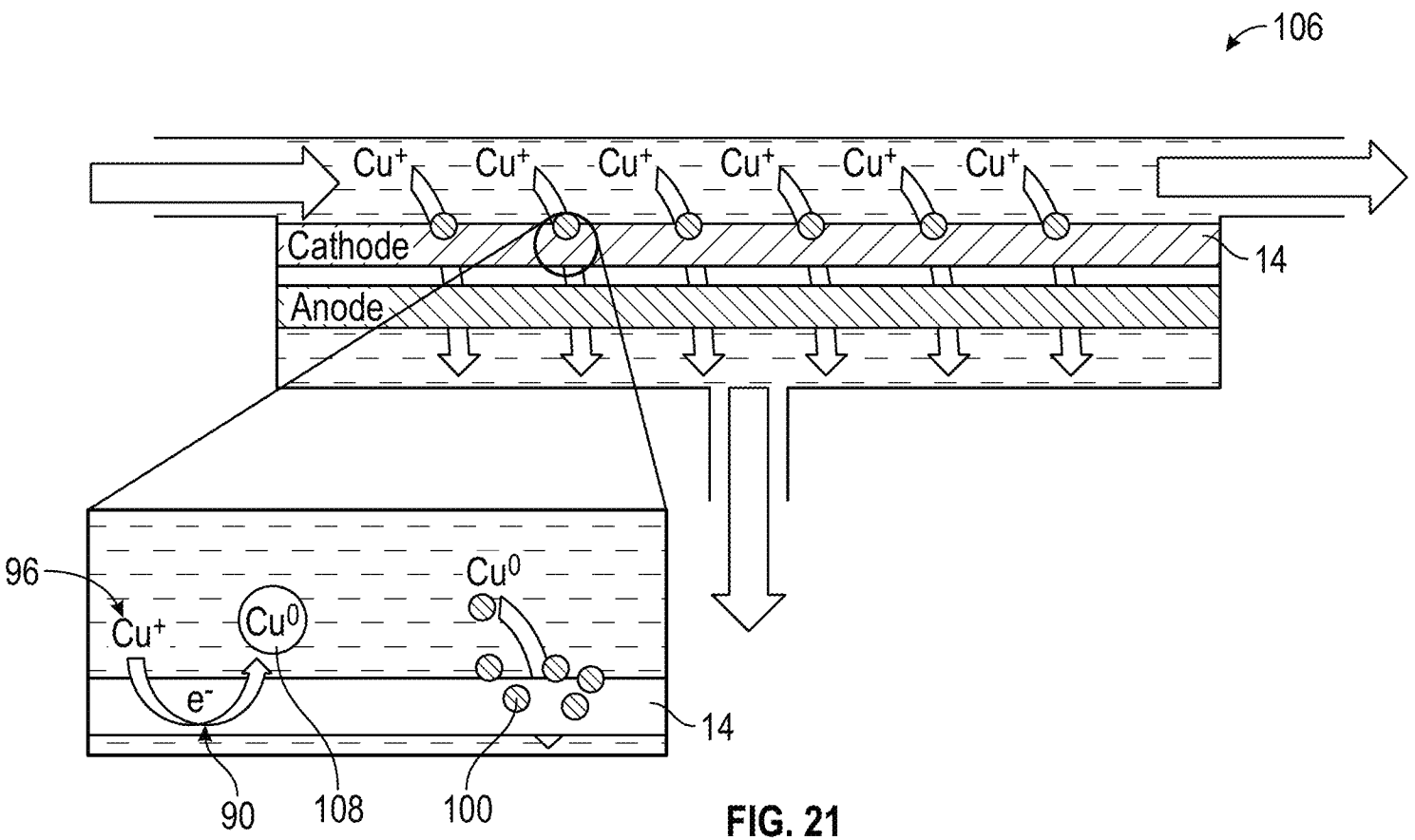
FIG. 21 is an illustration the electrochemical deposition apparatus of the present invention for non-ionic metal deposition.

FIG. 21 illustrates electrochemical deposition apparatus 106 of the present invention. In electrochemical deposition apparatus 106, metal ion 96 is converted to non-ionic or zero-valence metal 108 via redox reaction 90. Non-ionic metal 108 is then deposited 100 onto porous cathodic material 14.

Figure 22:
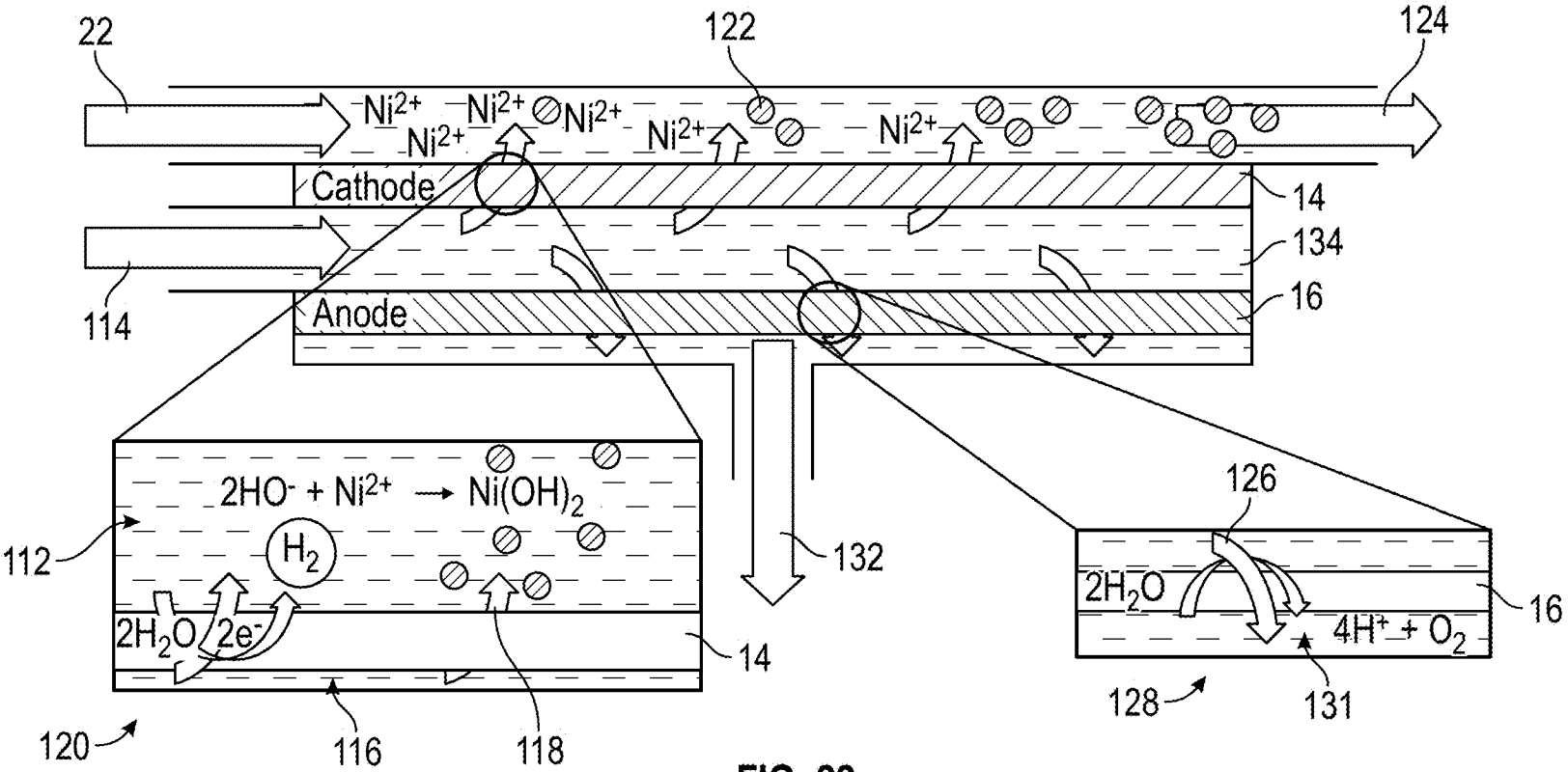
FIG. 22 is an illustration of the electrochemical deposition apparatus of the present invention with a center flow design.

FIG. 22 illustrates electrochemical deposition apparatus 110 of the present invention, wherein metal is deposited onto porous cathodic material 14 by a center-flow through the electrochemical deposition apparatus. Metal feed 22 enters region 112 of electrochemical deposition apparatus 110. Feed electrolyte 114 flows into region 116 and traverses porous cathodic material 14 by flow 118. Hydrogen molecules and hydroxide anions are generated by reaction 120 and hydroxide anion reacts with metal cations to form a metal hydroxide. Metal hydroxide 122 flows out of electrochemical deposition apparatus 110 by flow 124 as a metal hydroxide concentrate. Feed electrolyte 114 also traverses anode 16 by flow 126. Water is hydrolyzed at anode 16 by reaction 128 to form hydrogen ions and oxygen in cavity 131. The feed electrolyte 114 flows from electrochemical deposition apparatus 110 by flow 132 and may be recycled into an acidic leach. About 50% (or other portion) of feed electrolyte 114 may flow through and/or across porous cathodic material 14 and about 50% (or other portion) of feed electrolyte 114 may flow through and/or across anode 16. Flow 132 may be acidified by anodic electrolysis. Feed electrolyte 114 is forced to traverse porous cathodic material 14 and anode 16 by surface 134, which prevents feed electrolyte 114 from directly flowing out of electrochemical deposition apparatus 110. Optionally, surface 134 may not be present, and feed electrolyte 114 may simultaneously directly flow out of electrochemical deposition apparatus 110 and traverse porous cathodic material 14 and anode 16 into region 112 and 131, respectively.

Figure 23:
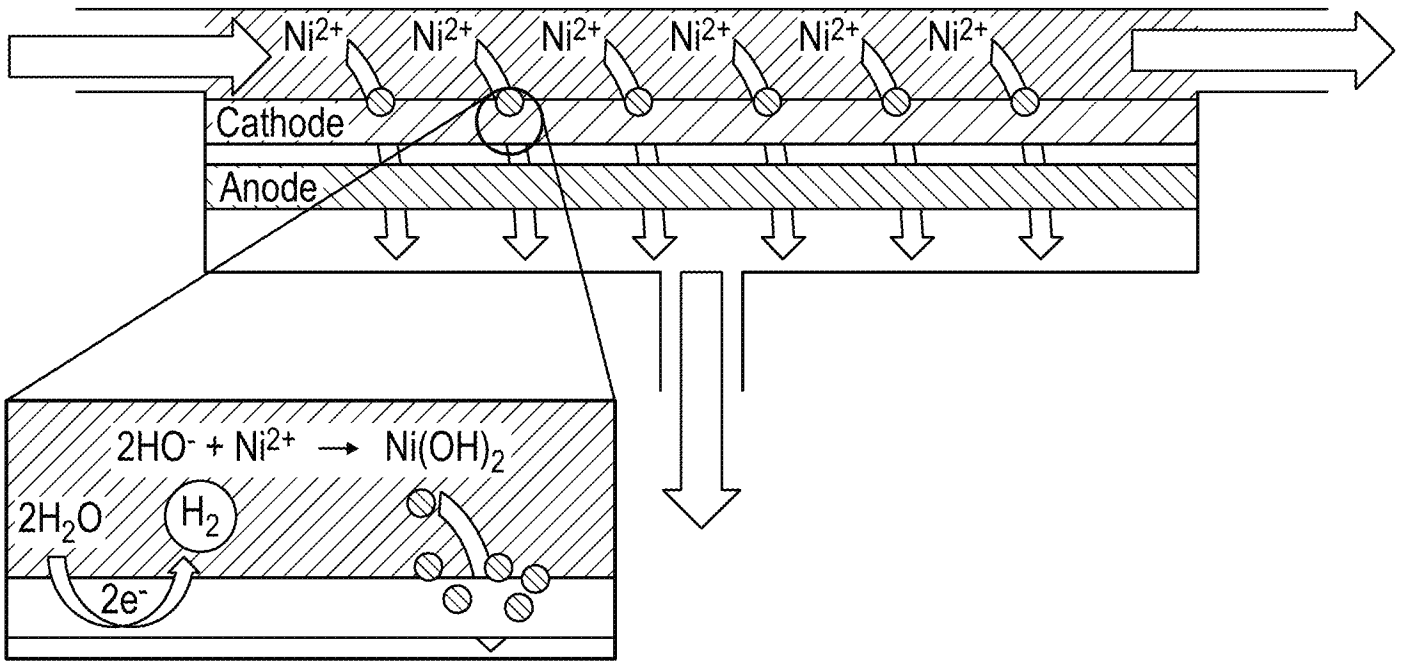
FIG. 23 is an illustration of an embodiment of the electrochemical deposition apparatus, wherein $Ni^{2+}$ ions are deposited and converted to nickel hydroxide.

FIG. 23 illustrates an exemplary embodiment of a chemical deposition apparatus for the selective deposition of nickel oxides. Ni ions are electrochemically converted to $Ni(OH)_2$ that are deposited within the electrochemical apparatus. Ni free permeate (raffinate) flows out of the electrochemical apparatus. Deposited $Ni(OH)_2$ can be released from the porous cathodic material (e.g., the cathode shown in FIG. 23) and released as a solution comprising concentrated $Ni(OH)_2$.

Figure 24:
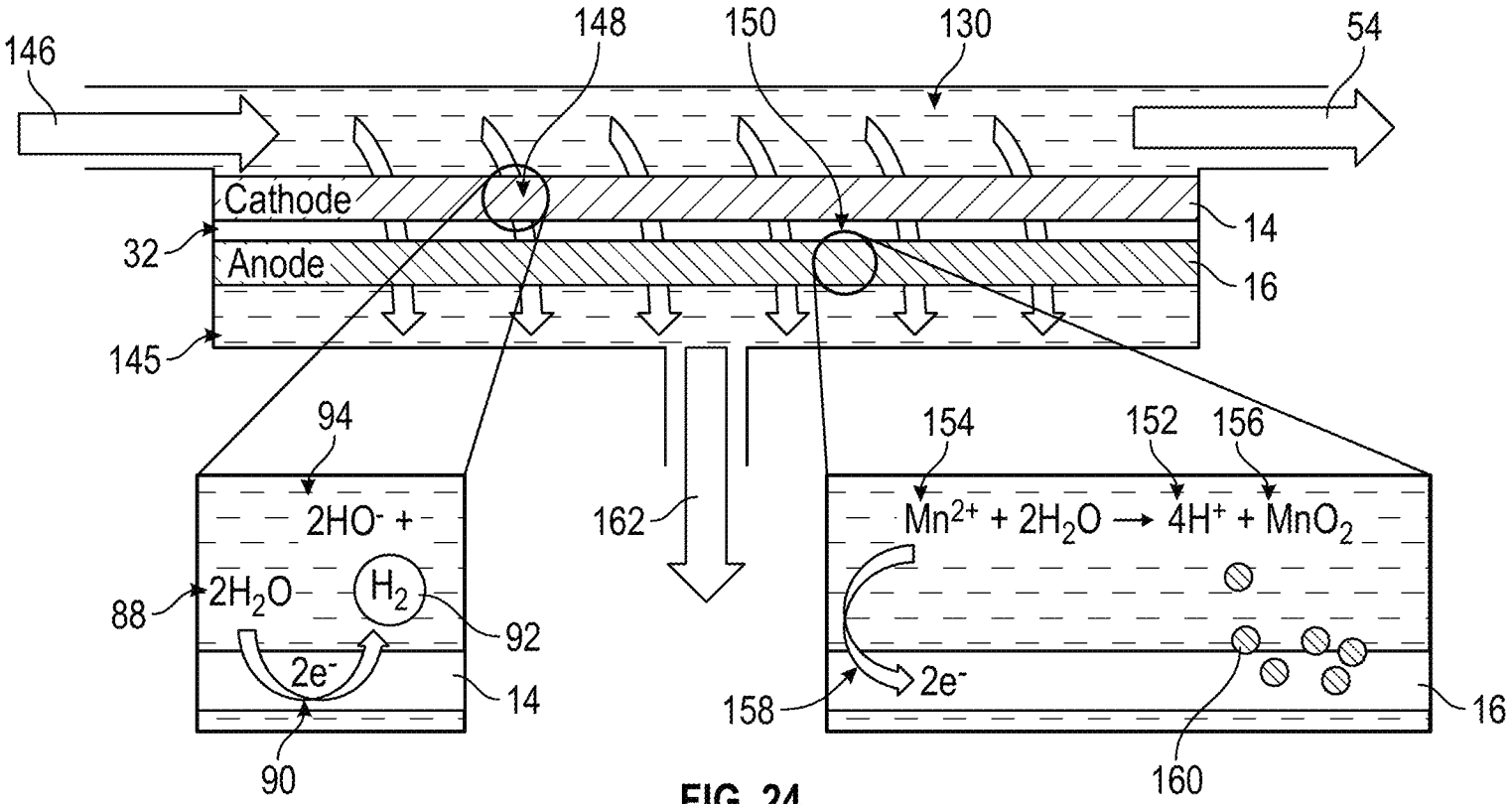
FIG. 24 is an illustration of the electrochemical deposition apparatus of the present invention for manganese oxide precipitation.

FIG. 24 illustrates electrochemical deposition apparatus 144 of the present invention. In electrochemical deposition apparatus 144, feed 146 (e.g., Ni, Mn, and Co) enters cavity 130 and contacts porous cathodic material 14 to undergo a reduction-oxidation reaction. The reduction-oxidation reaction may occur at exemplary reaction area 148. At reaction area 148, porous cathodic material 14 electrolyzes water 88 via redox reaction 90 to form hydrogen 92 and hydroxide ions 94. Feed 146 then passes through inter-electrode region 32 to contact anode 16 and undergoes a reduction-oxidation reaction. The reduction-oxidation reaction may occur at exemplary reaction area 150. At reaction area 150, anode 16 electrolyzes e.g., manganese 154 via redox reaction 158. Manganese 154 reacts with water 88 to form hydrogen ions 152 and $MnO_2$ 156. $MnO_2$ 156 deposits 160 onto the surface of anode 16. $MnO_2$ may be removed from anode 16 and flows out of electrochemical deposition apparatus 144 through post-deposition region 145 by flow 162 comprising dissolved $MnO_2$. Concentrate 54 passes out of cavity 130.

Figure 25:
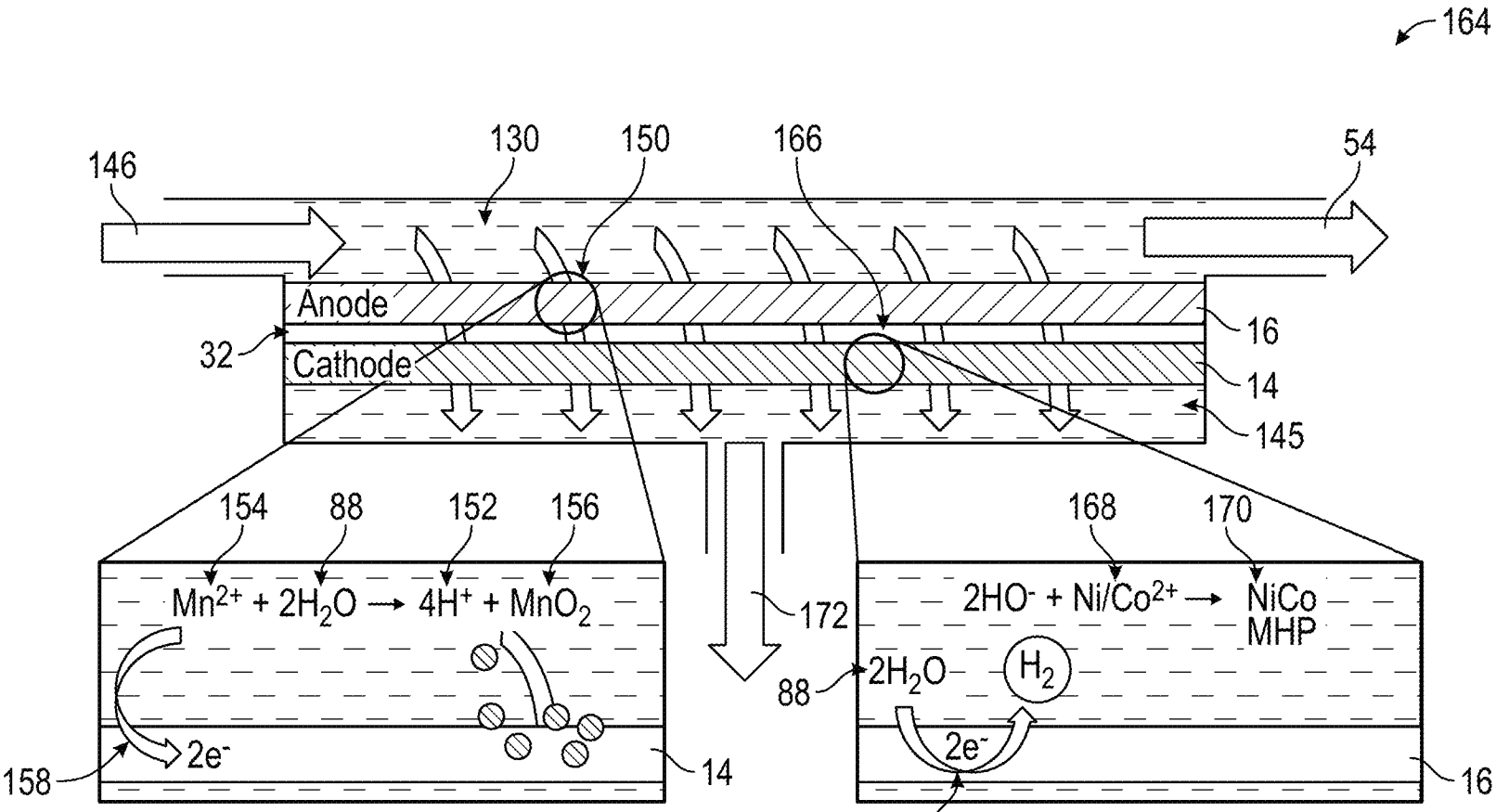
FIG. 25 is an illustration of the electrochemical deposition apparatus of the present invention for manganese oxide ($MnO_2$) precipitation and NiCo mixed hydroxide precipitate ("MHP") extraction.

FIG. 25 illustrates electrochemical deposition apparatus 164 of the present invention. In electrochemical deposition apparatus 164, feed 146 (e.g., Ni, Mn, and Co) enters cavity 130 and contacts anode 16 to undergo a reduction-oxidation reaction. The reduction-oxidation reaction may occur at exemplary reaction area 150. At reaction area 150, anode 16 converts e.g., manganese 154 via redox reaction 158. Manganese 154 reacts with water 88 to form hydrogen ions 152 and $MnO_2$ 156. Feed 146 then passes through inter-electrode region 32 to contact porous cathodic material 14 to undergo a reduction-oxidation reaction. The reduction-oxidation reaction may occur at exemplary reaction area 166. At reaction area 166, porous cathodic material 14 electrolyzes water 88 via redox reaction 90. Water 88 reacts with e.g., Ni and/or $Co^{2+}$ 168 to form nickel-cobalt metal hydroxide precipitate 170. Nickel-cobalt metal hydroxide precipitate 170 enters post-deposition region 145 and flow exits electrochemical deposition apparatus 164 by flow 172 comprising metal hydroxide precipitate 170. Concentrate 54 passes out of cavity 130.

Figure 26:
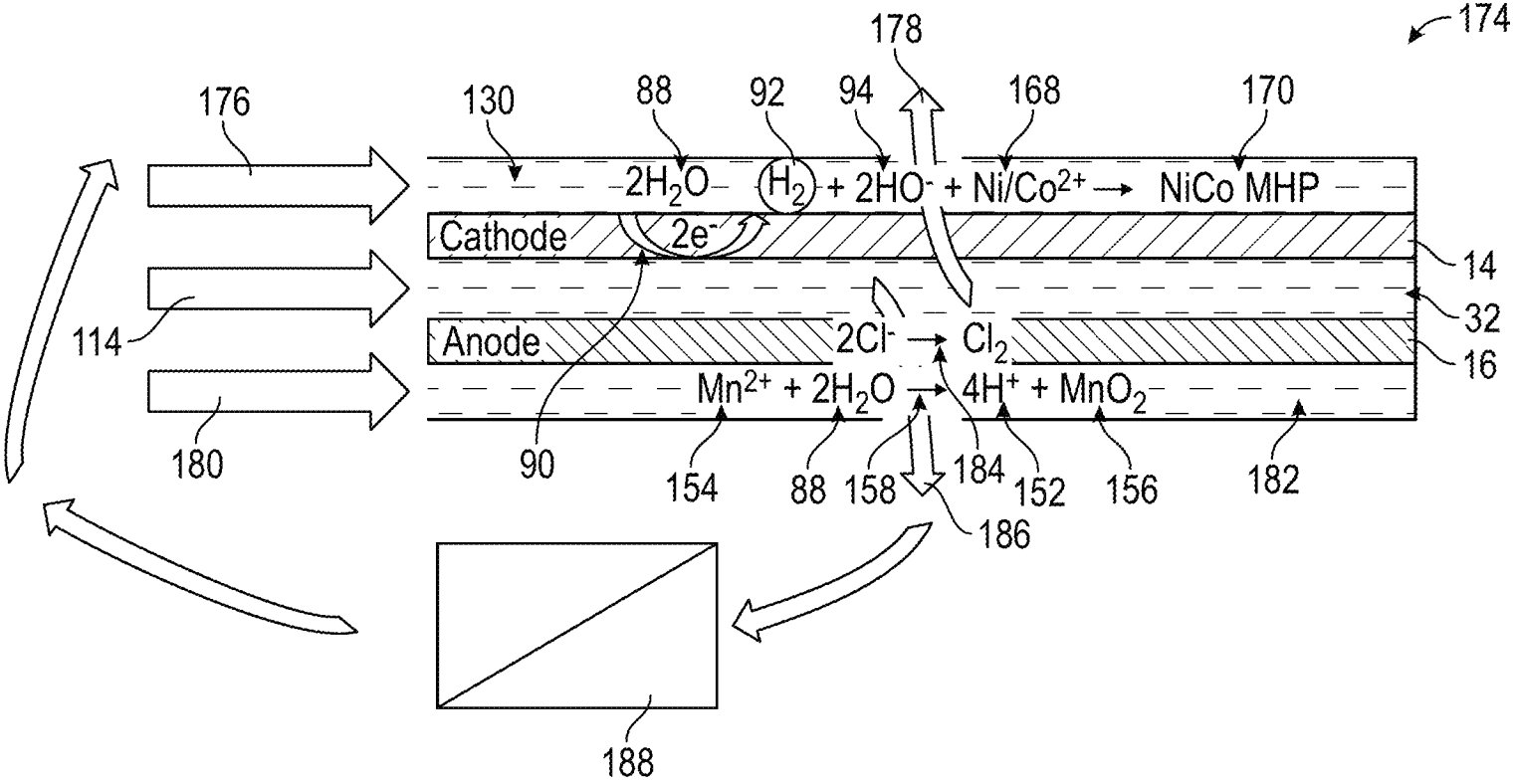
FIG. 26 is an illustration of the electrochemical deposition apparatus of the present invention for $MnO_2$ precipitation and filtration, Ni and Co recycling, and NiCo mixed hydroxide precipitate ("MHP") extraction.

FIG. 26 illustrates electrochemical deposition apparatus 174 of the present invention. In electrochemical deposition apparatus 174, feed 176 (e.g., Ni and Co) enters cavity 130 and contacts porous cathodic material 14 to undergo a reduction-oxidation reaction. Porous cathodic material 14 electrolyzes water 88 via redox reaction 90 to form hydrogen 92 and hydroxide ion 94. Hydroxide ion 94 react with reacts with Ni and/or $Co^{2+}$ 168 to form nickel-cobalt metal hydroxide precipitate 170. Electrolyte 114 enters inter-electrode region 32 and traverses across porous cathodic material 14 to enter cavity 130. Electrolyte 114 and nickel-cobalt metal hydroxide precipitate 170 exits electrochemical deposition apparatus 174 by flow 178 comprising nickel-cobalt metal hydroxide precipitate 170 and electrolyte 114. Feed 180 (e.g., Ni, Mn, and Co) enters cavity 182 and contacts anode 16 to undergo a reduction-oxidation reaction. Anode 16 electrolyzes manganese 154 via redox reaction 158. Manganese 154 reacts with water 88 to form hydrogen ions 152 and $MnO_2$ 156. Chloride ion is also converted to chlorine by redox reaction 184. Electrolyte 114 enters inter-electrode region 32 and traverses across anode 16 to enter cavity 182. Electrolyte 114 may comprise, but is not limited to, NaCl. Electrolyte 114 and $MnO_2$ 156 exit electrochemical deposition apparatus 174 by flow 186 comprising $MnO_2$ 156 and electrolyte 114. Flow 186 contacts filter 188 to remove $MnO_2$ 156 from flow 186 to form feed 176, which is recycled back into electrochemical deposition apparatus 174. Anode 16 electrolyzes manganese 154 via redox reaction 158. Manganese 154 reacts with water 88 to form hydrogen ions 152 and $MnO_2$ 156. Porous cathodic material 14 electrolyzes water 88 via redox reaction 90 to form hydrogen 92 and hydroxide ions 94.

Figure 27:
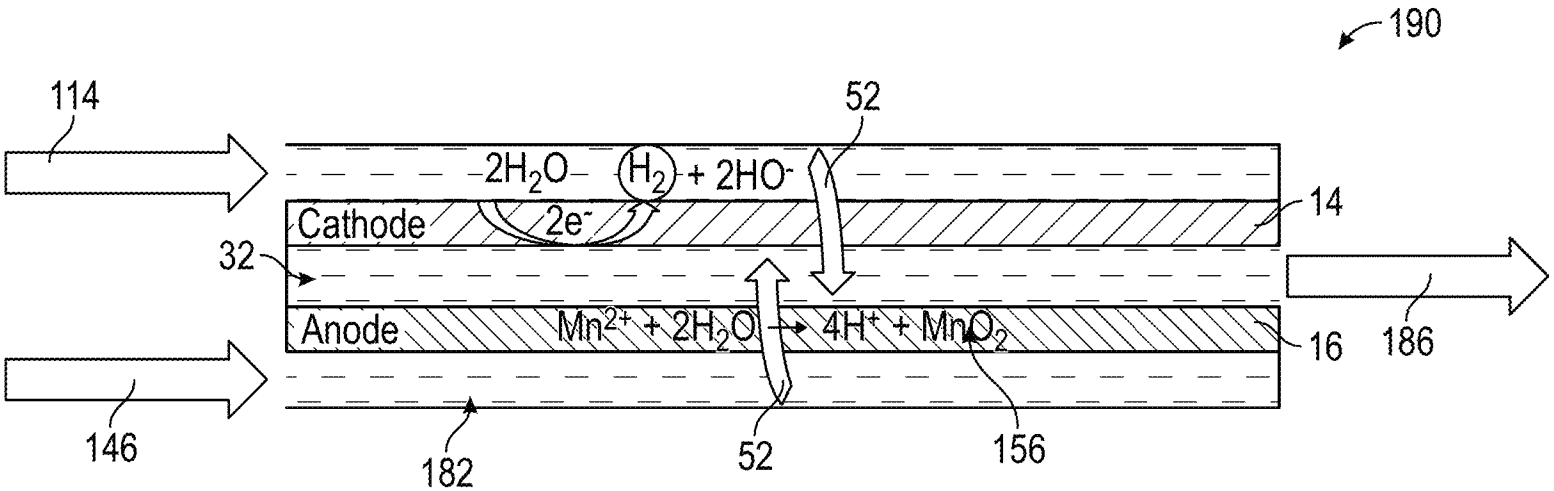
FIG. 27 is illustration of the electrochemical deposition apparatus of the present invention comprising an electrolyte and nickel-manganese-cobalt source merging in a central compartment for $MnO_2$ precipitation.

FIG. 27 illustrates electrochemical deposition apparatus 190 of the present invention. In electrochemical deposition apparatus 190, feed 146 (e.g., Ni, Mn, and Co) enters cavity 182 and contacts anode 16 to undergo a reduction-oxidation reaction. $MnO_2$ 156 enters inter-electrode region 32 by outside-in flows 52. Electrolyte 114 enters cavity 130 and contacts porous cathodic material 14 to undergo a reduction-oxidation reaction. Electrolyte 114 and $MnO_2$ 156 exits electrochemical deposition apparatus 190 by flow 186 comprising $MnO_2$ 156, electrolyte 114, nickel, and cobalt.

Figure 28:
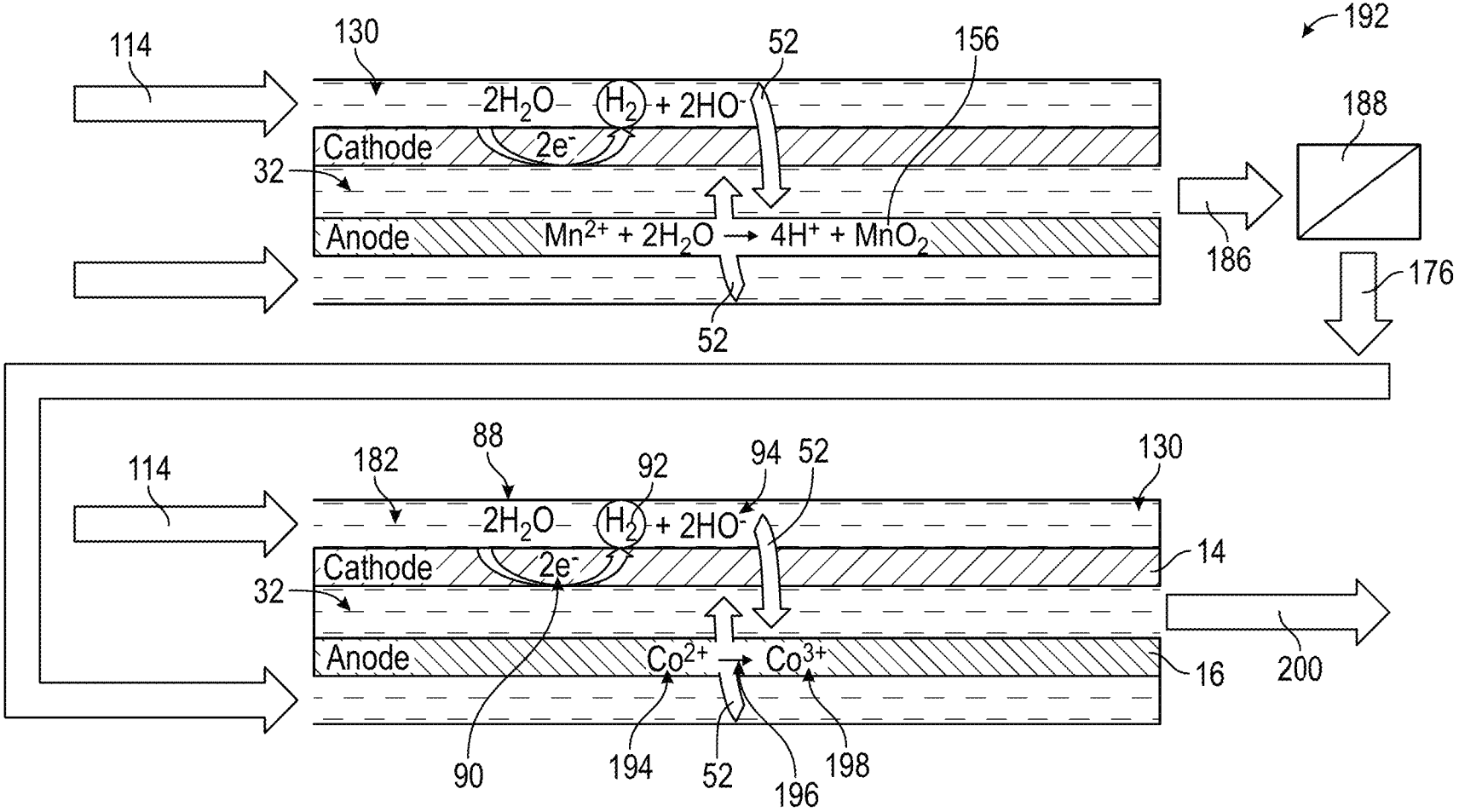
FIG. 28 is an illustration of the electrochemical deposition apparatus of the present invention for $MnO_2$ precipitation and extraction, and the formation of cobalt(III) hydroxide ($Co(OH)_3$) and cobalt(III) oxyhydroxide (CoOOH)

FIG. 28 illustrates electrochemical deposition apparatus 192 of the present invention. In electrochemical deposition apparatus 192, at least two electrochemical deposition chambers are set up in series. The first electrochemical deposition chamber generates flow 186 comprising e.g., $MnO_2$ 156, electrolyte 114, nickel, and cobalt according to electrochemical deposition apparatus 190 of FIG. 29. Flow 186 contacts filter 188 to remove $MnO_2$ 156 to form Ni—Co feed 176. Ni—Co feed 176 enters cavity 182 of a second electrochemical deposition chamber and contacts anode 16 to undergo a reduction-oxidation reaction. $Co^{2+}$ 194 undergoes redox reaction 196 to form $Co^{3+}$ 198. $Co^{3+}$ 198 enters inter-electrode region 32 by outside-in flows 52. Electrolyte 114 enters cavity 130 and contacts porous cathodic material 14 to undergo a reduction-oxidation reaction. Porous cathodic material 14 electrolyzes water 88 via redox reaction 90 to form hydrogen 92 and hydroxide ion 94. Hydroxide ion 94 reacts with $Co^{3+}$ 198 in inter-electrode region 32 to form flow 200 comprising $Co(OH)_3$ and CoOOH.

Figure 29:
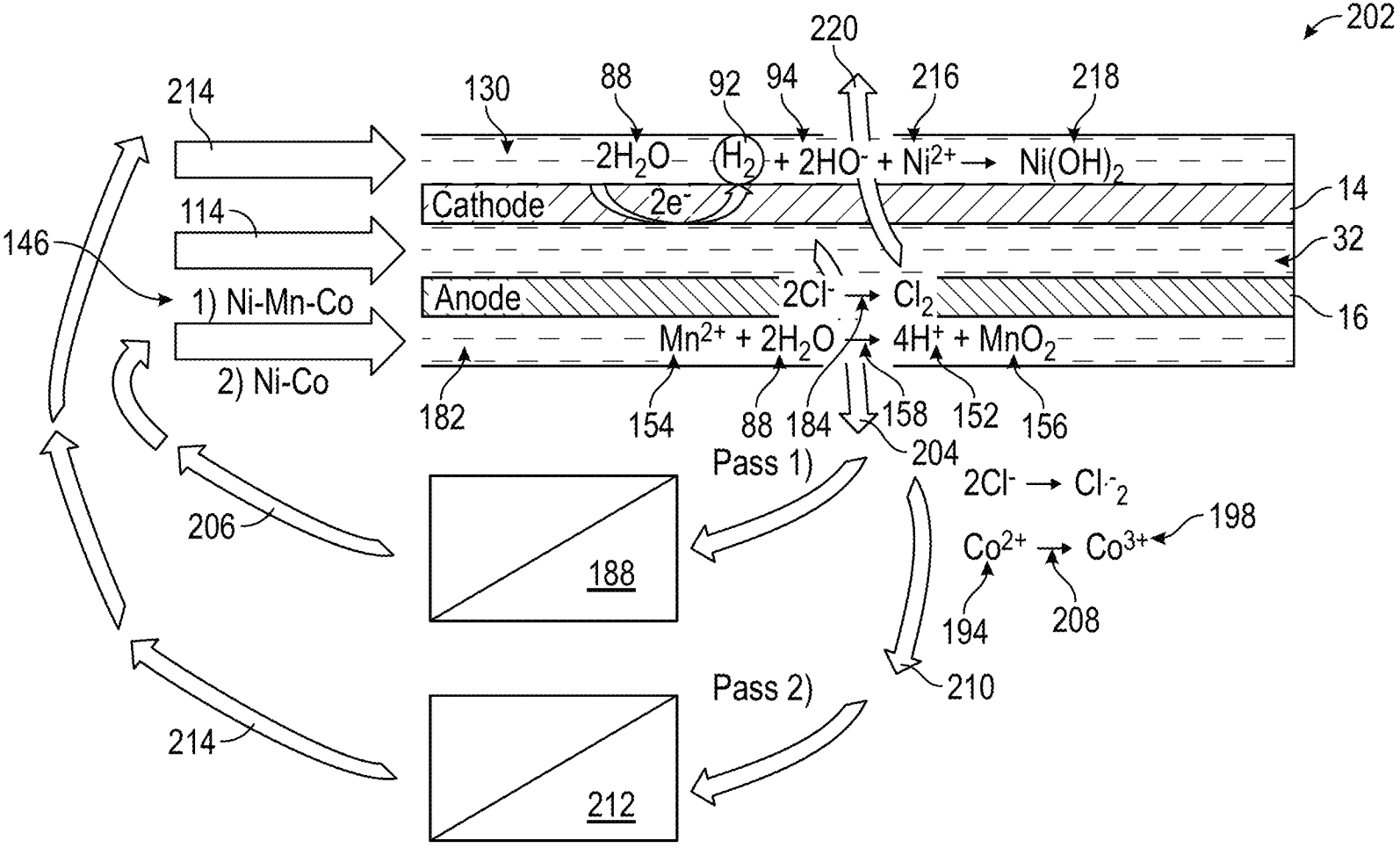
FIG. 29 is an illustration of the electrochemical deposition apparatus of the present invention for $MnO_2$ precipitation and extraction, the formation of cobalt(III) hydroxide ($Co(OH)_3$) and cobalt(III) oxyhydroxide (CoOOH), and the extraction of CoOOH.

FIG. 29 illustrates electrochemical deposition apparatus 202 of the present invention. In electrochemical deposition apparatus 202, electrolyte 114 enters inter-electrode region 32 and traverses porous cathodic material 14 and anode 16. Electrolyte 114 may comprise, but it not limited to, NaCl. Feed 146 (e.g., Ni, Mn, and Co) enters as a first pass material into cavity 182 and contacts anode 16 to undergo redox reactions 184 and 158. In redox reaction 184, chloride ion is converted to chlorine. In redox reaction 158, manganese 154 reacts with water 88 to form hydrogen ions 152 and $MnO_2$ 156. $MnO_2$ 156, Ni and $Co^{2+}$ exit electrochemical deposition apparatus 202 by flow 204, which contacts filter 188. Filter 188 removes $MnO_2$ 156 to form Ni—Co feed 206 comprising Ni and $Co^{2+}$ in solution. Ni—Co feed 206 acts as second pass feed and enters cavity 182 to contact anode 16 and undergo redox reactions 184 and 208. In redox reaction 184, chloride ion is again converted to chlorine. In redox reaction 208, $Co^{2+}$ 194 is converted to $Co^{3+}$+198. $Co^{3+}$+198 reacts with hydroxide ion 94 to form $Co(OH)_3$ and CoOOH. Flow 210 comprising Ni, $Co(OH)_3$ and CoOOH exits electrochemical deposition apparatus 202 and contacts filter 212. Filter 212 removes CoOOH to form feed 214 comprising Ni. Feed 214 enters cavity 130 and contacts porous cathodic material 14 to undergo a reduction-oxidation reaction 92. In redox reaction 92, water 88 is electrolyzed for form hydrogen 92 and hydroxide ion 94. Hydroxide ion 94 react with $Ni^{2+}$ 216 to form $Ni(OH)_2$ 218. $Ni(OH)_2$ 218 exits electrochemical deposition apparatus 202 by flow 220.

Figure 30:
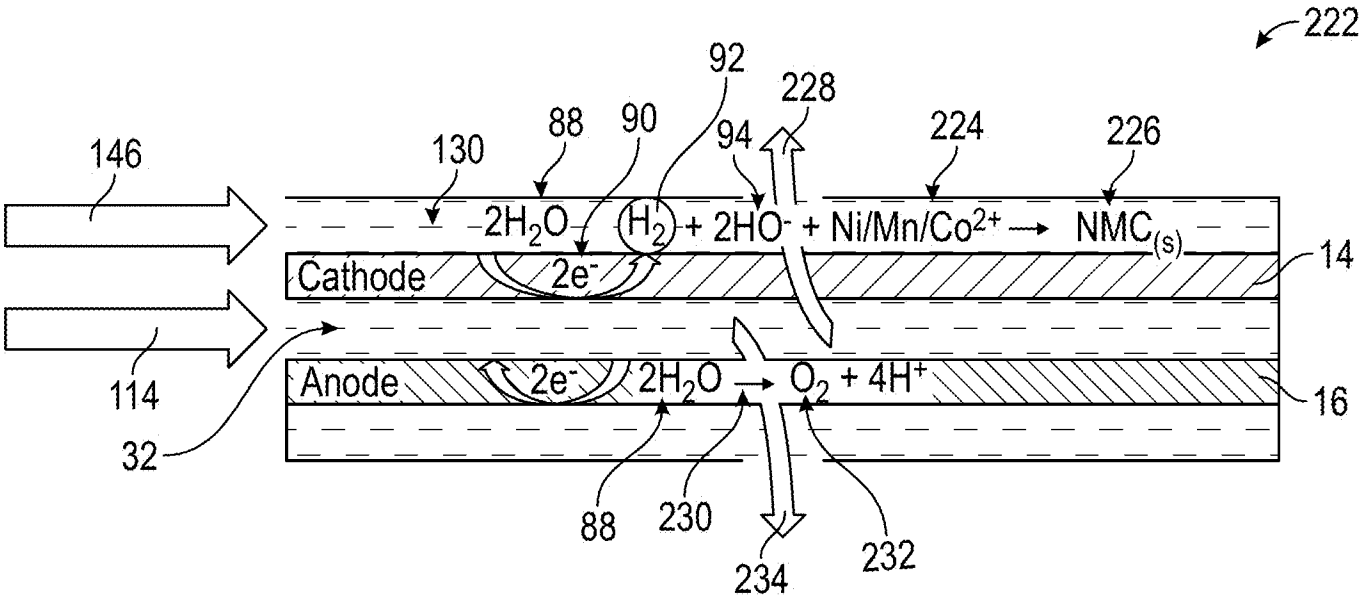
FIG. 30 is an illustration of the electrochemical deposition apparatus of the present invention for the formation of solid nickel-manganese-cobalt oxide ($NMC_{(s)}$)

FIG. 30 illustrates electrochemical deposition apparatus 222 of the present invention. In electrochemical deposition apparatus 222, feed 146 (e.g., Ni, Mn, and Co) enters cavity 130 and contacts porous cathodic material 14 to undergo a reduction-oxidation reaction. Porous cathodic material 14 electrolyzes water 88 via redox reaction 90 to form hydrogen 92 and hydroxide ion 94. Hydroxide ion 94 reacts with solvent Ni, Mn, and $Co^{2+}$ 224 to form $NMC_{(s)}$ 226. $NMC_{(s)}$ 226 exits electrochemical deposition apparatus 222 by flow 228. Electrolyte 114 enters inter-electrode region 32 and traverses across porous cathodic material 14 and anode 16. Electrolyte 114 may comprise $NaHCO_3$ and/or $Na_2SO_4$. Water 88 is converted by redox reaction 230 to oxygen 232 and hydrogen ion 152. Acid generated by redox reaction 230 is recycled by flow 234. The acid may be recycled to a leach.

Figure 31:
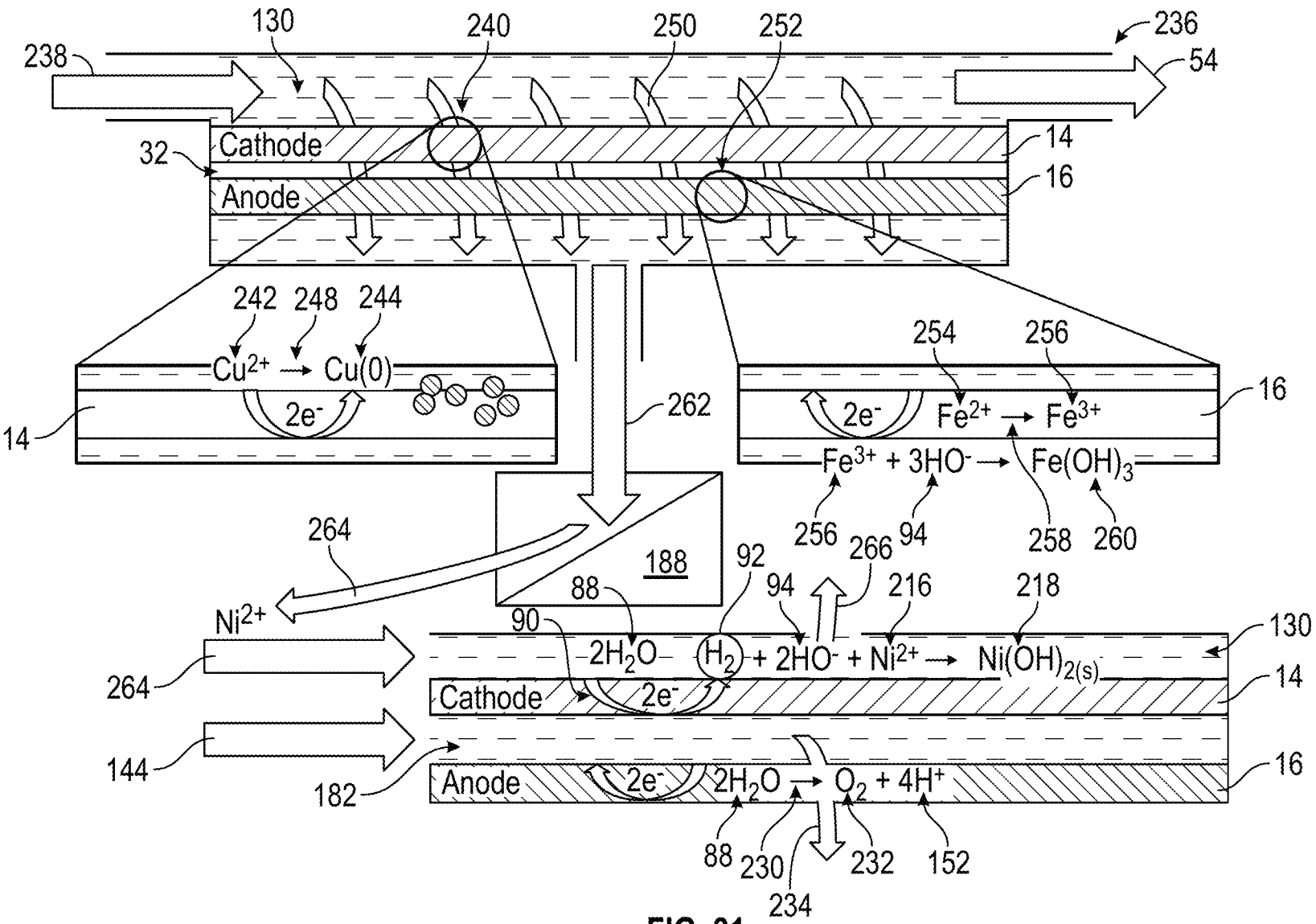
FIG. 31 is an illustration of the electrochemical deposition apparatus of the present invention for the formation of iron(III) hydroxide ($Fe(OH)_3$), iron(III) oxide ($Fe_2O_3$), and nickel hydroxide ($Ni(OH)_2$)

FIG. 31 illustrates electrochemical deposition apparatus 236 of the present invention. Electrochemical deposition apparatus 236 uses at least two electrochemical deposition chambers arranged in series. In electrochemical deposition apparatus 236, feed 238 (e.g., $Fe^{2+}$, $Cu^{2+}$, and $Ni^{2-}$) enters cavity 130 of a first electrochemical deposition chamber and contacts porous cathodic material 14 to undergo a reduction-oxidation reaction. The reduction-oxidation reaction may occur at exemplary reaction area 240. At reaction area 240, porous cathodic material 14 converts $Cu^{2+}$ 242 to Cu(0) 244 by redox reaction 248. Permeate 250 enters inter-electrode region 32 and contacts anode 16 to undergo a reduction-oxidation reaction. The reduction-oxidation reaction may occur at exemplary reaction area 252. At reaction area 252, anode 16 converts $Fe^{2+}$ 254 to $Fe^{3+}$ 256 by redox reaction 258. $Fe^{3+}$ 256 also reacts with hydroxide ion 94 to form $Fe(OH)_3$ 260. Concentrate 54 exits electrochemical deposition apparatus 236 from cavity 130. Flow 262 comprising $Fe(OH)_3$, $Fe_2O_3$, and $Ni^{2+}$ exits electrochemical deposition apparatus 236 and contacts filter 188. Filter 188 removes $Fe(OH)_3$ and $Fe_2O_3$ to form feed 264 comprising $Ni^{2+}$. Feed 264 enters cavity 130 of a second electrochemical deposition chamber and contacts porous cathodic material 14. Water 88 is converted to hydrogen 92 and hydroxide ion 94 by redox reaction 90. Hydroxide ion 94 react with $Ni^{2+}$ 216 to form $Ni(OH)_{2(s)}$ 218. $Ni(OH)_{2(s)}$ 218 exits electrochemical deposition apparatus 236 through flow 266. Electrolyte 114 enters cavity 182 and contacts anode 16. Electrolyte 114 may comprise $NaHCO_3$ and/or $Na_2SO_4$. Water 88 is converted to oxygen 232 and hydrogen ion 152 by redox reaction 230. Acid generated by redox reaction 230 is recycled by flow 234.

Figure 32:
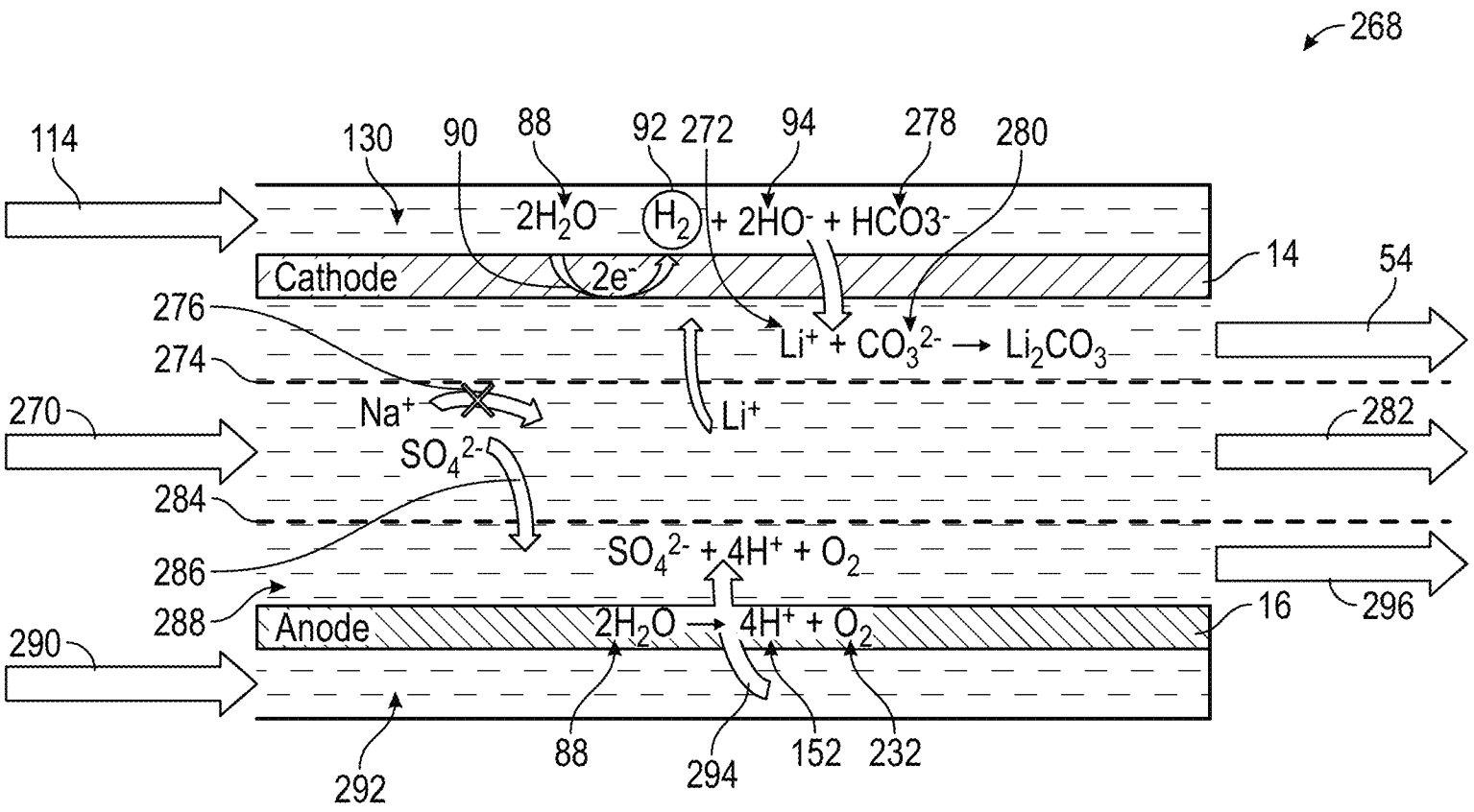
FIG. 32 is an illustration of the electrochemical deposition apparatus of the present invention for the formation of lithium carbonate ($Li_2CO_3$)

FIG. 32 illustrates electrochemical deposition apparatus 268 of the present invention. In electrochemical deposition apparatus 268, feed 270 (e.g., $Li^+$ 272 and $SO_4^{2-}$ ions) enters inter-membrane region 1417. $Li^+$ 272 traverses $Li^+$-specific cation exchange membrane 274. $Li^+$-specific cation exchange membrane 274 is impermeable to monovalent ions 276 except $Li^+$ 272, including, but limited to, Nat $NaHCO_3$ electrolyte 114 enters cavity 130 and contacts porous cathodic material 14. Water 88 is converted to hydrogen 92 and hydroxide 94 by redox reaction 90. Hydroxide 94 react with $HCO^{3-}$ 278 to form carbonate 280. Carbonate 280 traverses porous cathodic material 14 and reacts with $Li^+$ 272 to form $Li_2CO_3$. $Li_2CO_3$ exits electrochemical deposition apparatus 268 as concentrate 54 comprising Li concentrate or precipitate. Depleted $Li^+$ 272 and $SO_4^{2-}$ solution exits electrochemical deposition apparatus 268 by flow 282. Anions, including but not limited to $SO_4^{2-}$, traverse anion exchange membrane 284 according to exemplary flow 286 and enter region 288. Feed 290 comprising sodium sulfate and electrolyte enter region 292 and contact anode 16. Water 88 is converted to hydrogen ion 152 and oxygen 232. Hydrogen ion 152 and oxygen 232 traverse anode 16 by flow 294 and enter region 288 to form sulfuric acid. Sulfuric acid exits electrochemical deposition apparatus 268 by flow 296.

Figure 34:
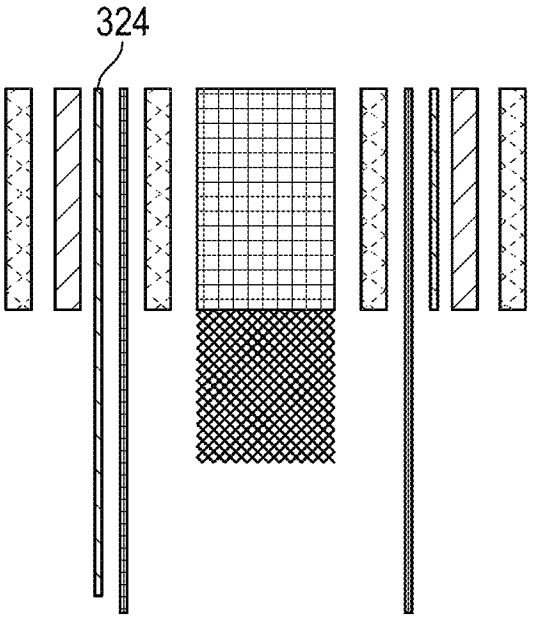
FIG. 34 is an illustration of the plate configuration in an electrochemical deposition apparatus comprising a filter plate and a mesh.
Figure 33:
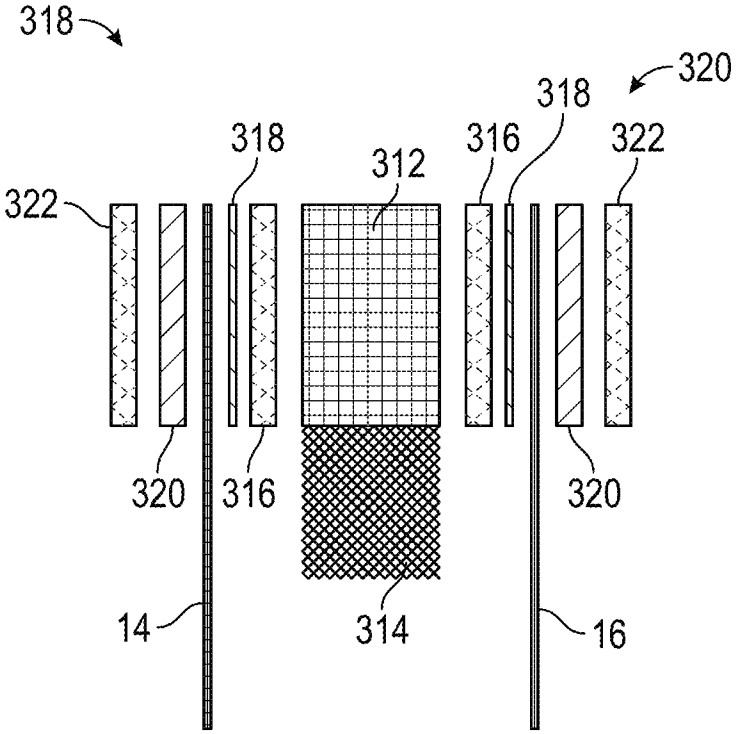
FIG. 33 is an illustration of the arrangement of flows in an electrochemical deposition apparatus comprising a filter plate and an elongated current collector.

FIG. 33 illustrates plate configuration 310, comprising plate 312, porous cathodic material 14, anode 16, mesh 314, gasket 316, current collector 318, collar 320, and collar gasket 322. Pairs gasket 316, current collector 318, collar 320, and collar gasket 322 may be at least partially disposed around plate 312. Plate 312 may be at least partially disposed around mesh 314. Optionally, elongated current collector 324 may be at least partially disposed beside porous cathodic material 14, as shown in FIG. 34.

Figure 35:
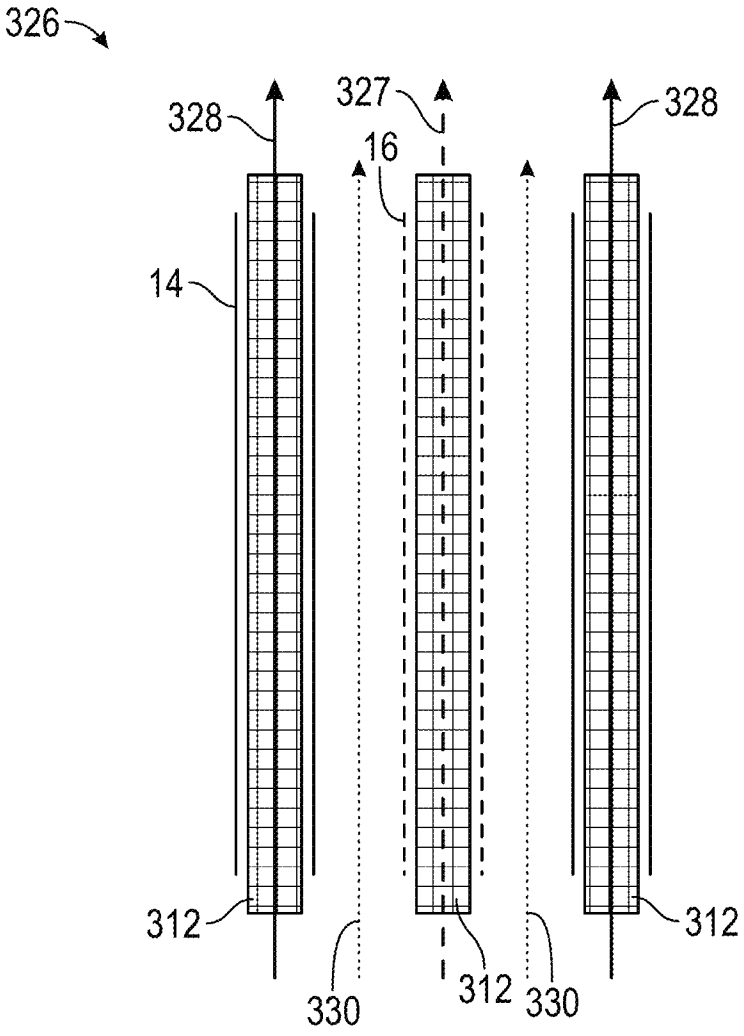
FIG. 35 is an illustration of the arrangement of flows in an electrochemical deposition apparatus comprising a filter plate, wherein either the anode or the porous cathodic material are at least partially disposed on both sides of the filter plate in an alternating pattern.

FIG. 35 illustrates arrangement of flows 326 in an electrochemical deposition apparatus comprising a plate. Pairs of porous cathodic material 14 and anode 16 are at least partially disposed around a plate 312, with each plate 312 at least partially disposed between either two porous cathodic materials 14 or two anodes 16. Anode permeate 327 traverses through plates 312 that are at least partially disposed between two anodes 16. Porous cathodic material permeate 328 traverses through plates 312 that are at least partially disposed between two porous cathodic materials 14. Arrangement of flows 326 comprises at least three plates 312 arranged in parallel, forming at least a first and a second channel. Metal feed 330 flows through the first and second channels. There may be a plurality of channels and metal feed 330 may flow through the plurality of channels.

Figure 36:
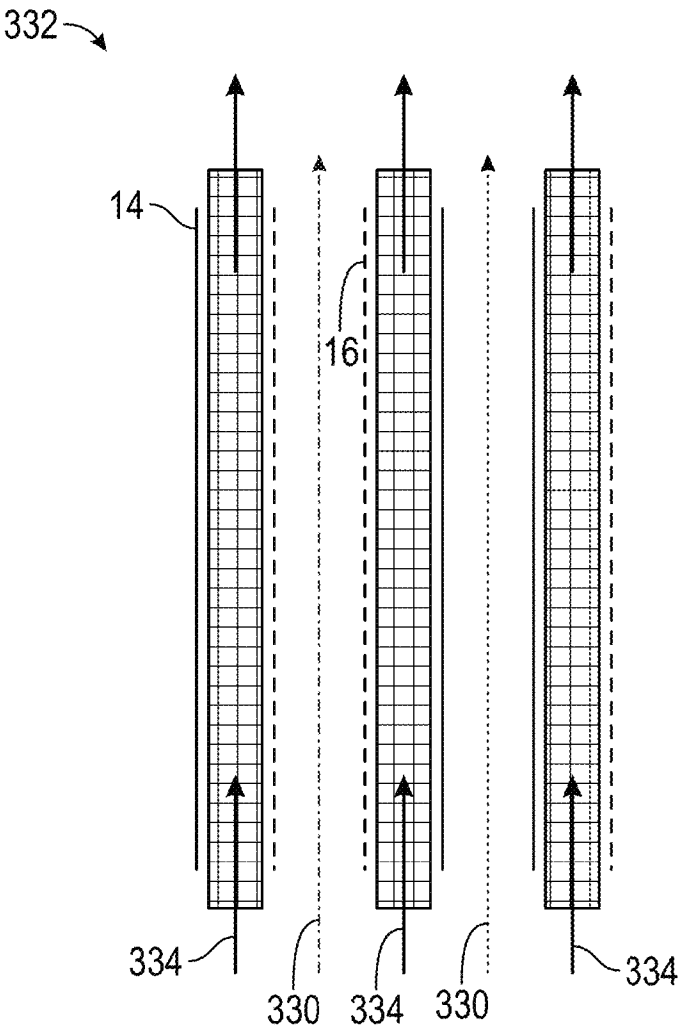
FIG. 36 is an illustration of the arrangement of flows in an electrochemical deposition apparatus comprising a filter plate, wherein the anode and porous cathodic material are at least partially disposed on each side of the filter plate.

FIG. 36 illustrates arrangement of flows 332 in an electrochemical deposition apparatus comprising a plate. Porous cathodic material 14 and anode 16 are at least partially disposed around plate 312. Electrolyte feed 334 traverses through plate 312. Arrangement of flows 332 comprises at least three plates 312 arranged in parallel, forming at least a first and a second channel. Metal feed 330 flows through a first channel and contacts porous cathodic material 14. Anode permeate flows through a second channel and contracts anode 16.

Figure 37:
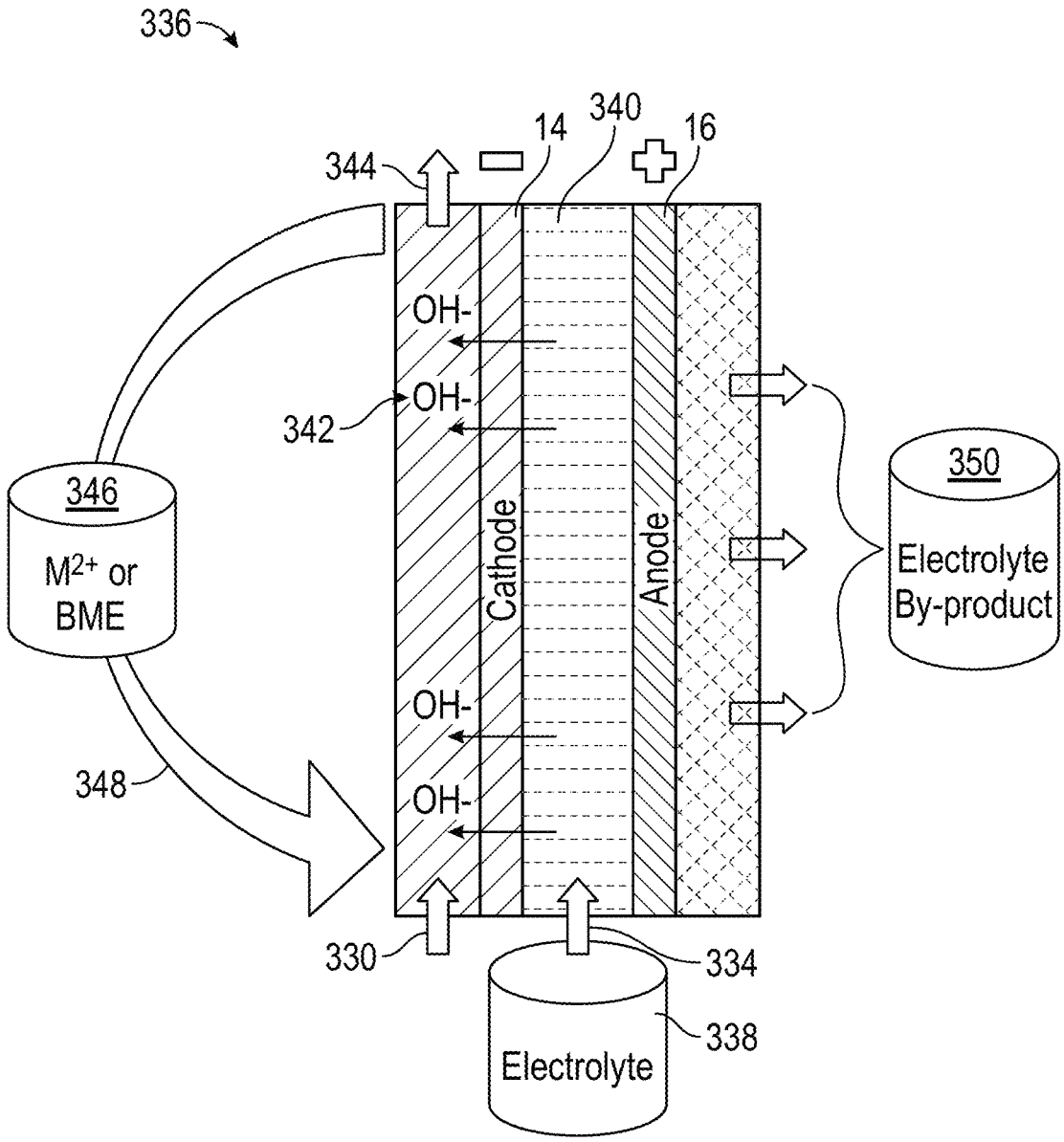
FIG. 37 is an illustration showing a center-flow electrochemical deposition apparatus.

FIG. 37 illustrates center-flow electrochemical deposition apparatus 336. Metal feed 330 enters center-flow electrochemical deposition apparatus 336. Electrolyte feed 334 supplied by electrolyte feed reservoir 338 enters region 340 of center-flow electrochemical deposition apparatus 336. Hydroxide ions 342 traverse porous cathodic material 14 and metal hydroxide are formed. Metal hydroxide concentrate 344 flow from center-flow electrochemical deposition apparatus 336. Metal hydroxide concentrate 344 may comprise metal ions and/or electrolytes. The metal ions and/or electrolytes may be stored in reservoir 346 and recycled into center-flow electrochemical deposition apparatus 336 by flow 348. Electrolyte feed 334 traverses anode 16, flows out of center-flow electrochemical deposition apparatus 336 and may be collected in reservoir 350.

Figure 38:
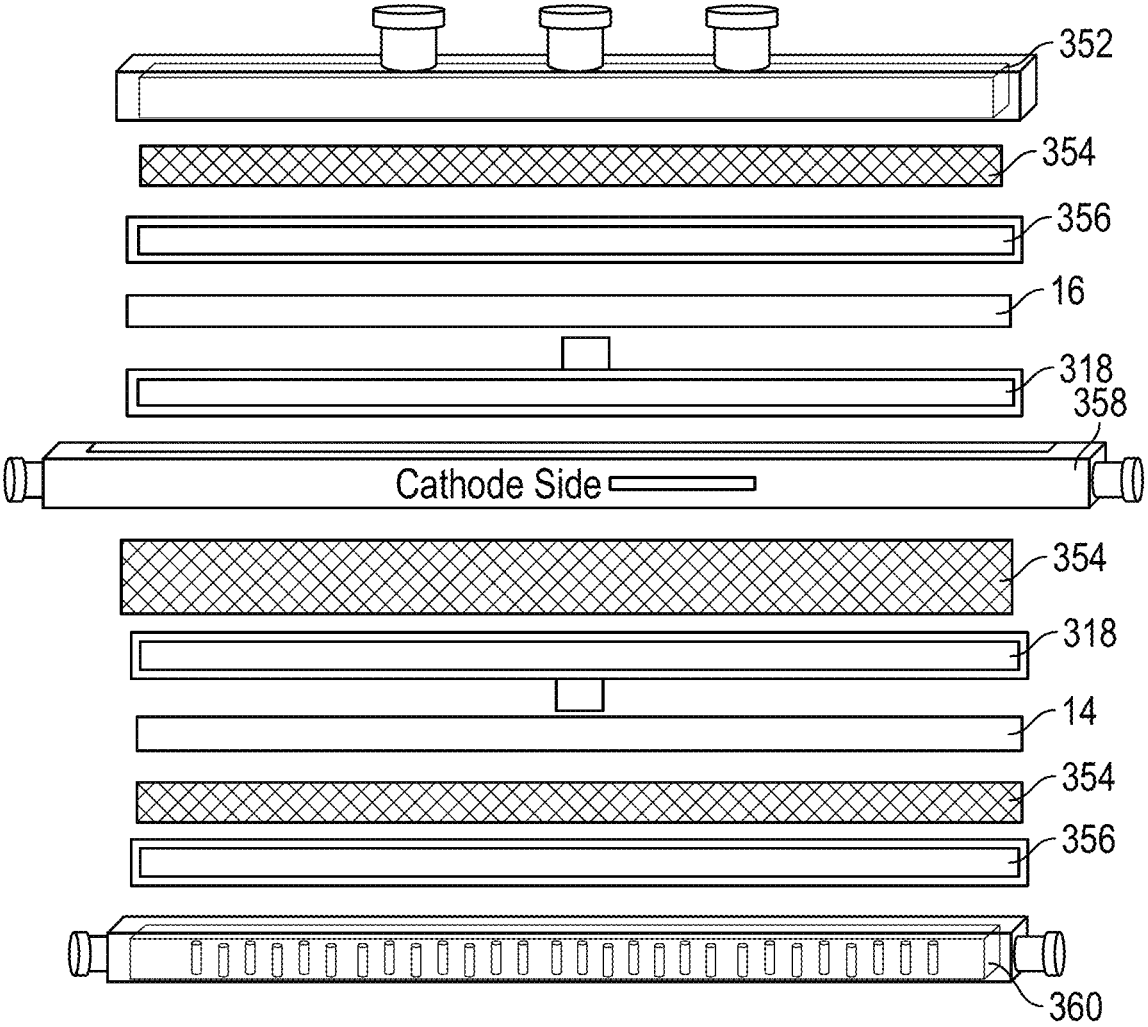
FIG. 38 is a schematic of a filter plate for an electrochemical deposition apparatus.

FIG. 38 illustrates an embodiment of an electrochemical deposition apparatus comprising a plate. The plate comprises e.g., anode-side acrylic 352 disposed plastic mesh 354. Mesh 354 (e.g., plastic mesh) is disposed beside gasket 356 (e.g., rubber gasket). Rubber gasket 356 is disposed beside anode 16. Anode 16 is disposed beside current collector 318. Current collector 318 is disposed beside frame 358. Frame 358 is disposed beside at least one mesh 354. Plastic mesh 354 is disposed beside currently collector 318. Current collector 318 is also disposed beside cathode (e.g., porous cathodic material) 14. Cathode 14 is disposed beside plastic mesh 354. Plastic mesh 354 may also be disposed beside rubber gasket 356. Rubber gasket 356 is disposed beside 360.

Figure 39:
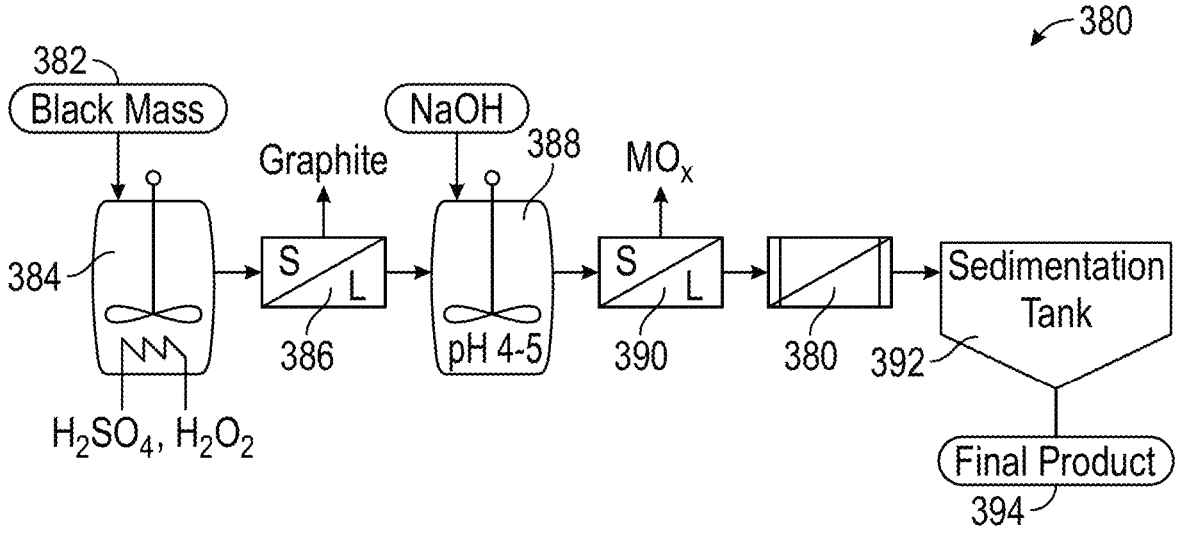
FIG. 39 is a flow schematic of a metal separation method with photos of the components and apparatuses of the present invention associated with each method step for black mass recycling.
Figure 40:
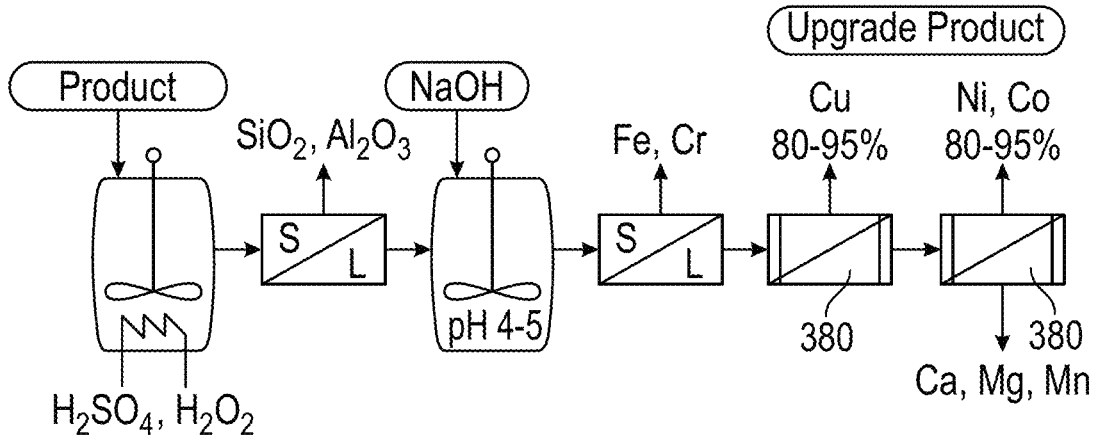
FIG. 40 is a process flow diagram where an electrochemical deposition apparatus is used to upgrade calcinated Ni scrap.

As shown in FIG. 39, electrochemical deposition apparatus 380 of the present invention may be incorporated into a process for recovering metals. Starting material 382 is combined with fluid to form a solution containing metal. The solution is formed in mixing vessel 384. The solution undergoes processing to remove impurities 386, for example, for not limited to, graphite, aluminosilicates, gangue materials, polymers, and other insolubles. The pH of the solution is then adjusted via mixing vessel 388. Filter 390 is used to remove unwanted metals, e.g., unwanted metal oxides. Electrochemical deposition apparatus 380 recovers metals from the solution by depositing metals onto porous cathodic material 14. The deposited metals are released from electrochemical deposition apparatus 380 and passed into sedimentation tank 392. Sediment is collected to collect final product 394. A plurality of electrochemical deposition apparatuses 380 may also be used to recover specific metals, as shown in FIG. 40.

Figure 41:
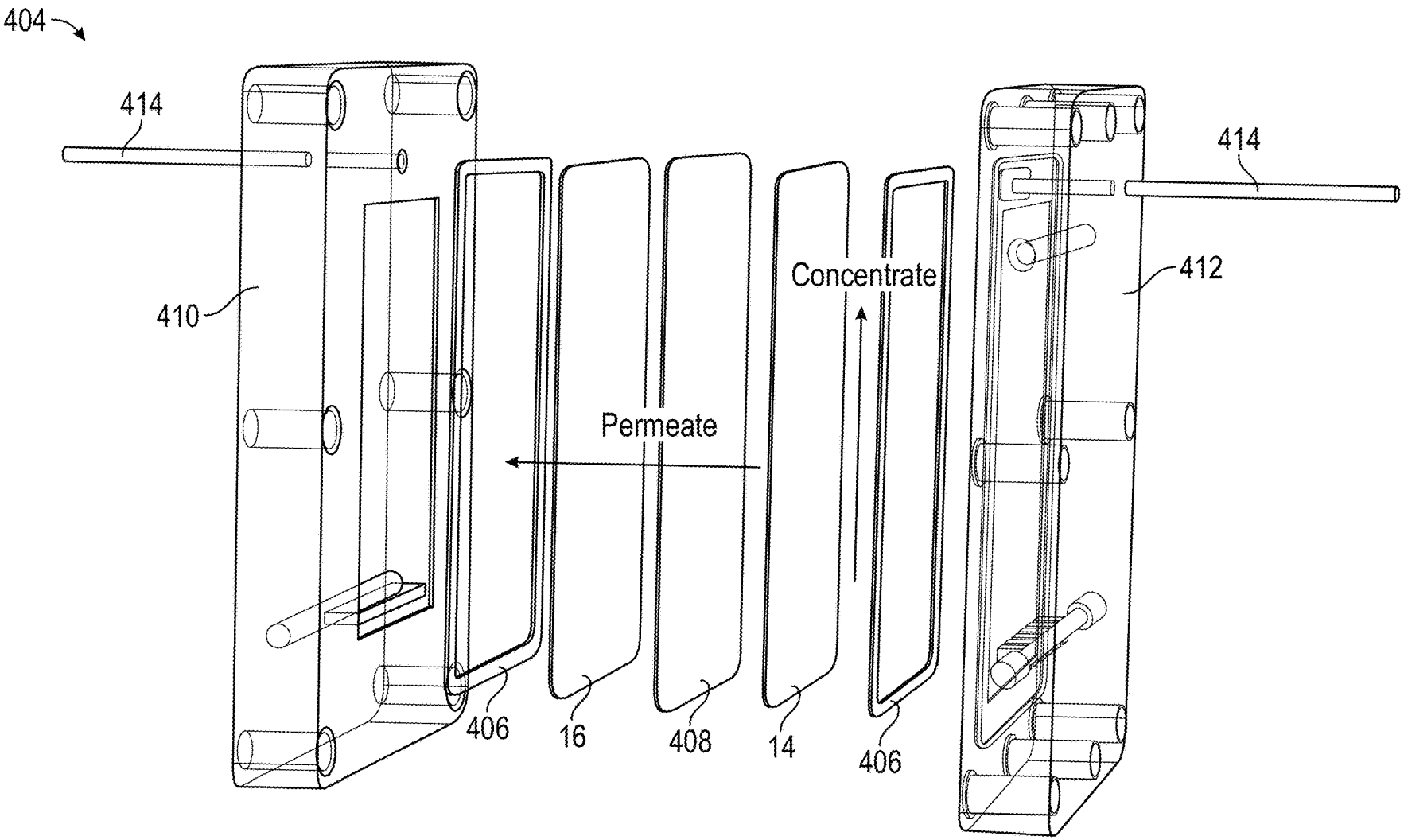
FIG. 41 is an expanded view illustration of an embodiment of an electrochemical deposition apparatus showing individual parts.

FIG. 41 illustrates electrochemical deposition apparatus 404 of the present invention comprising current collectors 406, porous cathodic material 14, anode 16, and separator 408 disposed within back housing 410 and front housing 412. Rods 414 (e.g., titanium rods) are partially disposed within back housing 410 and front housing 412 and contact current collectors 406.

Figure 42:
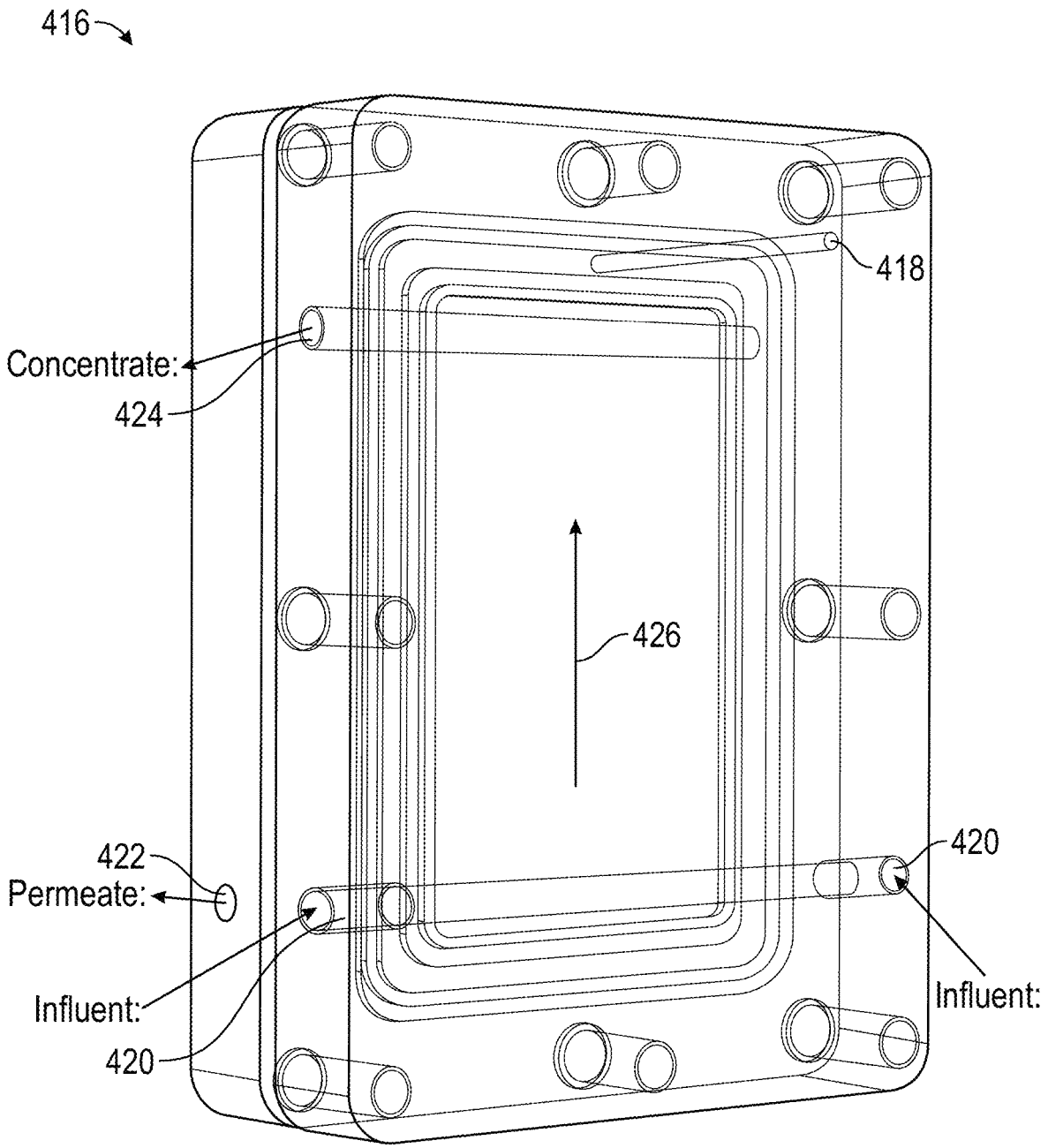
FIG. 42 is a front cut-away view illustration of an embodiment of an electrochemical deposition apparatus showing fluid and electrical flows.

FIG. 42 illustrates electrochemical deposition apparatus 416 of the present invention comprising electrical contact 418, feed inlet ports 420, permeate outlet 422 and concentrate outlet 424. Feed may traverse across electrochemical deposition apparatus 416 according to flow 426.

Figure 43:
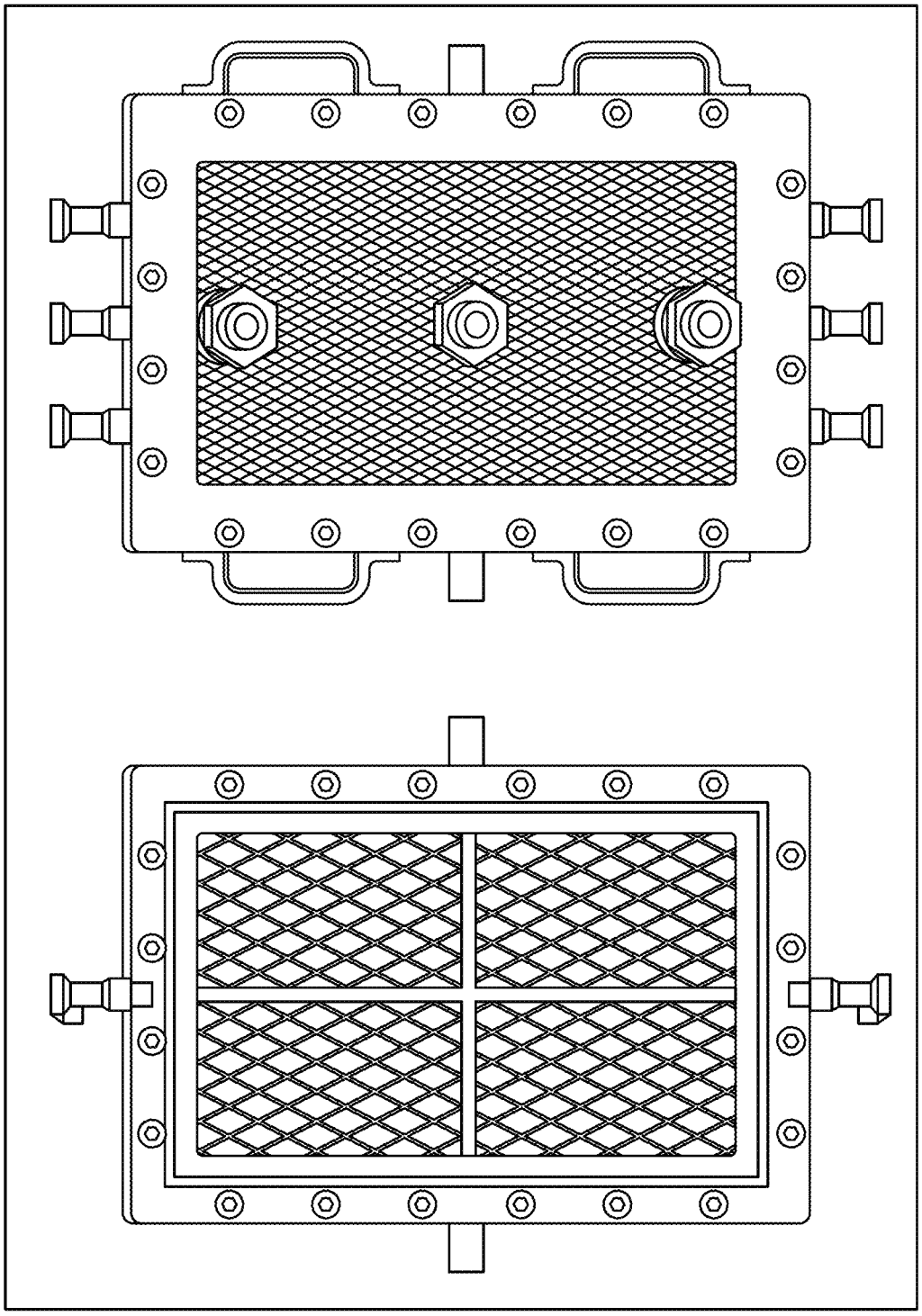
FIG. 43 is an illustration showing the external housing of an embodiment of an electrochemical deposition apparatus.

FIG. 43 illustrates an embodiment of an external housing for a chemical deposition apparatus. The external housing provides a protective casing for the internal components of a chemical deposition apparatus, including, but not limited to, the porous cathodic material, anode, electrodes, current collector, or a combination thereof. The external housing may have one or more external ports for attaching a line, including but not limited to, a feed, permeate, input, or output line, or a combination thereof.

Figure 44:
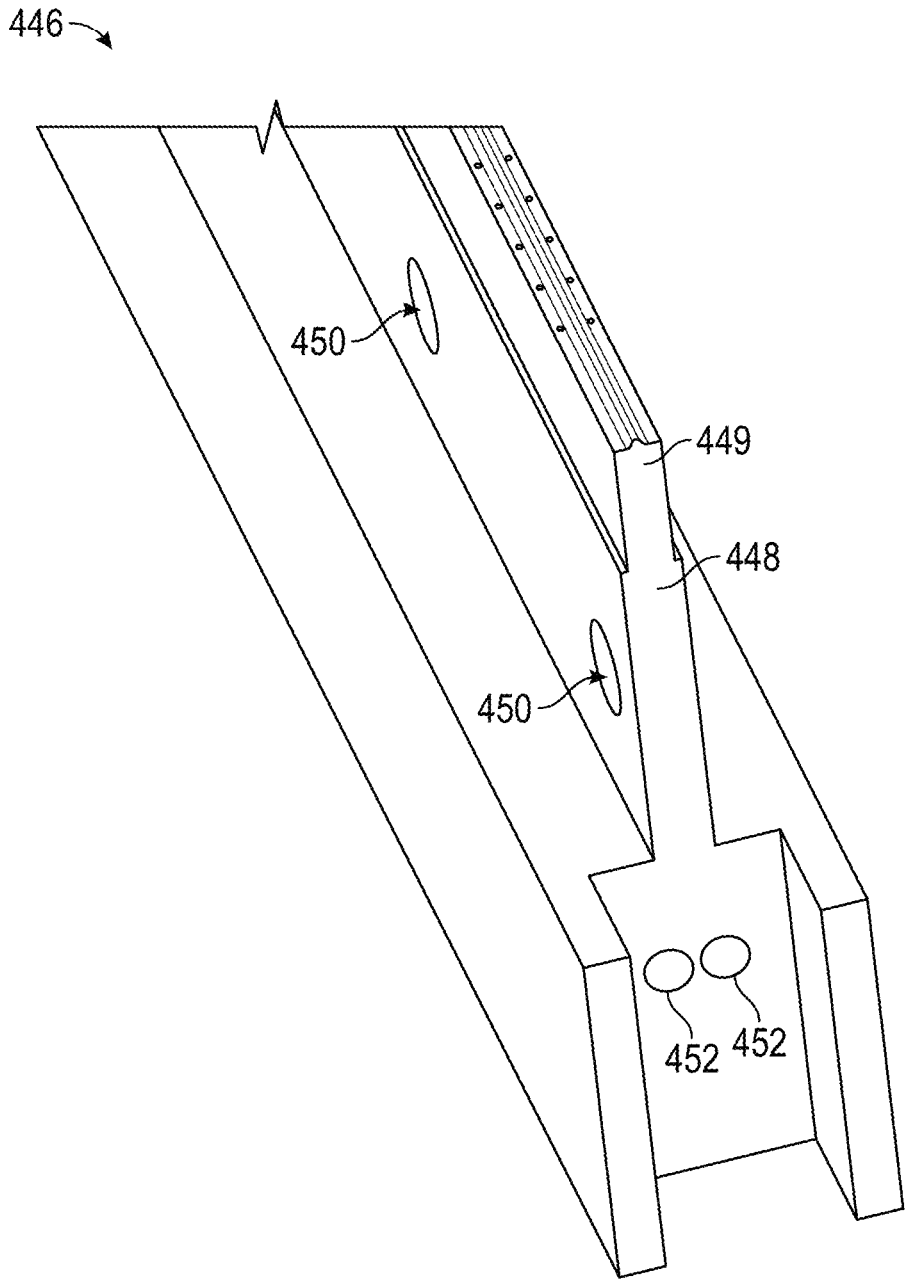
FIG. 44 is an illustration of an angled side view of a center plate component showing gas release orifices.

FIG. 44 illustrates an angled side view of center plate component 446 comprising middle plate 448 and extrusions 449. Middle plate 448 comprises a plurality of orifices 450. Gas release channels 452 are disposed within center plate component 446. Gas release channels 452 comprising two gas release channels are parallel to the base of center plate component 446. A hydrogen gas stream is dispersed from one of the two gas release channels and an oxygen gas stream is dispersed from the other gas release channel.

Figure 45:
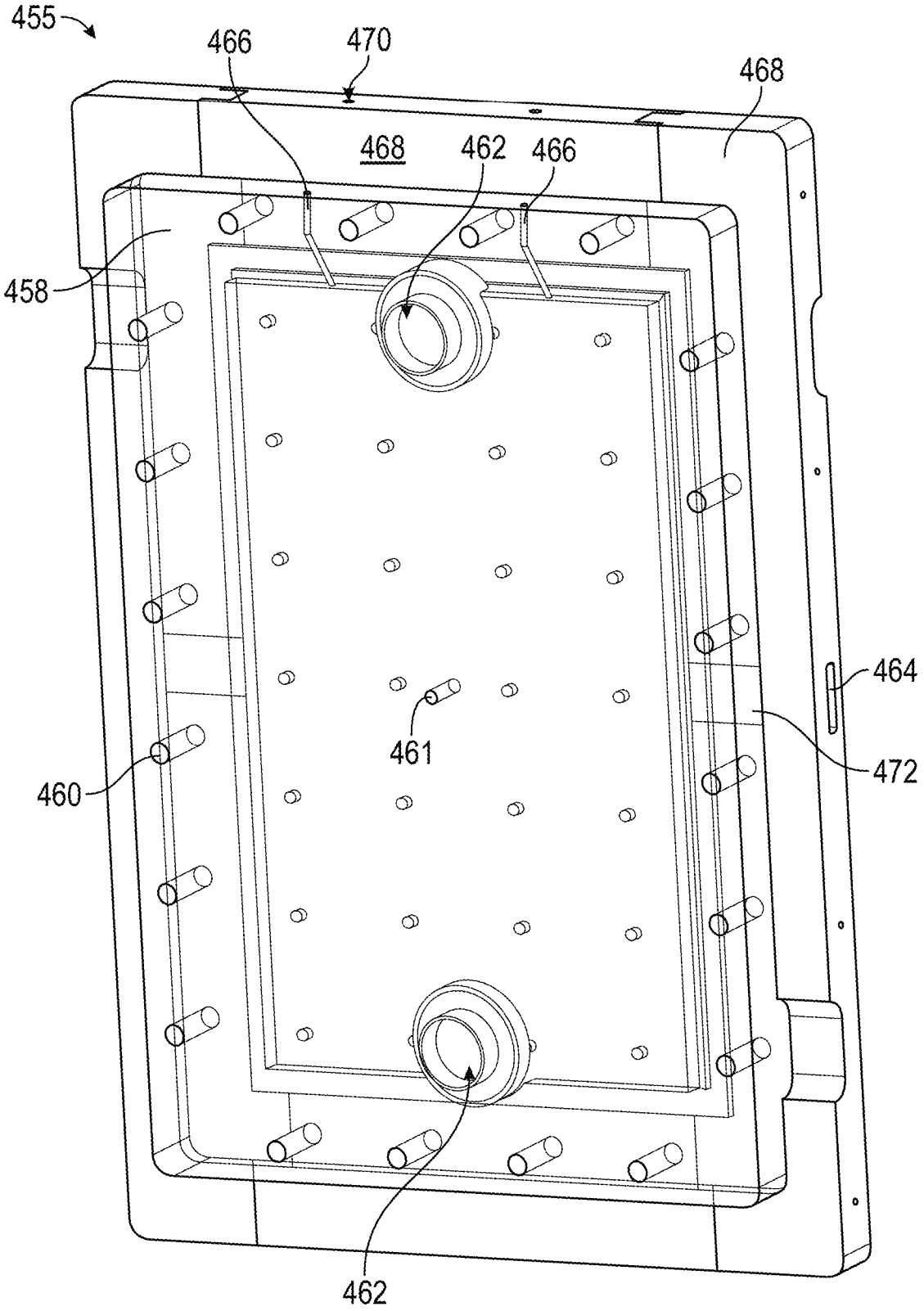
FIG. 45 is an illustration of the porous cathodic material side of an embodiment of an electrochemical deposition apparatus with ports perpendicular to porous cathodic material.

FIGS. 45-50 illustrate various embodiments of an electrochemical deposition apparatus. FIG. 45 illustrates the porous cathodic material side of electrochemical deposition apparatus 455 comprising holding body 458, fastener orifices 460, pressure gauge 461, ports 462, electrode ports 464, gas release channels 466, cover plate 468, outflow ports 470, and electrode channels 472.

Figure 46:
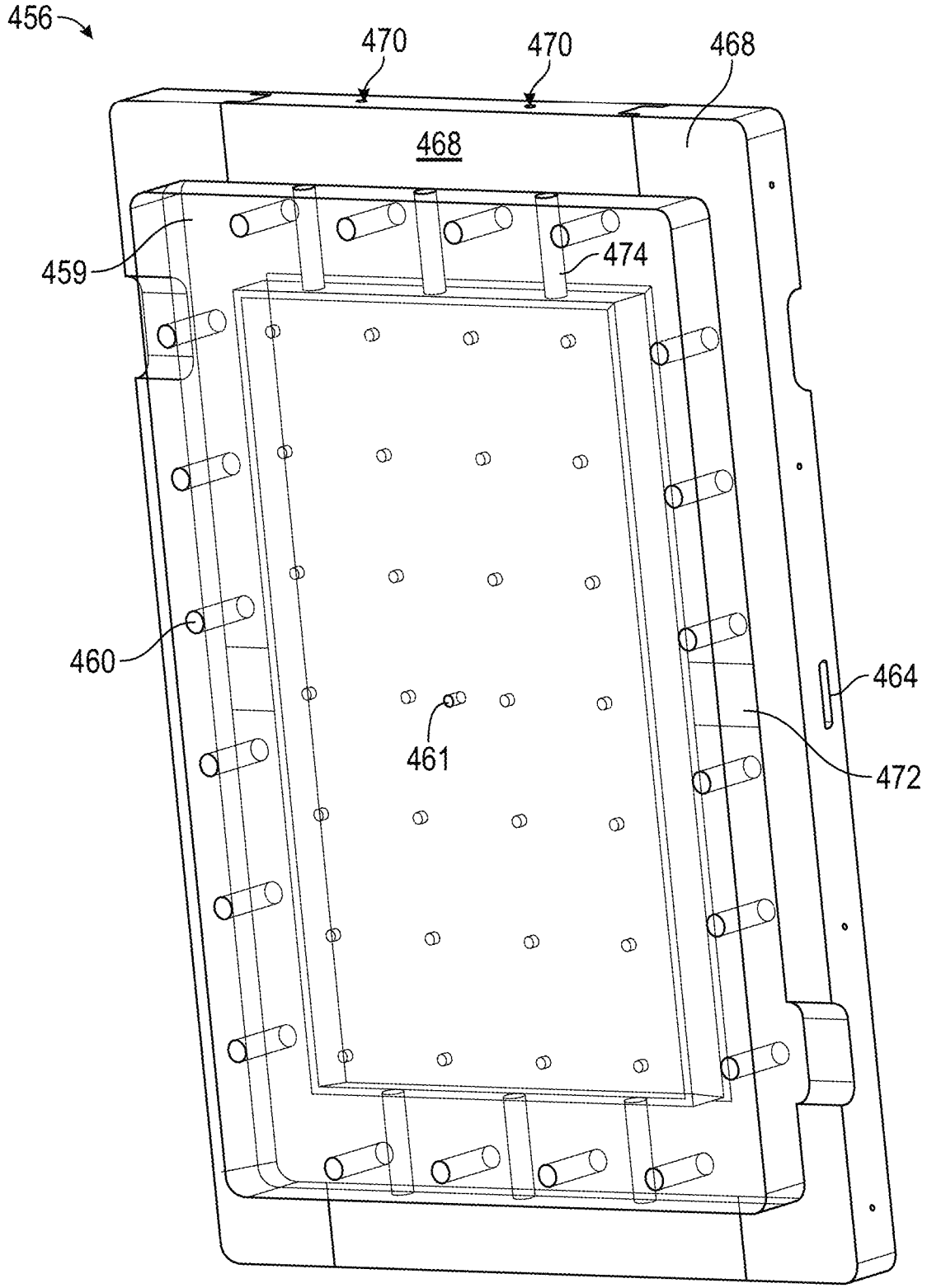
FIG. 46 is an illustration of the porous cathodic material side of an embodiment of the electrochemical deposition apparatus with ports parallel to porous cathodic material.
Figure 49:
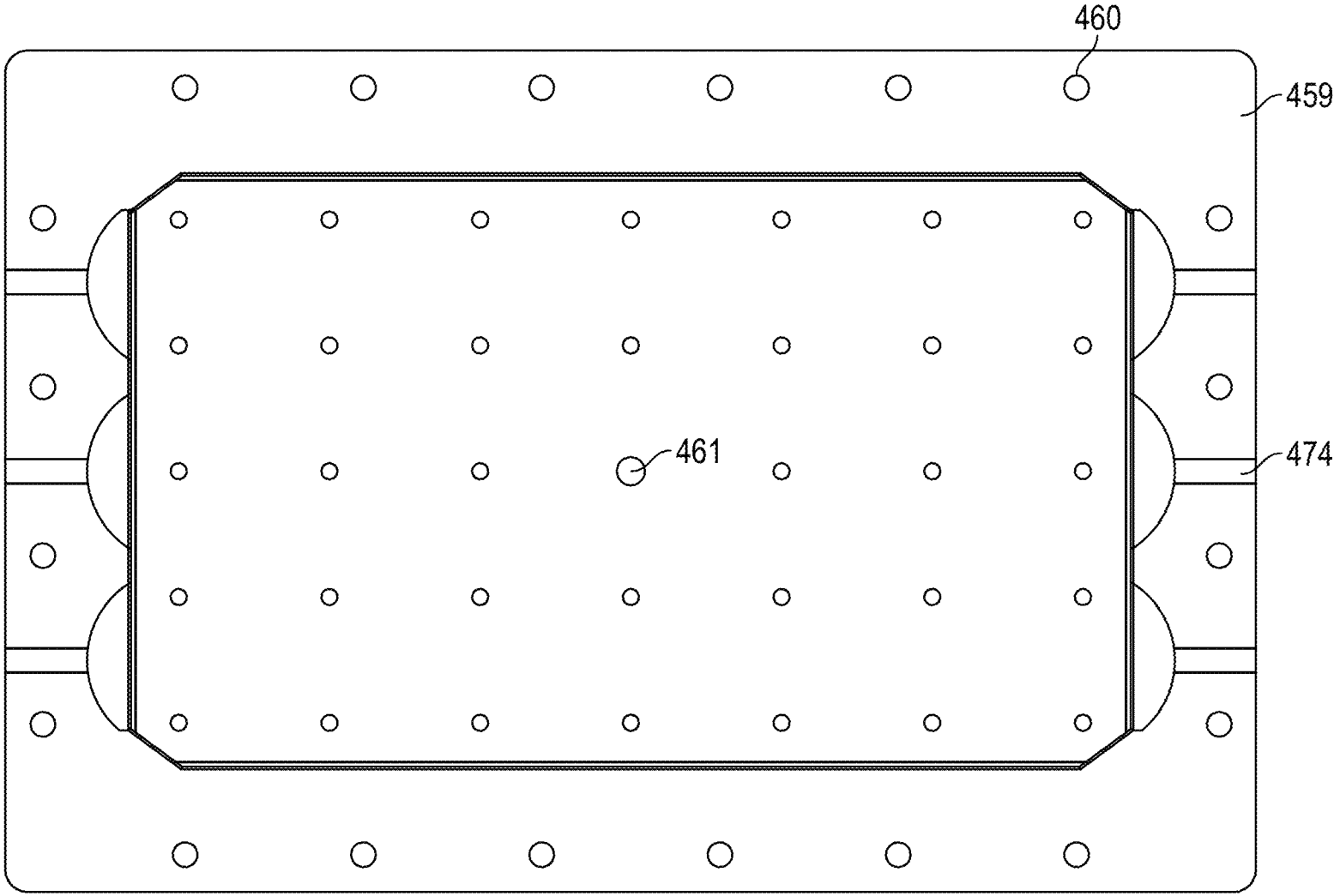
FIG. 49 is an illustration of the porous cathodic material plate an embodiment of the electrochemical deposition apparatus with ports parallel to porous cathodic material.

FIGS. 46 and 49 illustrate the porous cathodic material side of electrochemical deposition apparatus 456 comprising holding body 459, fastener orifices 460, pressure gauge 461, cathode-side ports 474, electrode ports 464, cover plate 468, outflow ports 470, and electrode channels 472.

Figure 47:
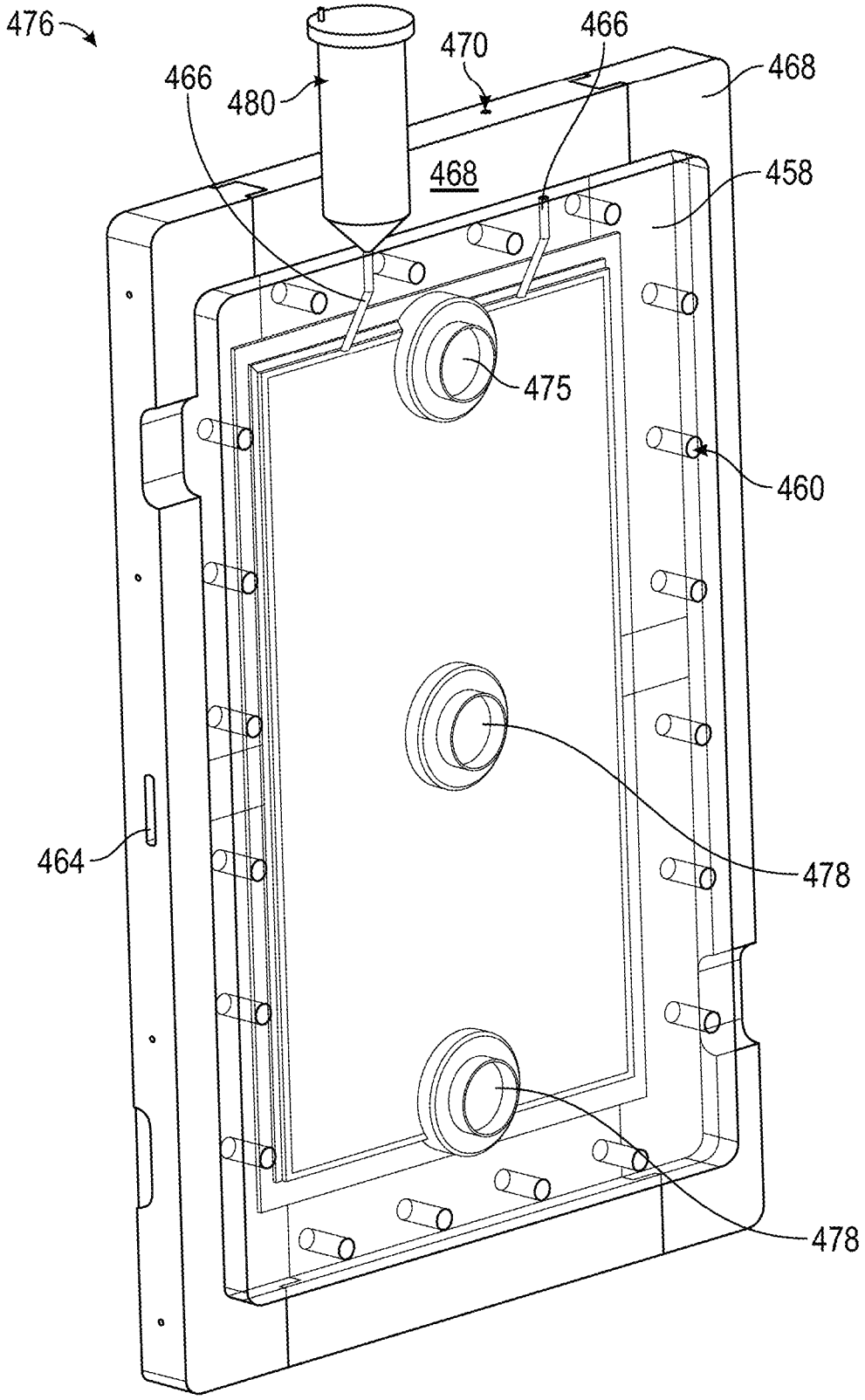
FIG. 47 is an illustration of the anode side of an embodiment of the electrochemical deposition apparatus with a gas release valve.
Figure 48:
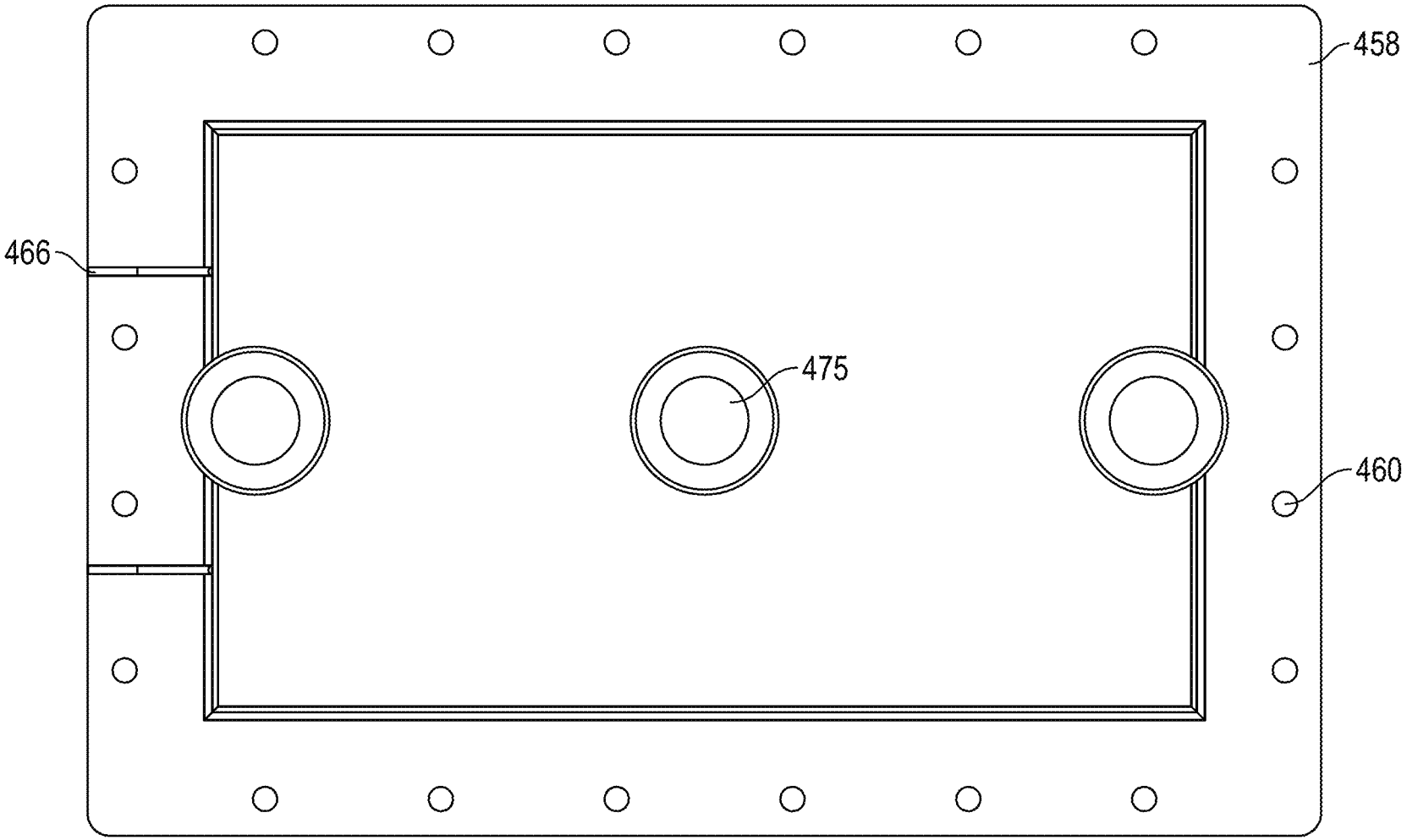
FIG. 48 is an illustration of the porous cathodic material plate an embodiment of the electrochemical deposition apparatus with ports perpendicular to porous cathodic material.

FIGS. 47 and 48 illustrate anode side of the electrochemical deposition apparatus 476 comprising holding body 458, fastener orifices 460, gas release channels 466, anode-side ports 475, electrode ports 464, cover plate 468, outflow ports 470, and gas release valve 480.

Figure 50:
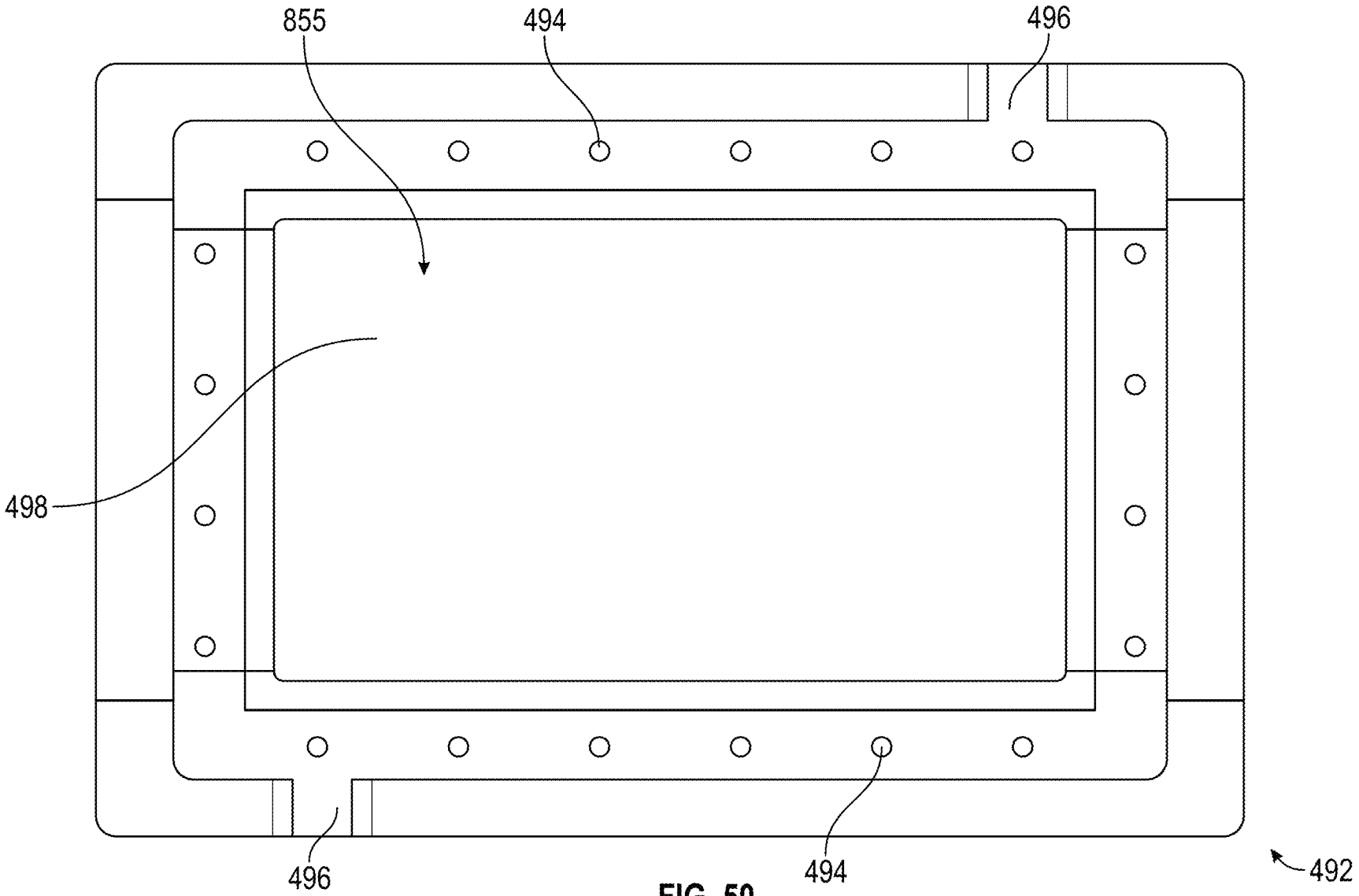
FIG. 50 is an illustration of the framing plate of an embodiment of the electrochemical deposition apparatus.

FIG. 50 illustrates a framing plate of an embodiment of the electrochemical deposition apparatus comprising a plurality of fastening orifices 494, fitting grooves 496, and cavity 498 for receiving holding body 458 (See FIG. 47).

Figure 51:
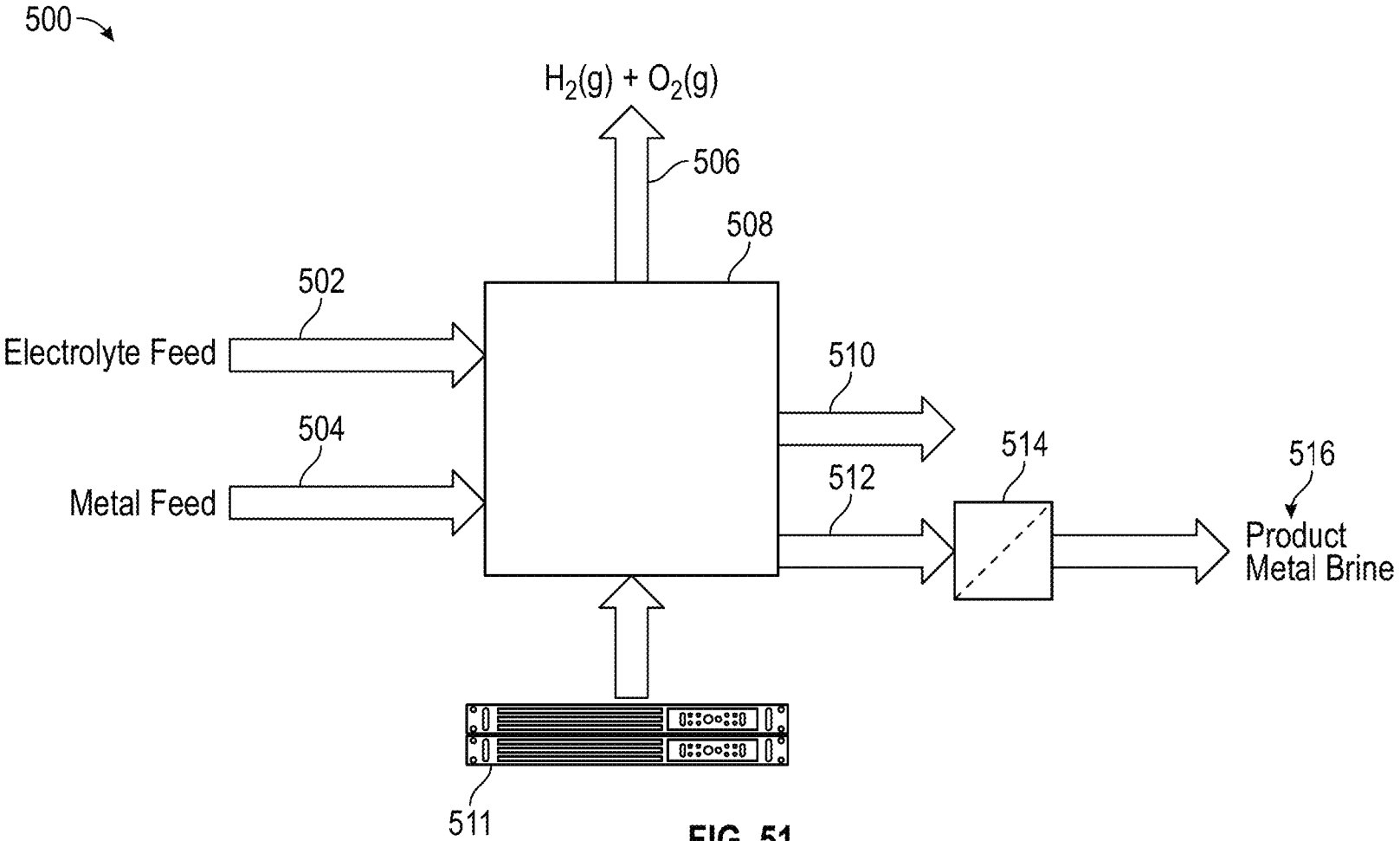
FIG. 51 is a process flow diagram showing the production of metal product using an electrochemical deposition apparatus.

FIG. 51 illustrates production process 500 of a metal product using electrochemical deposition apparatus 508. Electrolyte feed 502 and metal feed 504 pass into and/or through electrochemical deposition apparatus 508 to yield hydrogen and oxygen gas stream 506, aqueous anode permeate 510, and porous cathodic material permeate 512. Electrochemical deposition apparatus 508 is powered by power supply 511. Power supply may provide a voltage of about 10 V. Porous cathodic material permeate 512 contacts filter 514 to yield solid metal product 516 and an aqueous metal brine product.

Figure 52:
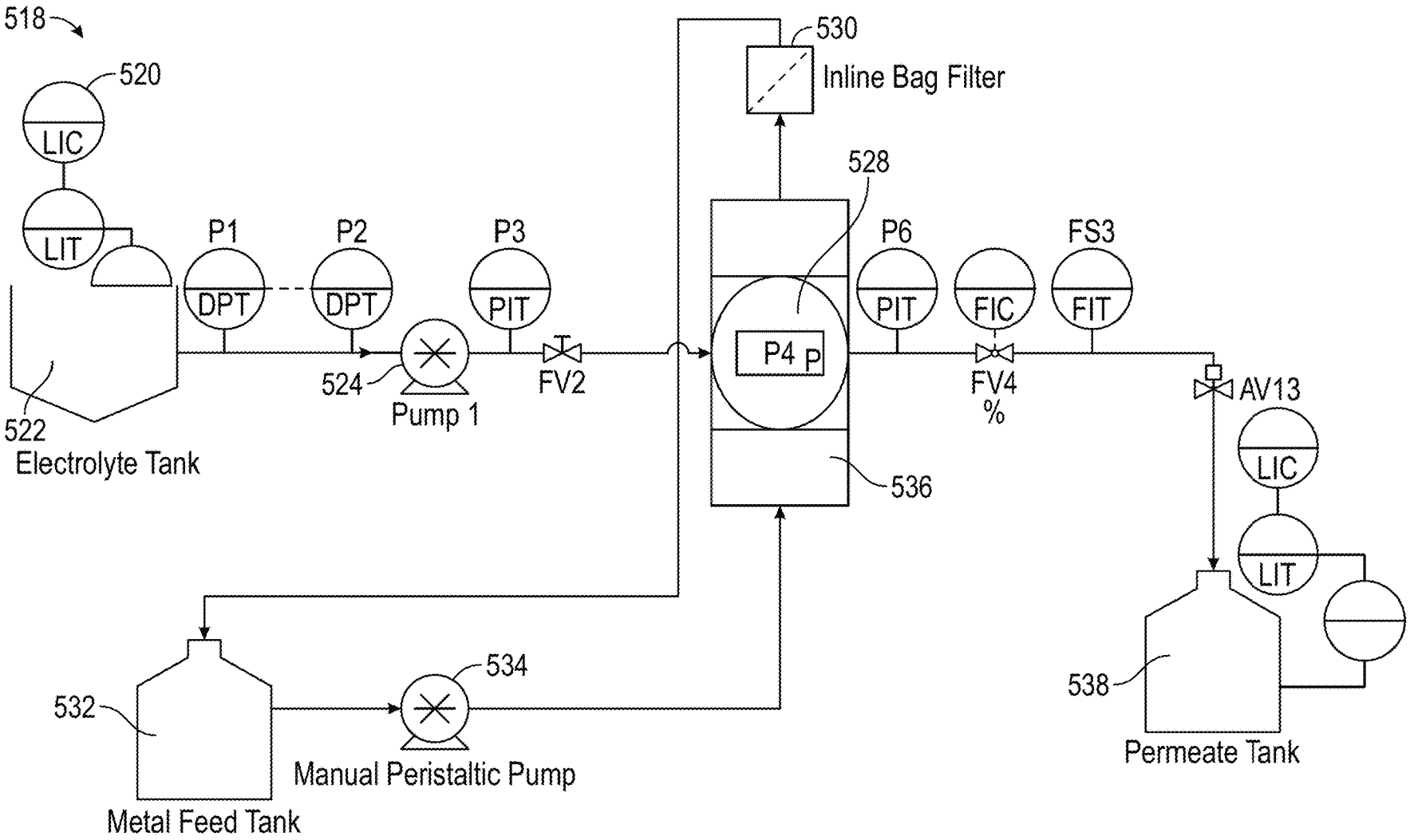
FIG. 52 is a process flow diagram showing a process for concentrating of a selected metal using an electrochemical deposition apparatus.

FIG. 52 illustrates process 518 for concentration of a selected metal using an electrochemical deposition apparatus 536. Electrolyte solution from electrolyte tank 522 is conveyed by pump 524 to processing unit 528 comprising electrochemical deposition apparatus 536. Metal feed from tank 532 is conveyed by manual peristaltic pump 534 to processing unit 528 comprising electrochemical deposition apparatus 536. Permeate from processing unit 528 passes into permeate tank 538. Concentrated metal feed passes into inline bag filter 530 and is recycled into metal feed tank 532.

Figure 53:
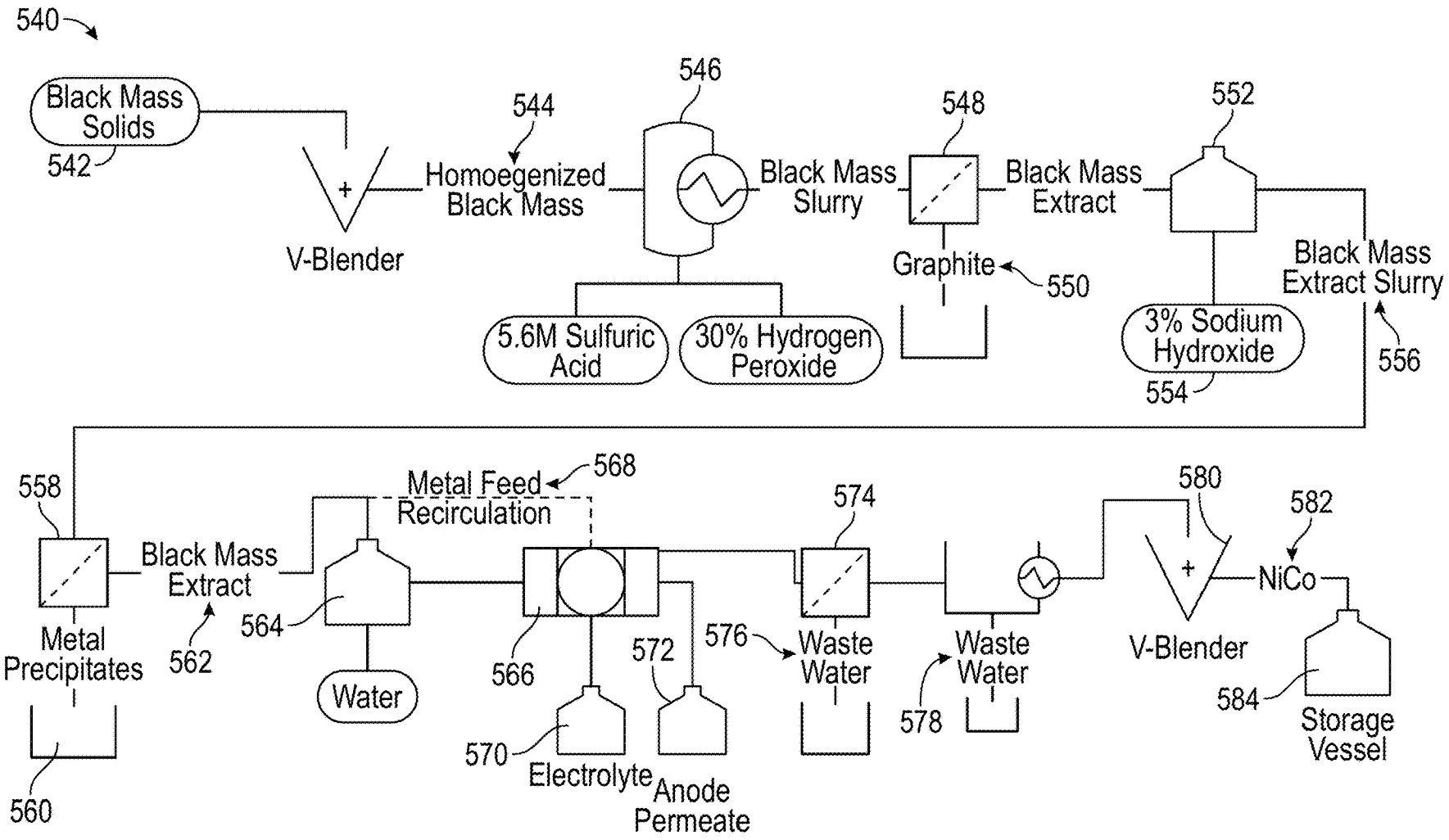
FIG. 53 is a process flow diagram showing metal product production from black mass using an electrochemical deposition apparatus.

FIG. 53 illustrates metal product production process 540 from black mass using electrochemical deposition apparatus 566. Black mass solids 542 are homogenized to form homogenized black mass 544. Homogenized black mass is contacted with e.g., sulfuric acid and hydrogen peroxide to form black mass slurry in vessel 546. Black mass slurry is contacted by filter 548 to remove graphite 550 and form black mass extract in vessel 552. Black mass extract is contacted with sodium hydroxide 554 to form black mass extract slurry 556, which is contacted by filter 558 to remove metal precipitates collected in vessel 560. Black mass extract 562 is diluted with water in vessel 564 before entering electrochemical deposition apparatus 566 and being contacted with electrolyte 570. Recirculated black mass 568 can be recycled into vessel 564. Anode permeate from electrochemical deposition apparatus 566 is collected in vessel 572. Product, for example NiCo 582, from electrochemical deposition apparatus 566 is contacted with filter 574 to produce wastewater and/or Li-brine 576 and concentrated product. The concentrated product is homogenized in blender 580 before being collected in storage vessel 584.

Figure 54:
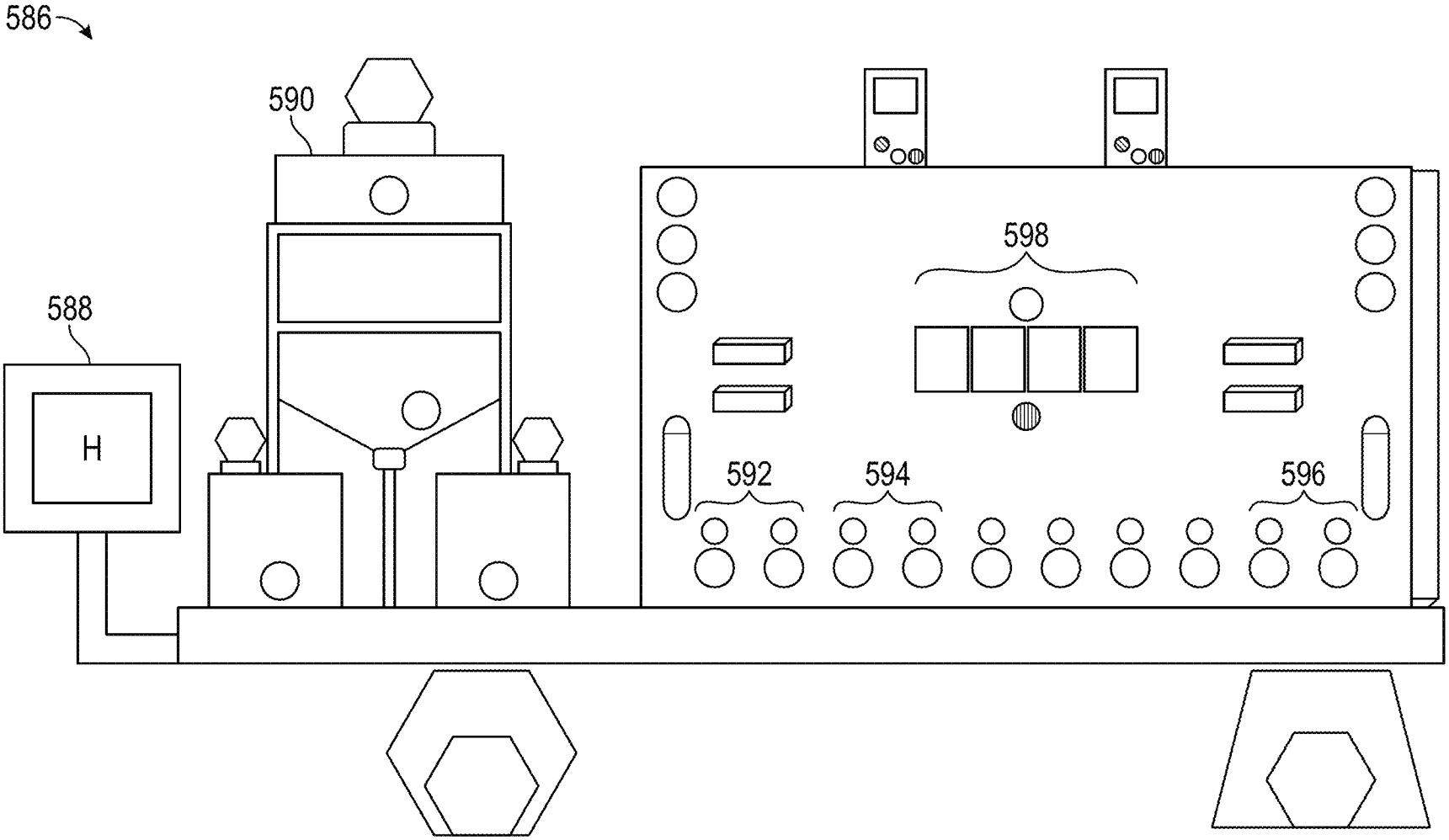
FIG. 54 is a diagram showing an embodiment of an electrochemical deposition apparatus of the present invention.
Figure 55:
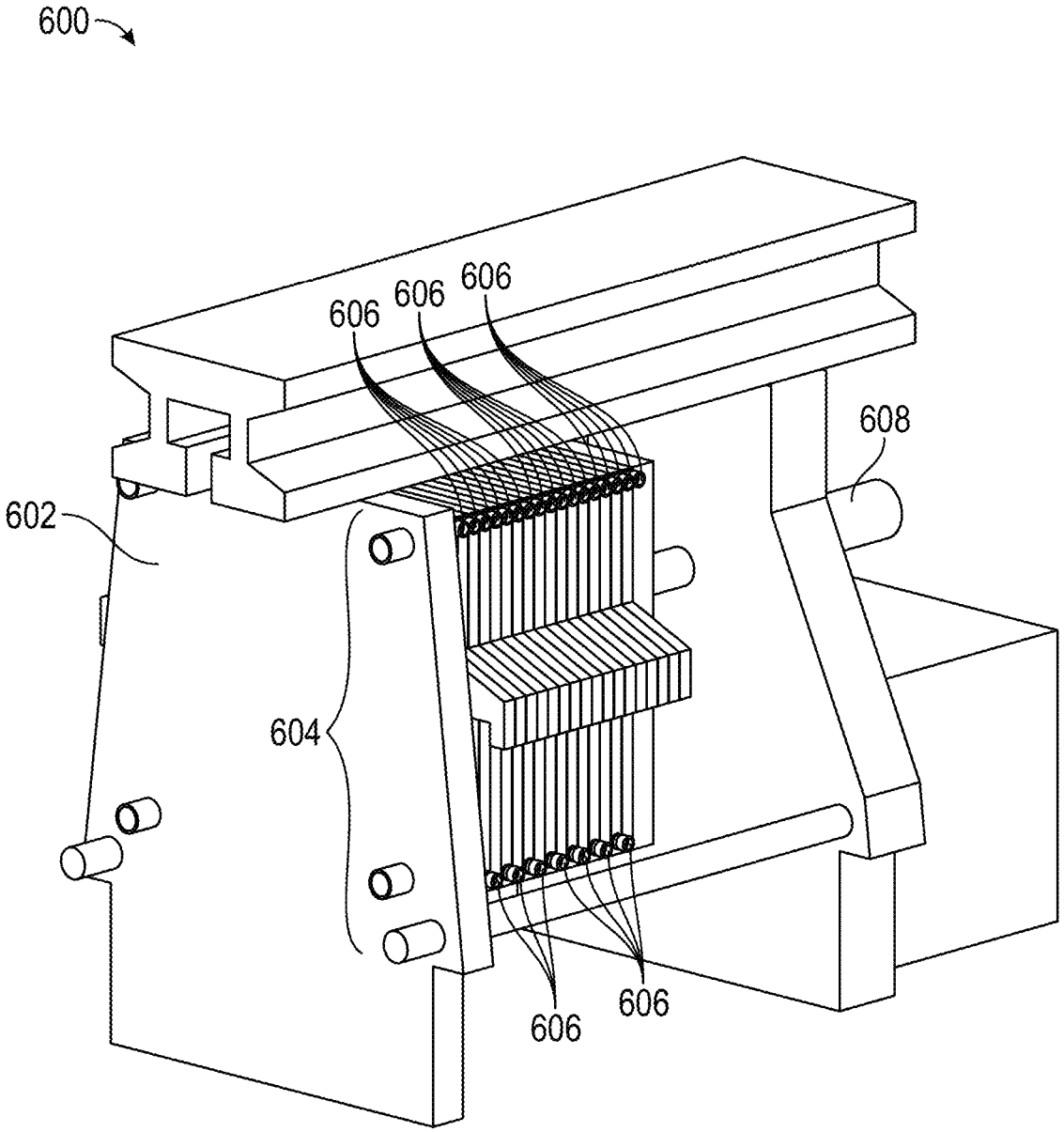
FIG. 55 is a diagram showing a plate system comprising plates and a housing for an embodiment of an electrochemical deposition apparatus.
Figure 56:
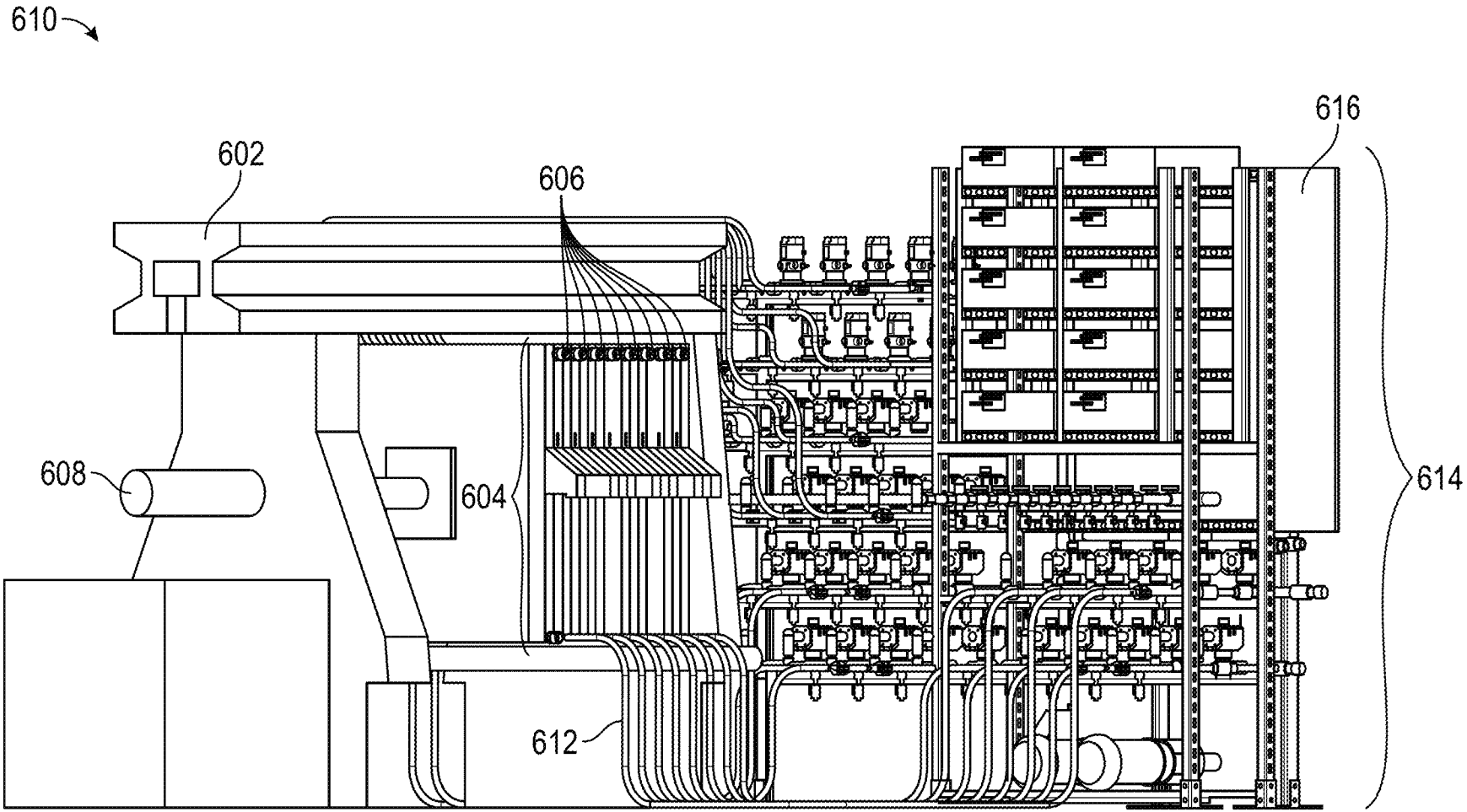
FIG. 56 is a diagram showing plates, a housing, automation system, power supplies, valves, flow monitors, and housing for an embodiment of an electrochemical deposition apparatus
Figure 57:
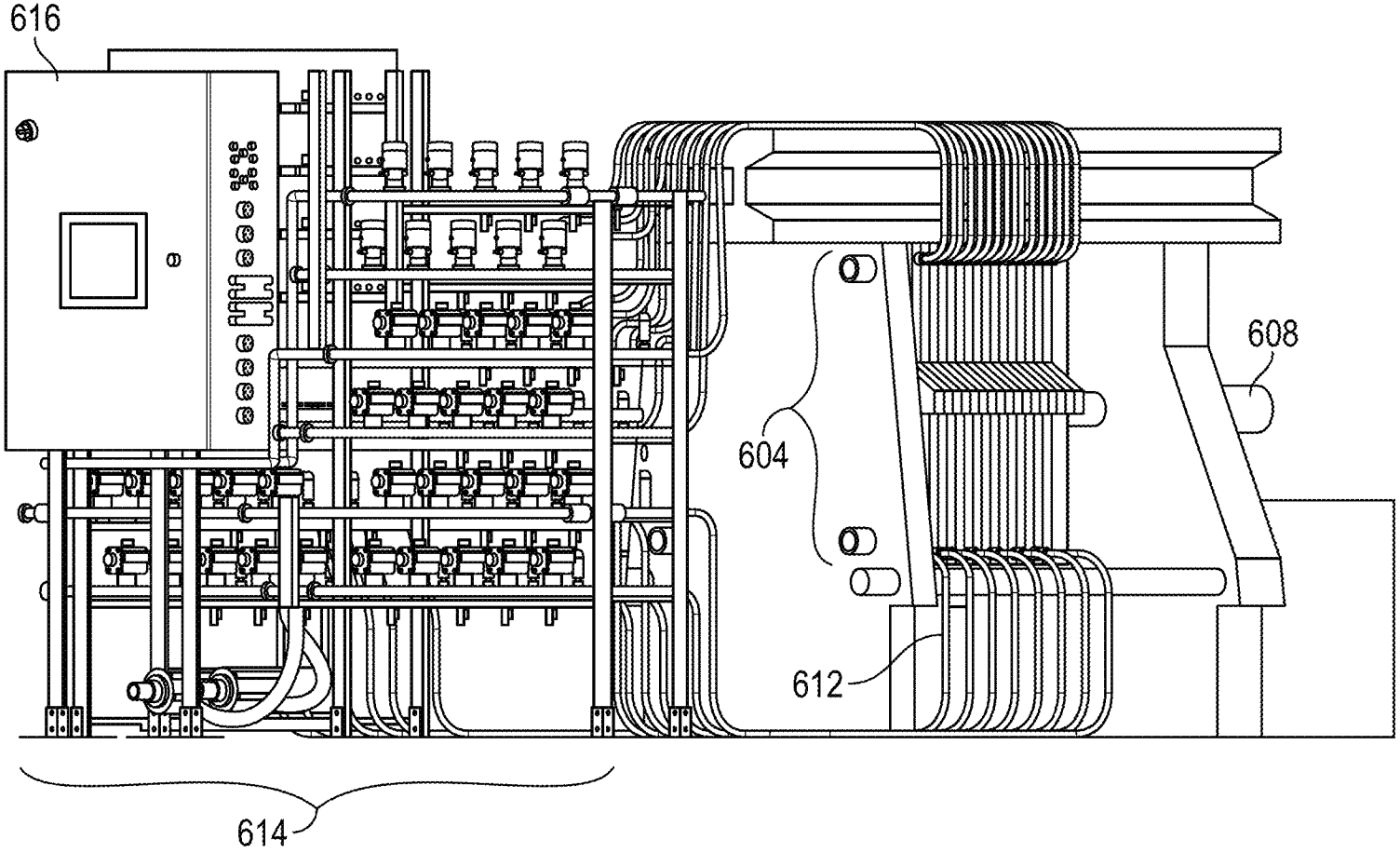
FIG. 57 is a diagram showing plates, a housing, automation system, power supplies, valves, flow monitors, and housing for an embodiment of an electrochemical deposition apparatus.

FIG. 54 illustrates electrochemical deposition apparatus 586 comprising power supply 588, reagent and feed storage system 590, feed ports 592, permeate ports 596, reagent ports 594, and acid and/or base ports 598. FIG. 55 illustrates plate system 600 comprising housing 602, input and/or output arrays 606, plate array 604, and plate adjuster 608. FIGS. 56 to 57 illustrate electrochemical deposition apparatus 610 comprising housing 602, input and/or output arrays 606, plate array 604, and plate adjuster 608 reagent and feed fluid pumps 614 and automation control system 616.

Figure 58:
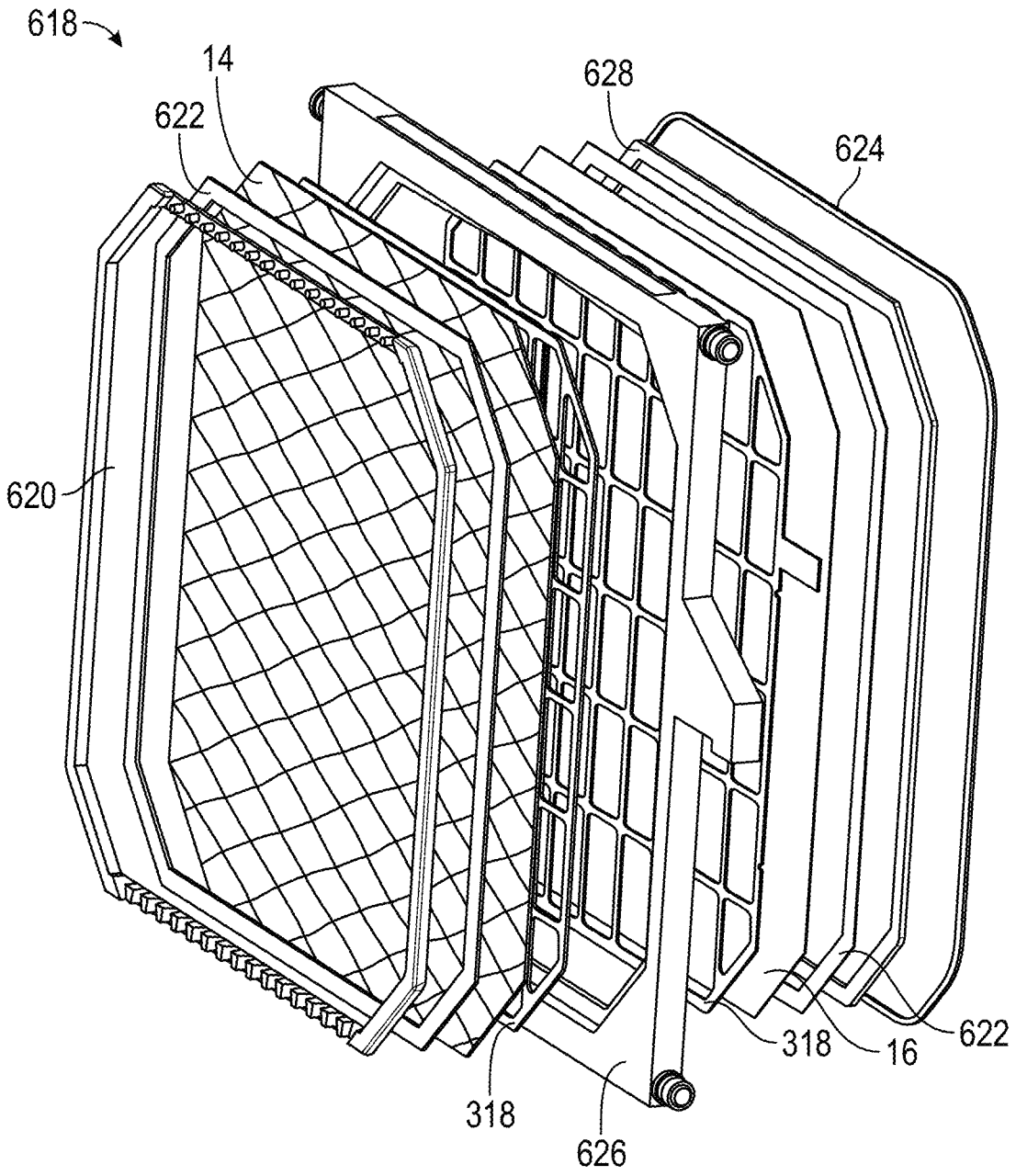
FIG. 58 is a diagram showing the components of a plate.

FIG. 58 illustrates plate 618 comprising thick collar 620, gasket 622, porous cathodic material 14, current collectors 318, plate 626, anode 16, think collar 628, and O-Ring 624.

Figure 59:
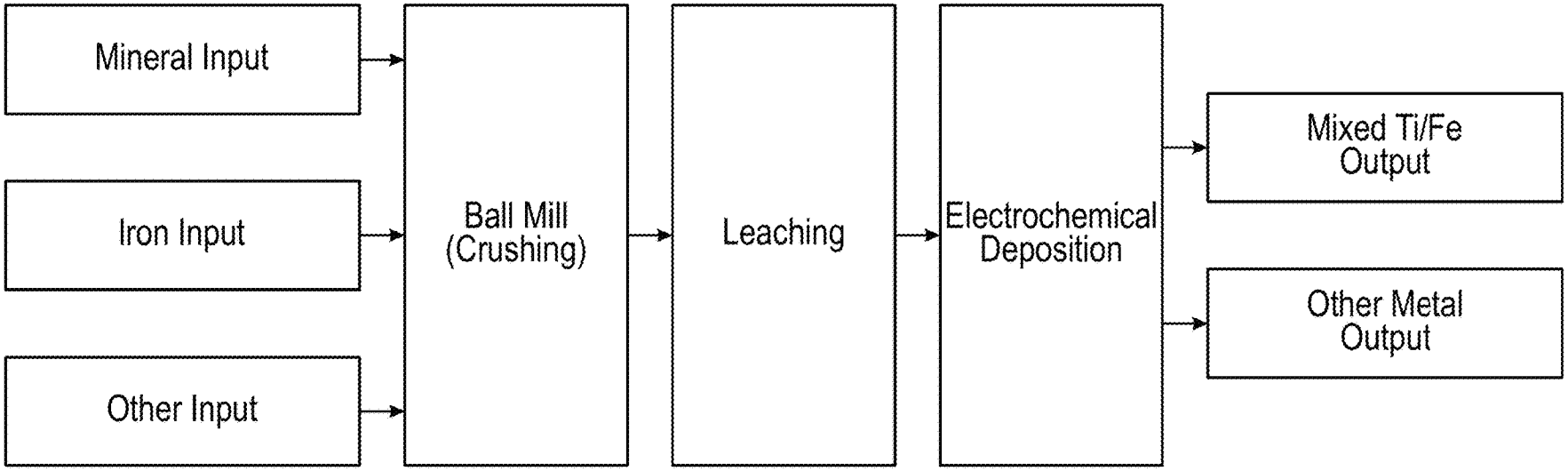
FIG. 59 is a process flow diagram where the electrochemical deposition apparatus is used to extract Ti and Fe from ilmenite ore.

The present invention can be utilized for a wide range of metal processing applications from virgin ore to end-of-life materials. FIG. 59 shows a process flow diagram of metal extraction from minerals, (e.g., virgin ore) using a chemical deposition apparatus of the present invention. Mineral input; iron input, including but not limited to, in the form of ore, concentrate, agglomerated material, slurry, or a combination thereof; and other input, including, but not limited to, in the form of acid, catalyst, surfactant, or a combination thereof, is crushed by e.g., ball milling and leached to form a solution. The solution is then processed by a chemical deposition apparatus to form a mixed iron output, for example, a Ti/Fe output, and/or other metal output, for example, copper, lithium, or other metal of interest. A virgin ore such as ilmenite may be input to the process. The ore may be first crushed and/or milled to a smaller particle size. The milled ore then may be beneficiated to a higher-grade concentrate using a range of methods such as density separation, magnetic separation, flotation, etc. The ore concentrate would then be leached with a process, including but not limited to, acid, high-pressure oxidation, or the present invention. The leach may be done selectively to only dissolve one or more specific metals. The undissolved material is then filtered from the dissolved material. Metals in the leached solution are then reprecipitated by the electrochemical deposition process of the present invention. The metals may be selectively precipitated to yield a high purity metal product. For example, the Ti can be selectively precipitated from an ilmenite leach liquor.

Figure 60:
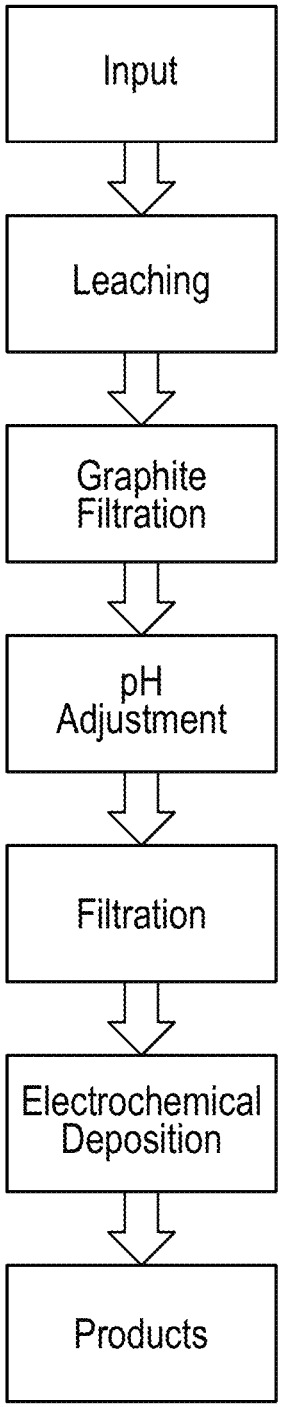
FIG. 60 is a process flow diagram incorporating the electrochemical deposition apparatus to produce Co, Ni, and Mn products.

FIG. 60 shows a process flow diagram of metal exaction from minerals using a chemical deposition apparatus of the present invention. Mineral input is leached to form a leaching product. The leaching product is filtered to remove the selected metal or material and the pH is adjusted using a reagent including, but not limited to an acid, base, buffer, or a combination thereof. The filtered product is processed by a chemical deposition apparatus to yield a product. The product may comprise a metal. The received material may be a crushed and/or milled end-of-life material such as from batteries, magnets, electric motors, circuit boards, catalytic converters, etc. The material is first leached with a process, including but not limited to, a reducing acid, oxidizing acid, or the present invention. The leach may be done selectively to only dissolve desirable metals or to remove undesirable metals. The undissolved material is then filtered from the dissolved metals. The filtered material could be a product such as graphite. If needed, a pH adjustment can be completed via chemical methods or using the present invention to precipitate either desirable or undesirable metals. The precipitates are then filtered from the dissolved solution. The filtrate is then passed through electrochemical filtration to yield an upgraded higher value metal product. For batteries, as an example, this can be Ni precipitates, Co precipitates, mixed NiCo precipitates, NMC precipitates, etc. For magnets, this can be Nd precipitates, Pr precipitates, mixed NdPr precipitates, etc. For circuit boards, this can be Cu precipitates, Au precipitates, or mixed CuAu precipitates. For catalytic converters, this can be Pd precipitates, Pt precipitates, Rh precipitates, mixed PdPtRh precipitates, etc.

Figure 61:
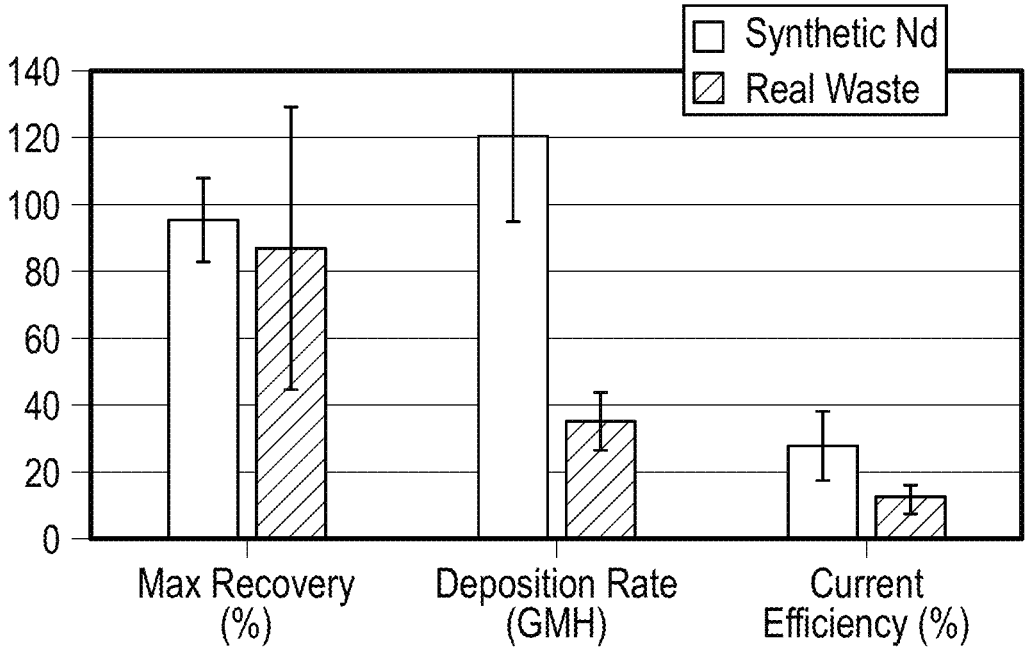
FIG. 61 is a graph showing the electrochemical performance of the electrochemical deposition apparatus/method of the present invention for synthetic aqueous Nd and real waste (e.g., a real magnet extract)

FIG. 61 shows a graph of recovery of synthetic Nd vs. real waste using a chemical deposition apparatus of the present invention. The maximum recovery, deposition rate, and current efficiency is greater with synthetic Nd. FIG. 61 presents results evaluating Nd recovery from both synthetic Nd solutions and Nd solutions produced from end-of-life magnets. The end-of-life magnets were processed by demagnetization in an oven, milling, dissolving in nitric acid, filtering remaining solids, pH adjustment if needed, and then electrochemical deposition, similar to that described in FIG. 60. The synthetic Nd was observed to have a higher recovery, deposition rate, and current efficiency as compared to the EOL magnet Nd, as expected due to the presence of other species in the magnet solutions including Pr, Dy, and Fe as well as a higher input Nd concentration. Operating conditions were standard flow (see FIG. 23).

Figure 62:
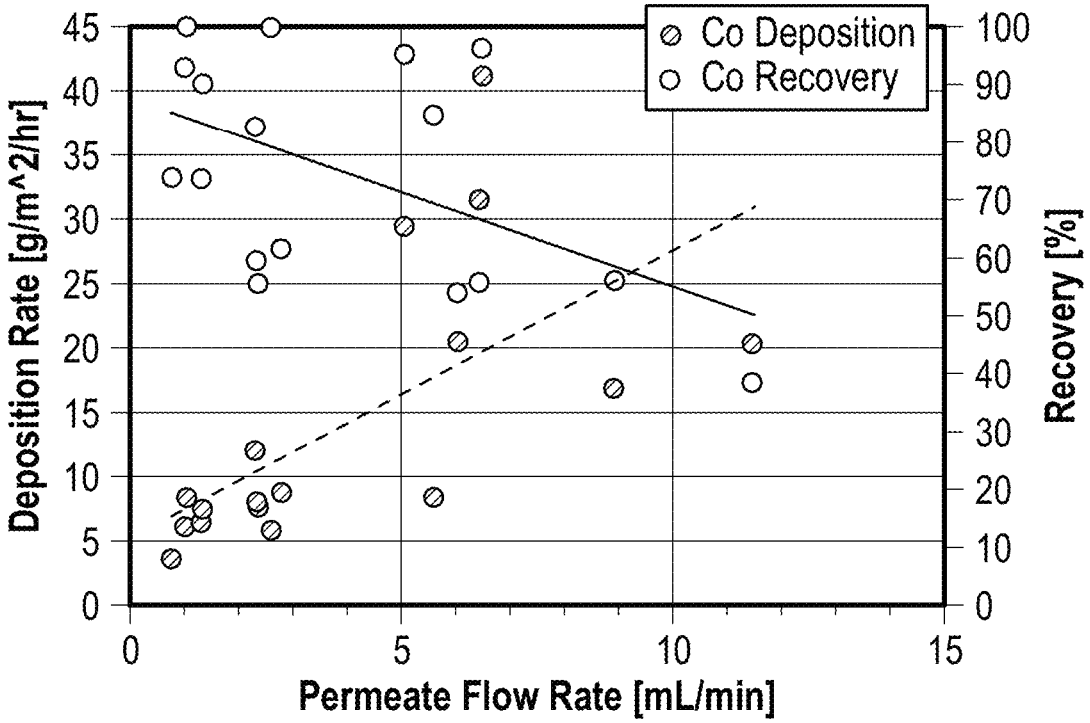
FIG. 62 is a graph showing deposition rate v. permeate flow rate for Co deposition and recovery where the feed is a synthetic battery porous cathodic material stream.

The Co recovery generally decreases with increased permeate flow rate and decreased deposition rate. FIG. 62 presents results on Co recovery (%) and deposition rate (g/m2/h) from a mixed synthetic Ni/Mn/Co solution as a function of permeate flow rate in the standard flow configuration, (see FIG. 23). As the permeate flow rate increases, the Co recovery decreases, while the deposition rate increases. Although less of the Co is recovered, the deposition rate increases since the total mass flow Co increases to a greater extent.

Figure 63:
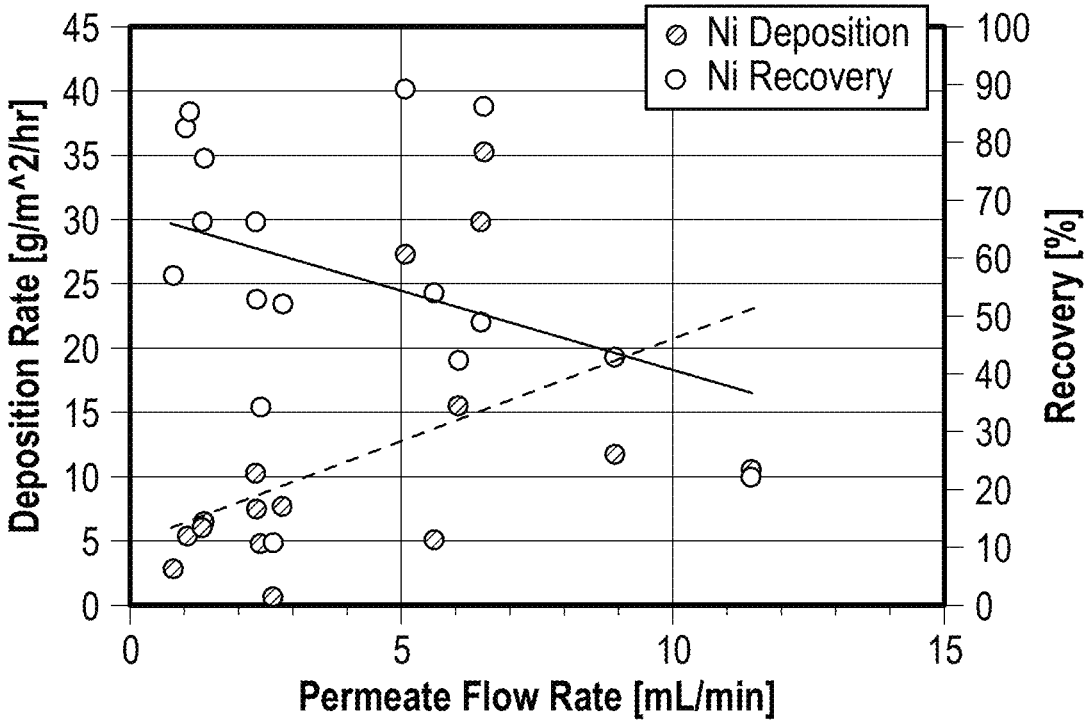
FIG. 63 is graph showing deposition rate v. permeate flow rate for Ni deposition and recovery where the feed is a synthetic battery porous cathodic material stream.

FIG. 63 shows a graph of deposition rate vs. permeate flow rate for Ni deposition and recovery. The Ni deposition rate generally increases with increased permeate flow rate and increased deposition rate. Ni recovery generally decreases with increased permeate flow rate and decreased deposition rate. FIG. 63 presents results on Ni recovery (%) and deposition rate (g/m2/h) from a mixed synthetic Ni/Mn/Co solution as a function of permeate flow rate in the standard flow configuration, (see FIG. 23). As the permeate flow rate increases, the Co recovery decreases, while the deposition rate increases. Although less of the Ni is recovered, the deposition rate increases since the total mass flow Ni increases to a greater extent.

Figure 64:
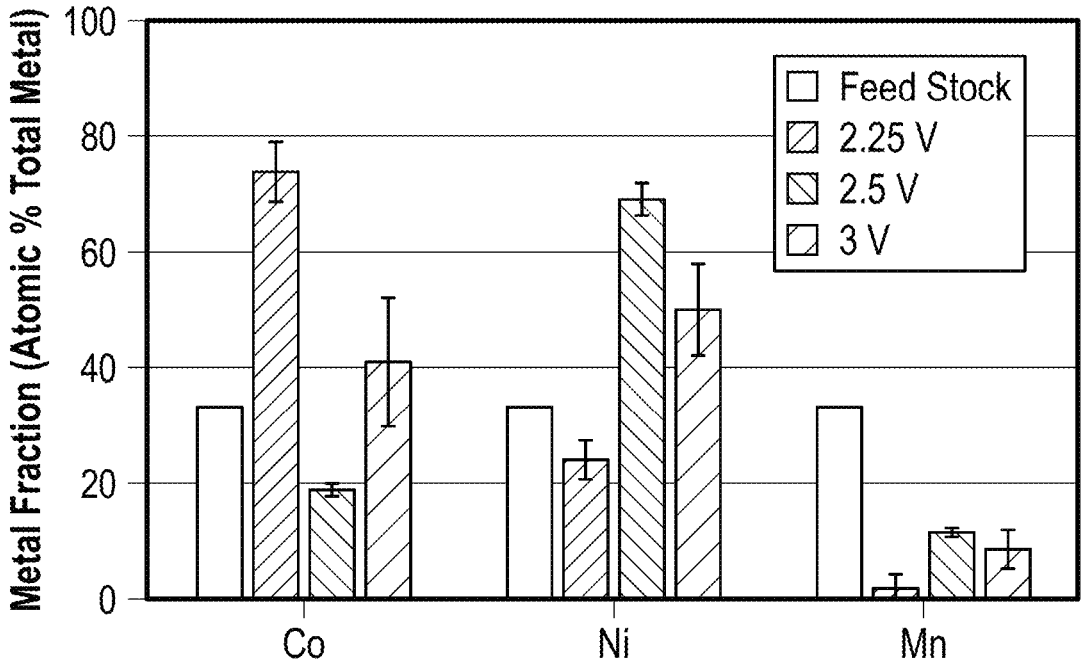
FIG. 64 is a graph showing the normalized metal atomic percentage as a fraction of the total electrodeposited metal as characterized by SEM and EDS where the feed is a synthetic battery porous cathodic material stream.

FIG. 64 shows a graph of metal fractions at various voltages for Co, Ni, and Mn. The Co metal fraction was greatest at 2.25 V applied to a chemical deposition apparatus. The Ni and Mn metal fraction was greatest at 2.5 V applied to a chemical deposition apparatus. This graph demonstrates that there is an optimum voltage for each metal fraction. FIG. 64 presents results on the metal composition of the precipitates from the electrochemical deposition system of the present invention as a function of applied voltage. As the applied cell voltage increased from 2.25 to 2.5 to 3.0 V, the Ni:Mn:Co product ratio varied. At all voltages, Ni and Co were preferentially precipitated as compared to Mn. At 2.25 V, there was a 3:1 selectivity for Co as compared to Ni. At 2.5 V, there was a 3:1 selectivity for Ni as compared to Co. At 3 V, there was no significant selectively between Co and Ni. The ability to tune the system for selective metal hydroxide precipitation is related to the differences of the three metals pH-pe diagrams.

Figure 65:
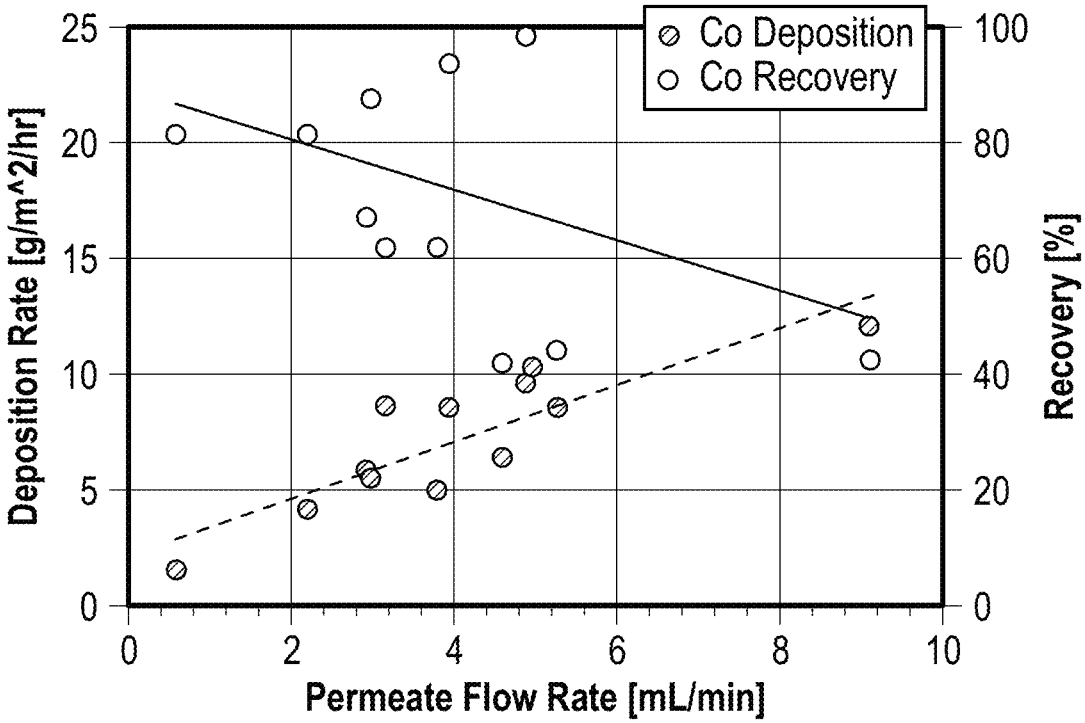
FIG. 65 is a graph showing deposition rate v. permeate flow rate for Co deposition and recovery where the feed is black mass extract.

FIG. 65 shows a graph of deposition rate vs. permeate flow rate for Co deposition and recovery for permeate flow rates of 0 to 10 mL/min and deposition rates of 0 to 25 $g/m^2/hr$. The Co deposition rate generally increases with increased permeate flow rate and increased deposition rate. FIG. 65 presents results on Co recovery (%) and deposition rate (g/m2/h) from a black mass, i.e., shredded end-of-life Li-ion battery or input into electrochemical deposition as shown in FIG. 60, and extract solution as a function of permeate flow rate in the standard flow configuration, (see FIG. 23). As the permeate flow rate increases, the Co recovery decreases, while the deposition rate increases similar to FIG. 62. Although less of the Co is recovered, the deposition rate increases since the total mass flow Co increases to a greater extent.

Figure 66:
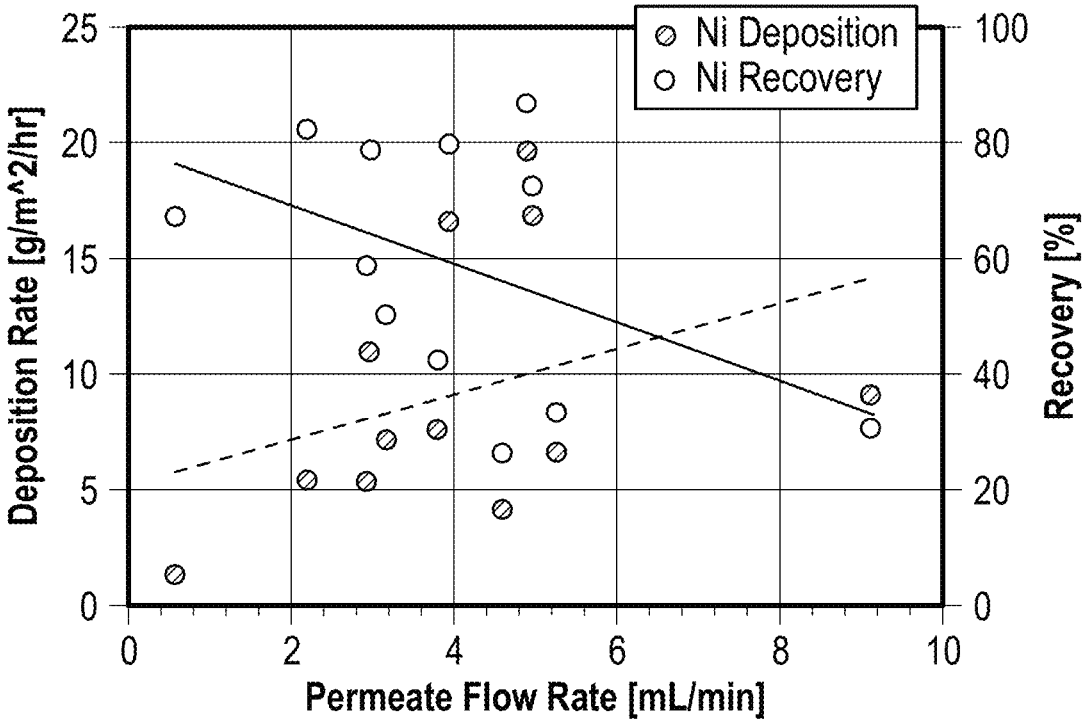
FIG. 66 is a graph showing deposition rate v. permeate flow rate for Ni deposition and recovery where the feed is black mass extract.

FIG. 66 shows a graph of deposition rate vs. permeate flow rate for Ni deposition and recovery for permeate flow rates of 0 to 10 mL/min and deposition rates of 0 to 25 $g/m^2/hr$. The Ni deposition rate generally increases with increased permeate flow rate and increased deposition rate. The Ni recovery generally decreases with increased permeate flow rate and decreased deposition rate. FIG. 66 presents results on Ni recovery (%) and deposition rate (g/m2/h) from a black mass, i.e., shredded end-of-life Li-ion battery or input into electrochemical deposition in FIG. 60, and extract solution as a function of permeate flow rate in the standard flow configuration, (see FIG. 23). As the permeate flow rate increases, the Ni recovery decreases, while the deposition rate increases similar to FIG. 62. Although less of the Ni is recovered, the deposition rate increases since the total mass flow Ni increases to a greater extent.

Figure 67:
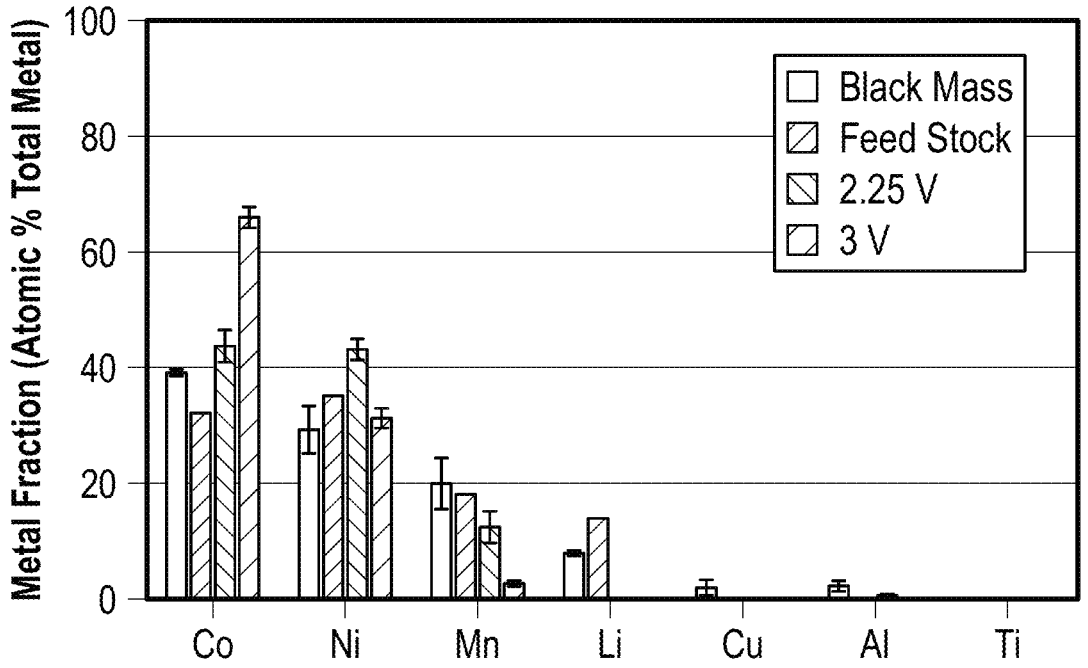
FIG. 67 is a graph showing the normalized metal atomic percentage as a fraction of the total electrodeposited metal as characterized by ICP-MS, SEM, and EDS where the feed is black mass extract.

FIG. 67 shows a graph of metal fractions at various voltages for Co, Ni, Mn, Li, Cu, Al, and Ti. Co, Ni, Mn, and Li had the high metal fractions when deposited using an electrochemical deposition apparatus. Cu, Al, and Ti had lower metal fractions at the voltages tested relative to Ni, Mn, and Li. FIG. 67 presents results on the metal composition of the precipitates from the electrochemical deposition apparatus as a function of applied voltage from a black mass, i.e., shredded end-of-life Li-ion battery or input into electrochemical deposition in FIG. 60, extract solution. As the applied cell voltage is increased from 2.25 and 3.0 V, the Ni:Mn:Co:Li:Cu:Al product ratio varied. At all voltages, Ni and Co were preferentially precipitated as compared to Mn. At 3 V, there was a 2:1 precipitation selectively of Co over Ni. The ability to tune the system for selective metal hydroxide precipitation is related to the differences of the three metals pH-pe diagrams. At both voltages, there is no Li precipitated. As all of the Li is diverted to the electrochemical deposition apparatus effluent, this could be considered a Li-brine by-product with Li levels similar to those found in naturally occurring Li-brines.

Figure 68:
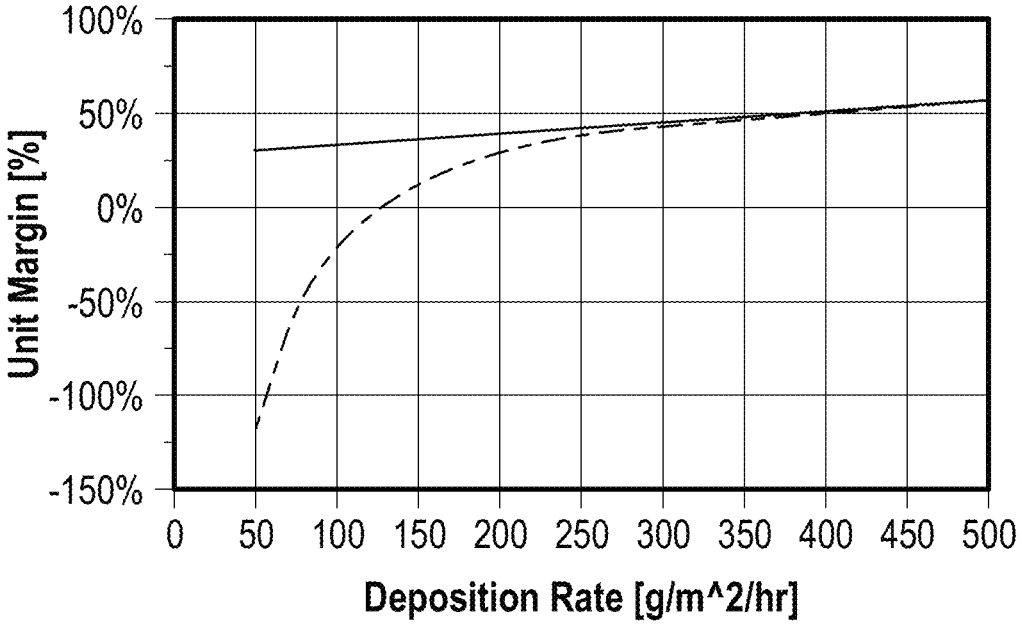
FIG. 68 is a graph showing the unit profit margin as a function of metal deposition rate at a constant porous cathodic material lifetime of 50 hours.

FIG. 68 shows a graph of unit margin vs. deposition rate. Deposition rates above 125 yielded a positive unit margin. FIG. 68 depicts the unit margin (%) as a function of porous electrode lifetime (h) based off the sensitivity analysis of an in-depth technoeconometric analysis of the flow diagram in FIG. 60 using black mass, i.e., shredded end-of-life batteries, as an input. Assumptions were the same as FIG. 68. The sensitivity analysis indicates that electrode lifetimes need to be over 50 h to achieve positive unit margins and approach the limit at >100 h. These are conservative values since we have already achieve them experimentally and that industrial electrode lifetimes are typically in the range of 2000-20000 h.

Figure 69:
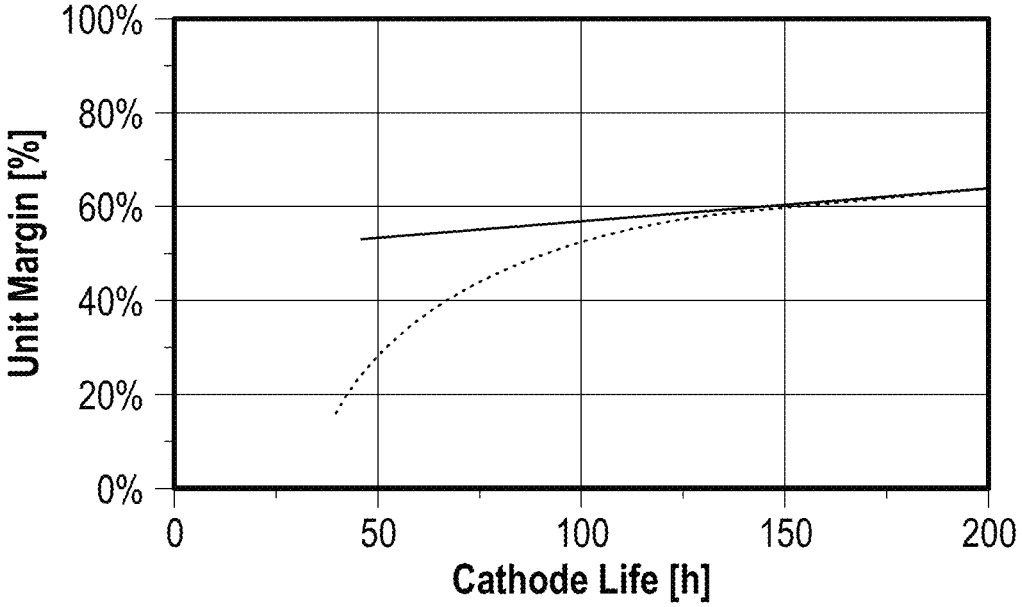
FIG. 69 is a graph showing the unit profit margin as a function of porous cathodic material lifetime at a constant metal deposition rate.

FIG. 69 shows a graph of deposition rate vs. permeate flow rate for Co deposition and recovery. The Co deposition rate generally increases with increased permeate flow rate and increased deposition rate. Co recovery generally decreases with increased permeate flow rate and decreased deposition rate.

Figure 70:
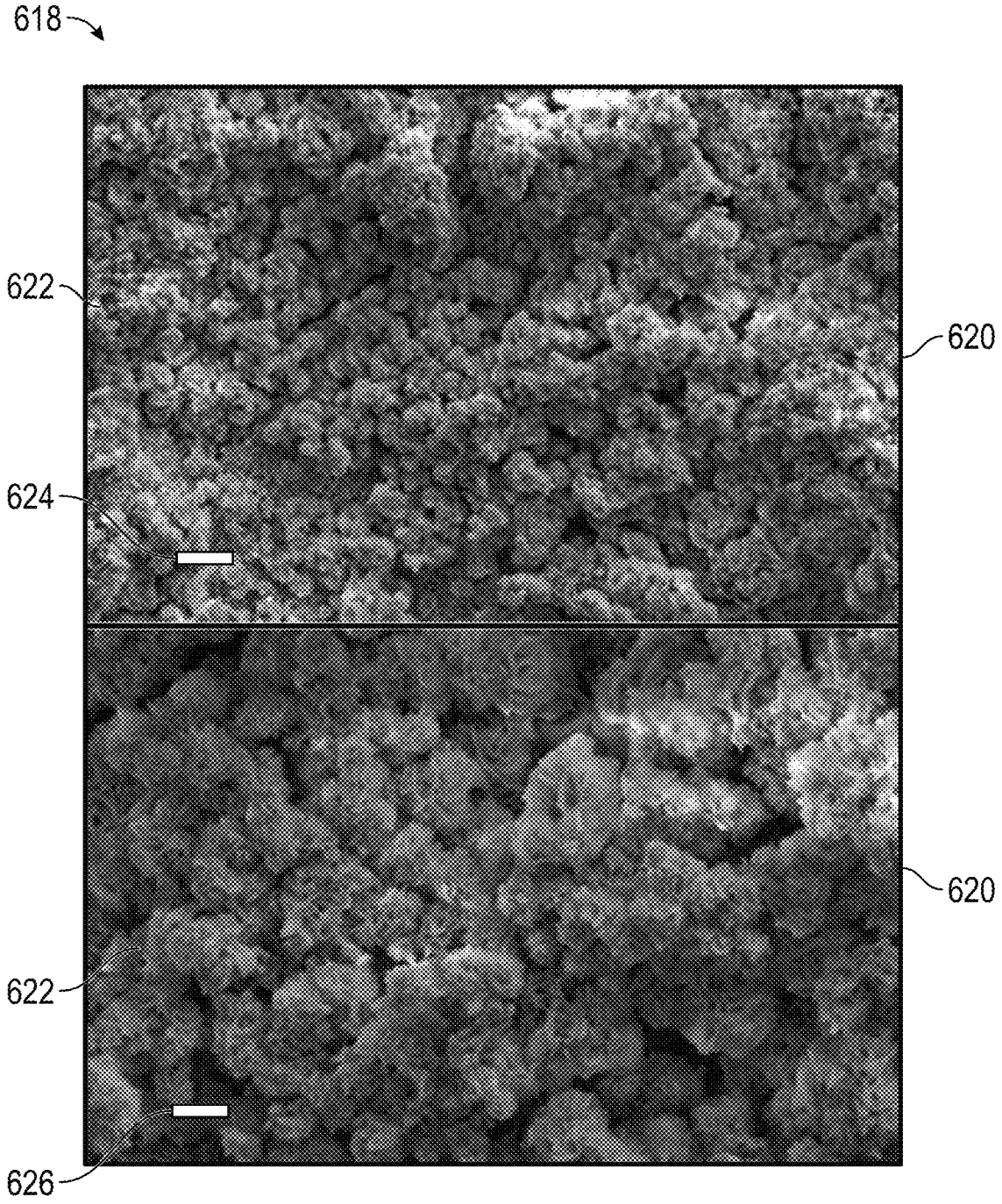
FIG. 70 is a series of SEM images showing collected and dried metal oxide precipitates on the electrochemical deposition apparatus where the feed is a synthetic battery porous cathodic material stream.

FIG. 70 is series of SEM images 618 showing collected and dried metal oxide precipitates on the electrochemical deposition apparatus where the feed is a synthetic battery porous cathodic material stream. SEM image 620 shows metal oxide precipitate 622 accompanied by 10 micron scale bar 624. SEM image 620 shows metal oxide precipitate 622 accompanied by 2 micron scale bar 626.

Figure 71:
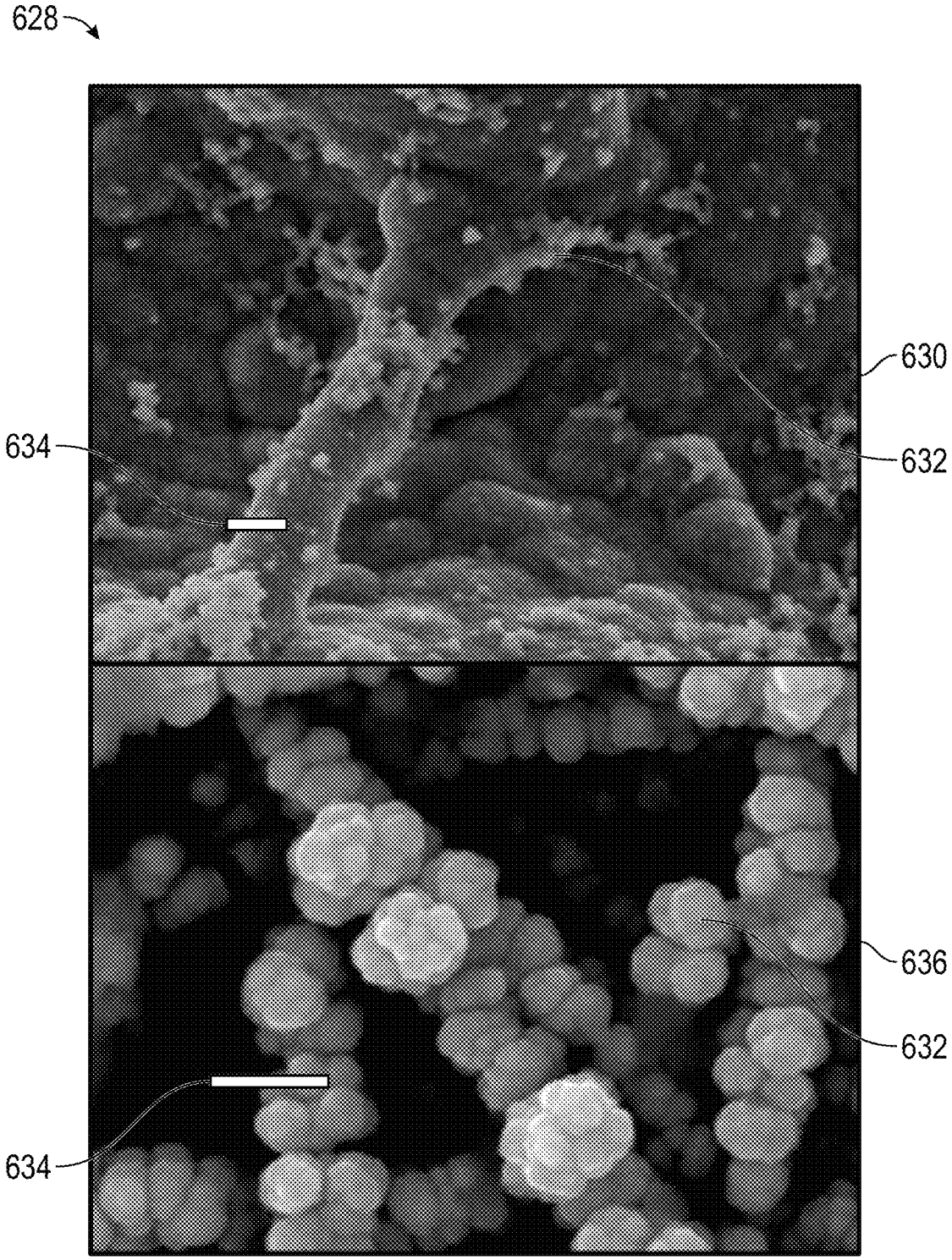
FIG. 71 is a series of SEM images showing collected and dried metal oxide precipitates on the electrochemical deposition apparatus where the feed is black mass extract.

FIG. 71 is series of SEM images 628 showing collected and dried metal oxide precipitates on the electrochemical deposition apparatus where the feed is black mass extract. SEM image 630 shows metal oxide precipitate 632 accompanied by 10 micron scale bar 634. SEM image 636 shows metal oxide precipitate 632 accompanied by 2 micron scale bar 634.

The electrochemical deposition apparatus or system may comprise a porous cathodic material or other porous material with a high surface area. The porous cathodic material allows a solution (e.g., an aqueous solution) to pass across and/or through it. The porous cathodic material may be conductive. The porous cathodic material may be positively charged or negatively charged. The porous cathodic material may be charged by a direct current ("DC") source, by an alternating current ("AC") source, or by a pulsed current. The porous cathodic material may be regenerated.

The porous cathodic material may comprise, but is not limited to, carbon nanotubes and/or carbon fibers. The carbon nanotubes may be single walled, multiwalled, or a combination thereof. The carbon nanotubes may have lengths including, but not limited to, at least about 0.05 mm, about 0.05 mm to about 2.0 mm, about 0.1 mm to about 1.8 mm, about 0.2 mm to about 1.5 mm, about 0.4 mm to about 1.4 mm, about 0.6 mm to about 1.2 mm, about 0.8 mm to about 1.0 mm, or about 2.0 mm. The porous cathodic carbon or other material such as metal mesh or felt may comprise a high surface area relative to a solid material, including, but not limited to, at least about 25 $m^2/g$, about 25 $m^2/g$ to about 1000 $m^2/g$, about 50 $m^2/g$ to about 950 $m^2/g$, about 100 $m^2/g$ to about 900 $m^2/g$, about 150 $m^2/g$ to about 850 $m^2/g$, about 200 $m^2/g$ to about 800 $m^2/g$, about 250 $m^2/g$ to about 750 $m^2/g$, about 300 $m^2/g$ to about 700 $m^2/g$, about 350 $m^2/g$ to about 650 $m^2/g$, about 400 $m^2/g$ to about 500 $m^2/g$, or about 1000 $m^2/g$. The anode may be porous or comprise a porous material. The anode may comprise, but is not limited to, a carbon cloth or felt, a Ti mesh or felt.

The electrochemical deposition apparatus and method may allow for flow-through electrochemistry. The electrochemical deposition apparatus and method may not be limited by slow diffusive mass transfer. The electrochemical deposition apparatus and method may maintain rapid deposition kinetics. The rapid deposition kinetics may comprise a deposition rate including, but not limited to, at least about 20 g $hr^{-1}$ $m^{-2}$, at least about 50 g $hr^{-1}$ $m^{-2}$, at least about 100 g $hr^{-1}$ $m^{-2}$, at least about 200 g $hr^{-1}$ $m^{-2}$, at least about 300 g $hr^{-1}$ $m^{-2}$, at least about 400 g $hr^{-1}$ $m^{-2}$, at least about 500 g $hr^{-1}$ $m^{-2}$, at least about 600 g $hr^{-1}$ $m^{-2}$, at least about 700 g $hr^{-1}$ $m^{-2}$, at least about 800 g $hr^{-1}$ $m^{-2}$, at least about 900 g $hr^{-1}$ $m^{-2}$, at least about 1000 g $hr^{-1}$ $m^{-2}$, at least about 2000 g $hr^{-1}$ $m^{-2}$, at least about 5000 g $hr^{-1}$ $m^{-2}$, at least about 10000 g $hr^{-1}$ $m^{-2}$, or at least about 20000 g $hr^{-1}$ $m^{-2}$. The rapid deposition kinetics may comprise a deposition rate including, but not limited to, about 20 g $hr^{-1}$ $m^{-2}$ to about 1000 g $hr^{-1}$ $m^{-2}$, about 50 g $hr^{-1}$ $m^{-2}$ to about 900 g $hr^{-1}$ $m^{-2}$, about 100 g $hr^{-1}$ $m^{-2}$ to about 800 g $hr^{-1}$ $m^{-2}$, about 200 g $hr^{-1}$ $m^{-2}$ to about 700 g $hr^{-1}$ $m^{-2}$, about 300 g $hr^{-1}$ $m^{-2}$ to about 600 g $hr^{-1}$ $m^{-2}$, about 400 g $hr^{-1}$ $m^{-2}$ to about 500 g $hr^{-1}$ $m^{-2}$, or about 1000 g $hr^{-1}$ $m^{-2}$. The standard flow deposition rate may be calculated according to the equation $R_{d,\ avg}$ (g $m^{-2}$ $h^{-1}$)=337.6×$Q_p$ (mL $min^{-1}$)×($C_f$−$C_r$), where $Q_p$ (mL $min^{-1}$) is the permeate flow rate and $C_f$ and $C_p$ are the molar concentrations in the feed and permeate, respectively (and $C_f$−$C_p$ is the recovery percent over 100). The maximum deposition rate may be calculated according to the equation $R_{d,\ max}$ (g $m^{-2}$ $h^{-1}$)=−117.4×$I_{ss}$(A), where $I_{ss}$ is the steady state current.

The electrochemical deposition apparatus and method may comprise an electroactive area in which a metal or metals are precipitated. The electroactive area may comprise an area including, but not limited to, at least about 25 $cm^2$, about 25 $cm^2$ to about 1000 $cm^2$, about 50 $cm^2$ to about 900 $cm^2$, about 75 $cm^2$ to about 800 $cm^2$, about 100 $cm^2$ to about 700 $cm^2$, about 200 $cm^2$ to about 600 $cm^2$, about 300 $cm^2$ to about 500 $cm^2$, or about 1000 $cm^2$. The electroactive area may also comprise an area of about 93.75 $cm^2$. The electroactive area may also comprise an area including, but not limited to, at least about 1.0 $m^2$, about 1.0 $m^2$ to about 10.0 $m^2$, about 1.5 $m^2$ to about 9.5 $m^2$, about 2.0 $m^2$ to about 9.0 $m^2$, about 2.5 $m^2$ to about 8.5 $m^2$, about 3.0 $m^2$ to about 8.0 $m^2$, about 3.5 $m^2$ to about 7.5 $m^2$, about 4.0 $m^2$ to about 7.0 $m^2$, about 4.5 $m^2$ to about 6.5 $m^2$, about 5.0 $m^2$ to about 6.0 $m^2$, or about 10.0 $m^2$.

The electrochemical deposition apparatus and method may be run in parallel to increase the electroactive area. The total electroactive area for electrochemical deposition apparatus and method may comprise an area including, but not limited to, at least about 10 $m^2$, about 10 $m^2$ to about 20 $m^2$, about 11 $m^2$ to about 19 $m^2$, about 12 $m^2$ to about 18 $m^2$, about 13 $m^2$ to about 17 $m^2$, about 14 $m^2$ to about 16 $m^2$, or about 20 $m^2$. The total electroactive area for electrochemical deposition apparatus and method may comprise an area including, but not limited to, at least about 20 $m^2$, about 20 $m^2$ to about 200 $m^2$, about 100 $m^2$ to about 190 $m^2$, about 110 $m^2$ to about 180 $m^2$, about 120 $m^2$ to about 170 $m^2$, about 130 $m^2$ to about 150 $m^2$, about 140 $m^2$ to about 150 $m^2$, or about 200 $m^2$. The number of individual electrochemical deposition apparatuses operating in parallel includes, but is not limited to, at least 2, 2 to 200, 10 to 180, 20 to 160, 30 to 140, 40 to 120, 50 to 100, 60 to 90, 70 to 80, or 200.

The electrochemical deposition apparatus and method may comprise a total surface area calculated as the specific surface area times the weight of electroactive material. For example, 50 g electroactive material with a specific surface area of 100 $m^2/g$ has a total surface area of 5000 $m^2$. The electrochemical deposition apparatus and method may also comprise a geometric surface calculated from the real density times the surface area. For example, 50 g electroactive material with a real density of 50 $m^2/g$ over as surface of 1 $m^2$ has geometric surface area of 1 $m^2$. The electroactive area of electrochemical deposition apparatus may be between the total surface area and geometric surface area.

The electrochemical deposition apparatus and method may maintain a current density. The current density may be a steady-state current density. The current density may include, but is not limited to, at least about 1 $mA/cm^2$, about 1 $mA/cm^2$ to about 50 $mA/cm^2$, about 5 $mA/cm^2$ to about 45 $mA/cm^2$, about 10 $mA/cm^2$ to about 40 $mA/cm^2$, about 15 $mA/cm^2$ to about 35 $mA/cm^2$, about 20 $mA/cm^2$ to about 30 $mA/cm^2$, or about 50 $mA/cm^2$. The current density may include, but is not limited to, at least about 50 $mA/cm^2$, about 50 $mA/cm^2$ to about 50 $A/cm^2$, about 5 $A/cm^2$ to about 45 $A/cm^2$, about 10 $A/cm^2$ to about 40 $A/cm^2$, about 15 $A/cm^2$ to about 35 $A/cm^2$, about 20 $A/cm^2$ to about 30 $A/cm^2$, or about 50 $A/cm^2$. The current density may include, but is not limited to, at least about 50 $A/m^2$, about 50 $A/m^2$ to about 7.0 $kA/m^2$, about 0.5 $kA/m^2$ to about 6.5 $kA/m^2$, about 1 $kA/m^2$ to about 6.0 $kA/m^2$, about 1.5 $kA/m^2$ to about 5.5 $kA/m^2$, about 2.0 $kA/m^2$ to about 5.0 $kA/m^2$, about 2.5 $kA/m^2$ to about 4.5 $kA/m^2$, about 3.0 $kA/m^2$ to about 4.0 $kA/m^2$, or about 7.0 $kA/m^2$. The electrochemical deposition apparatus and method may operate at a wide range of pH values. The electrochemical deposition apparatus and method may operate at a pH including, but not limited to, at least pH 0, pH 0 to about pH 10, about pH 1 to about pH 9, about pH 2 to about pH 8, about pH 3 to about pH 7, about pH 4 to about pH 6, or about pH 10.

The electrochemical deposition apparatus and method may operate at a wide range of pressure values. The electrochemical deposition apparatus and method may operate at a pressure including, but not limited to, at least about 1 atm, about 1 atm to about 50 atm, about 5 atm to about 40 atm, about 10 atm to about 30 atm, or about 50 atm. The electrochemical deposition apparatus and method may operate at a differential pressure including, but not limited to, at least about 0.1 psi, about 0.1 psi to about 60 psi, about 1 psi to about 55 psi, about 5 psi to about 50 psi, about 10 psi to about 45 psi, about 15 psi to about 40 psi, about 20 psi to about 35 psi, about 25 psi to about 30 psi, or about 60 psi.

The electrochemical deposition apparatus and method may selectively recover metals from a feed. The recovery may include, but is not limited to, at least about 30%, about 30% to about 99%, about 50% to about 97%, about 70% to about 95%, about 75% to about 90%, about 80% to about 85%, or about 99%.

The electrochemical deposition apparatus and method may produce purified metal. The purity of the metal may include, but is not limited to, at least about 20%, about 20% to about 99.9%, about 25% to about 99%, about 30% to about 97%, about 35% to about 95%, about 40% to about 90%, about 45% to about 85%, about 50% to about 80%, about 55% to about 75%, about 60% to about 70%, or about 99.9%.

The electrochemical deposition apparatus and method may operate with a fluid flow. The fluid flow may be a laminar and/or turbulent flow. The fluid flow may be present as a flow rate. The flow rate may include, but is not limited to, at least about 0.5 mL/min, about 0.5 mL/min to about 10.0 mL/min, about 1.0 mL/min to about 9.5 mL/min, about 1.5 mL/min to about 9.0 mL/min, about 2.0 mL/min to about 8.5 mL/min, about 2.5 mL/min to about 8.0 mL/min, about 3.0 mL/min to about 7.5 mL/min, about 3.5 mL/min to about 7.0 mL/min, about 4.0 mL/min to about 6.5 mL/min, about 4.5 mL/min to about 6.0 mL/min, or about 10.0 mL/min. The flow rate may also include, but is not limited to, at least about 10 mL/min, about 10 mL/min to about 100 mL/min, about 20 mL/min to about 90 mL/min, about 30 mL/min to about 80 mL/min, about 40 mL/min to about 70 mL/min, about 50 mL/min to about 60 mL/min, or about 100 mL/min. The flow rate may also be at least about 100 mL/min, about 100 mL/min to about 1000 mL/min, about 200 mL/min to about 900 mL/min, about 300 mL/min to about 800 mL/min, about 400 mL/min to about 700 mL/min, about 500 mL/min to about 600 mL/min, or about 1000 mL/min. The flow rate may also include, but is not limited to, at least about 1 L/min, about 1 L/min to about 10 L/min, about 2 L/min to about 9 L/min, about 3 L/min to about 8 L/min, about 4 L/min to about 6 L/min, or about 10 L/min. The flow rate may also include, but is not limited to, at least about 10 L/min, about 10 L/min to about 100 L/min, about 20 L/min to about 90 L/min, about 30 L/min to about 80 L/min, about 40 L/min to about 60 L/min, or about 100 L/min.

The electrochemical deposition apparatus may comprise a crossflow membrane system and/or a dead-end flow system. The electrochemical deposition apparatus may comprise a modular membrane-like configuration, e.g., a plate- and frame membrane configuration, a spiral-wound configuration, a tubular configuration, or a hollow-fiber configuration. There may be a plurality of electrochemical deposition apparatuses. The plurality of electrochemical deposition apparatuses may operate in parallel. Operating the plurality of electrochemical deposition apparatuses in parallel may deposit more metal on the porous cathodic material compared to operating a single electrochemical deposition apparatus. The plurality of electrochemical deposition apparatuses may operate in series. Operating the plurality of electrochemical deposition apparatuses in series may deposit one type of metal onto each of the porous cathodic materials in series, allowing for more types of metal to be deposited simultaneously compared to operating a single electrochemical deposition apparatus. Operating the plurality of electrochemical deposition apparatuses in series may facilitate sequential redox processes.

A feed flows through the electrochemical deposition apparatus. The feed may be synthetic or be derived from an industrial or commercial process. The feed may comprise a metal or a plurality of metals. The feed may comprise, but is not limited to, a metal feed, black mass, metal particulates, metal compounds, metal ions, or a combination thereof. The metal or plurality of metals may comprise a concentration including, but not limited to, at least about 1 mM, about 1 mM to about 30 mM, about 5 mM to about 25 mM, about 10 mM to about 20 mM, about 30 to 50 mM, about 40 mM to 100 mM, about 60 mM to 400 mM, about 200 mM to 1000 mM, or about 500 mM to 5000 mM. The feed may also comprise electrolytes. The electrolytes may comprise a concentration including, but not limited to, at least about 1 mM, about 1 mM to about 30 mM, about 5 mM to about 25 mM, about 10 mM to about 20 mM, about 30 to 50 mM, about 40 mM to 100 mM, about 60 mM to 400 mM, about 200 mM to 1000 mM, or about 500 mM to 5000 mM. The feed may comprise numerous types of materials, including but not limited to a synthetic magnet, a recycled magnet, black mass, electrical waste, battery waste, recycled batteries, recycled metal scrap, mineral ore, mineral tailings, or combination thereof. The mineral ore may also comprise, but not be limited to, RE, Ti and/or Fe. The mineral ore may be ilmenite ore. The battery waste may comprise Li ion battery waste. The battery waste may also comprise battery cathode waste. The battery cathode waste may comprise, but not be limited to, Ni, Mn, and Co. Feed components may be pre-processed. Pre-processing may comprise any number of processes, including but not limited to, demagnetization, ball milling, filtration, acid leaching, or a combination thereof.

The apparatus and method may utilize an acid. The acid may comprise any number of acids, including but not limited to phosphoric acid, nitric acid, sulfuric acid, hydrochloric acid, hydrofluoric acid, hydrobromic acid, hydroiodic acid, perchloric acid, hydrogen peroxide, carbonic acid, acetic acid, hydrogen cyanide, formic acid, oxalic acid, sulfurous acid, nitrous acid, or a combination thereof.

The apparatus and method may comprise an oxidant. The oxidant may comprise any number of oxidants including, but not limited to, chlorine, bromine, oxygen, carbon dioxide, ozone, iodine, or a combination thereof.

The apparatus and method may comprise a solvent extractant. The solvent extractant may comprise chemicals including, but not limited to, Alamine 336 (tri/octyl-decyl amine), meta-xylene, Cyanex 272 (bis-(2,4,4-trimethdypentyl) phosphinic acid), hydroxyoximes, di(2-ethyl-hexyl) phosphoric acid, hexane, tributyl phosphate, a hydrocarbon diluent, dialkyl sulfides, alkyl amines, sodium hydroxide, TPEN (N,N,N',N',-tetrakis(2-pyridylmethyl)ethylenediamine, D2EHPA, or a combination thereof.

Pre-processing feed components may comprise, but are not limited to, filtering, crushing, grinding, mixing, homogenizing, leaching, pH adjusting, precipitation or combination thereof. The feed may comprise, but is not limited to, coal fly ash. The coal fly ash may be pre-processed. The coal fly ash may be pre-processed by re-heating it in a gas (e.g., an inert gas) to generate a metal-enriched carbon vapor and impinge the metal-enriched carbon vapor on glass-fiber filters and collected. The metal-enriched carbon vapor may be collected and leached (e.g., acid leached).

The apparatus and method may comprise a buffer. The buffer may be used to maintain a solution at a pH above/below what would be achieved by the electrochemical process. Maintaining pH may be useful for separation and/or deposition of metals. For example, at pH 2.5, both $Al^{3+}$ and $Cu^{2+}$ are completely dissolved. $Al^{3+}$ completely precipitates out at a pH ~4.2 and $Cu^{2+}$ only begins to precipitate at pH ~4.2. To complete a sharp separation of the two during cathodic production of hydroxide at the porous cathodic material, a buffer may be used to limit the pH increase to 4.2 to allow for Al precipitation and to allow Cu to remain in solution.

The apparatus and method may comprise a reagent to manipulate the precipitation of metals. For example, Co, Ni, and Mn as sulfates ($M^{2+}$ $SO_4^{2-}$) are substantially soluble in water (>100 g/L), but as carbonates ($M^{2+}$ $CO_3^{2-}$) Co, Ni, and Mn are substantially insoluble in water. Co, Ni, and Mn as hydroxides or oxides have a range of solubility dependent upon oxidation state. Thus, if Co, Ni, and Mn sulfates are added to water, they may dissolve completely even at >1 M concentrations. The precipitated material composition may then be manipulated by using a specific reagent. Carbon dioxide and/or bicarbonate may be used as a reagent that reacts with the cathodically produced hydroxide to form carbonate. Carbonate may then react with the Co—Ni—Mn sulfate solution and may cause all the metals to become insoluble and precipitate out together by forming a Co—Ni—Mn mixed precipitate.

Water may be used as the cathodic reagent and chloride as the anodic reagent. For selective precipitation, a reactive chloride species produced at the anode may specifically react with e.g., Mn first to increase oxidation state from 2+ to 4+. The $Mn^{4+}$ may then react with a cathodic hydroxide to selectively precipitate $MnO_2$, thereby separating $MnO_2$ from the dissolved Co and Ni. The reactive chloride species may also selectively oxidize the Co from 2+ to 3+, resulting in selective precipitation of $Co(OH)_3$ that may be separated from the dissolved Ni.

The buffer and/or reagent may be used at a pH including, but not limited to, at least 0, about pH 0 to about pH 13, about pH 1 to about pH 12, about pH 2 to about pH 11, about pH 4 to about pH 10, about pH 5 to about pH 9, about pH 6 to about pH 8, or about pH 13. The buffer and/or reagent may be at a concentration including, but not limited to, at least about 0.01 M, about 0.01 M to about 2 M, about 0.02 M to about 1.8 M, about 0.05 M to about 1.5 M, about 0.1 M to about 1.2 M, about 0.2 M to about 1.0 M, or about 2 M.

The apparatus and method of the present invention may comprise the selection of a cathodic and/or anodic reagent to selectively precipitate an individual metal from a mixture, or alternatively simultaneously precipitate all metals from a mixture. The list of ions and/or reagents may comprise, but is not limited to, potassium tetroxalate dihydrate ($KH_3C_4O_8.2H_2O$); potassium hydrogen tartrate ($KHC_4H_4O_6$); potassium dihydrogen citrate ($KH_2C_6H_5O_7$); citric acid; citric acid monohydrate; citric acid trisodium salt; sodium citrate tribasic dihydrate; potassium hydrogen phthalate ($KHC_8H_4O_4$); trisodium phosphate $Na_3PO_4$; disodium hydrogen phosphate ($Na_2HPO_4$); sodium phosphate dibasic dehydrate; sodium phosphate dibasic tetrahydrate; dipotassium hydrogen phosphate ($K_2HPO_4$); potassium dihydrogen phosphate ($KH_2PO_4$); sodium dihydrogen phosphate ($KH_2PO_4$); sodium pyrophosphate dibasic; sodium pyrophosphate tetrabasic decahydrate; disodium tetraborate decahydrate ($Na_2B_4O_7 \cdot 10H_2O$); sodium tetraborate decahydrate; carbon dioxide; sodium hydrogen carbonate or sodium bicarbonate ($NaHCO_3$); sodium carbonate ($Na_2CO_3$); calcium hydroxide $Ca(OH)_2$; sodium hydrogen diglycolate; phosphoric acid; acetic acid; sodium acetate; sodium acetate trihydrate; piperazine phosphate; tris hydrochloride; tris; potassium hydrochloride (KCl); hydrochloric acid (HCl); sodium hydroxide (NaOH); tris(hydroxymethyl) aminomethane; borax; ammonium acetate; trifluoroacetic acid; ammonium trifluoroacetate; MES 2-(N-Morpholino) ethanesulfonic acid; MES hemisodium salt; MES hydrate; MES monohydrate; MES potassium salt; MES sodium salt; BIS TRIS Bis(2-hydroxyethyl)iminotris(hydroxymethyl) methane; BIS TRIS HCl; ADA N-(2-Acetamido)-2-iminodiacetic acid; ADA disodium salt; ACES 2-[(2-Amino-2-oxoethyl)amino]ethanesulfonic acid; PIPES Piperazine-N, N"-bis(2-ethanesulfonic acid); PIPES dipotassium salt; PIPES disodium salt; PIPES sesquisodium salt; PIPES sodium salt; MOPSO 3-(N-Morpholino)-2-hydroxypropanesulfonic acid; MOPSO sodium salt; BIS TRISPROPANE 1,3-Bis[tris(hydroxymethyl)methylamino]propane; BES N,N-Bis(2-hydroxyethyl)-2-aminoethanesulfonic acid; BES sodium salt; MOPS 3-(N-Morpholino)propanesulfonic acid; MOPS hemisodium salt; MOPS sodium salt; TES N-Tris(hydroxymethyl)methyl-2-aminoethanesulfonic acid; TES hemisodium salt; TES sodium salt; HEPES N-(2-Hydroxyethyl)piperazine-N"-(2-ethanesulfonic acid); HEPES hemisodium salt; HEPES potassium salt; HEPES sodium salt; DIPSO 3-[N,N-Bis(2-hydroxyethyl)amino]-2-hydroxypropanesulfonic acid; MOBS 4-(N-Morpholino)butanesulfonic acid; TAPSO 3-[N-Tris(hydroxymethyl)methylamino]-2-hydroxypropanesulfonic acid; TRIZMA Tris (hydroxymethyl)methylamine; HEPPSO N-(2-hydroxyethyl)piperazine-N"-(2-hydroxypropanesulfonic acid); POPSO Piperazine-N,N"-bis(2-hydroxypropanesulfonic acid); POPSO hydrate; TEA Tris(2-hydroxyethyl)amine; EPPS 4-(2-Hydroxyethyl)-1-piperazinepropanesulfonic acid; TRICINE N-Tris(hydroxymethyl)methylglycine; Gly-Gly N-Glycylglycine; BICINE N,N-Bis(2-hydroxyethyl) glycine; HEPBS N-(2-Hydroxyethyl)piperazine-N'-(4-butanesulfonic acid); TAPS N-Tris(hydroxymethyl)methyl-3-aminopropanesulfonic acid; TAPS sodium salt; AMPD 2-Amino-2-methyl-1,3-propanediol; TABS N-Tris(Hydroxymethyl)methyl-4-aminobutanesulfonic acid; AMPSO 3-[(1,1-Dimethyl-2-hydroxyethyl)amino]-2-hydroxypropanesulfonic acid; CHES 2-(N-Cyclohexylamino)ethanesulfonic acid; CAPSO 3-(Cyclohexylamino)-2-hydroxy-1-propanesulfonic acid; CAPSO sodium salt; AMP 2-Amino-2-methyl-1-propanol; CAPS 3-(Cyclohexylamino)-1-propanesulfonic acid; CABS 4-(Cyclohexylamino)-1-butanesulfonic acid; AMPSO; AMPSO sodium salt; TRIZMA acetate; TRIZMA base; TRIZMA HCl; TRIZMA maleate; TRIZMA phosphate monobasic; bicine; cacodylic acid; sodium cacodylate trihydrate; sodium bitartrate monohydrate; sodium tartrate dibasic dihydrate; calcium acetate hydrate; calcium carbonate; lime; calcium phosphate dibasic; ethanol amine hydrochloride; imidazole; glycolic acid; imidazole HCl; glyoxaline; periodic acid; potassium acetate; potassium bicarbonate; potassium carbonate; potassium citrate tribasic monohydrate; potassium hydrogen phthalate; potassium phosphate dibasic; potassium phosphate dibasic trihydrate; potassium phosphate monobasic; potassium phosphate tribasic; histidine; lactic acid; sodium lactate; potassium lactate; gluconic acid; sodium gluconate; potassium gluconate; calcium gluconate; aspartic acid; sodium aspartate; potassium aspartate; calcium aspartate; glutamic acid; sodium glutamate; potassium glutamate; calcium glutamate; succinic acid; sodium succinate; potassium succinate; calcium succinate; maleic acid; sodium maleate; potassium maleate; calcium maleate; fumaric acid; sodium fumarate; potassium fumarate; calcium fumarate; ketoglutaric acid; glutarate; oxalic acid; oxalate; malonic acid; malonate; EDTA formic acid; formate; carboxylic acids and their derivatives; propionic acid; propionate; butric acid; butrate; benzoic acid, benzoate, and their derivates; toluic acid; toluate; nitrobenzoic acid; nitrobenzoate; chlorobenzoic acid; chlorobenzoate; phenol, phenolate, and their derivatives; nitrophenols; nitrophenolates; halophenols; halophenolates; alkylphenols; alkylphenolates; ammonia; ammonium; alkylamines and their derivatives; amino alcohols and their derivatives; phosphates and their derivatives; hydrogen fluoride and fluoride salts; hydroiodide and iodide salts; selenic acid and selenite salts; iodic acid; iodate salts; hydrogen bromate; bromate salts; hydrogen sulfide; hydrosulfide salts; sulfide salts; sulfur dioxide; sulfurous acid; sulfite salts; selenium dioxide; selenous acid; selenite salts; selenic acid; hydrogen selenate salts; selenate salts; silicon dioxide; silicic acid; silicate salts; hydrogen chromate; chromate salts; hydrogen molybdate; molybdate salts; arsenic acid; arsenate salts perchloric acid; perchlorate salts; hydrogen cyanide; cyanide salts; hydrogen thiocyanate; thiocyanate salts; or a combination thereof.

The feed may comprise, but is not limited to, a solution, an aqueous solution, a non-aqueous solution, an organic solvent, ionic liquid, eutectic solvent, a gas, a homogenous mixture, a heterogenous mixture, a slurry, a non-Newtonian fluid, vapor, or a combination thereof. The solution may comprise a metal stream. The feed flows by and/or through the porous cathodic material of the electrochemical deposition apparatus. A plurality of feeds may flow through the electrochemical deposition apparatus.

The electrochemical deposition apparatus and method may comprise a catalyst. Catalyst choice may depend on the target porous cathodic material and anode reactions. For example, a hydrogen evolution reaction ("HER") catalyst may be used for a reaction at the porous cathodic material to reduce water and produce hydroxide (increase pH). The specific HER catalyst may depend on cost, performance, and other parameters. The porous cathodic material may be used for other processes than water reduction including, but not limited to, direct metal reductive precipitative; oxidant production including, but not limited to, reduction of oxygen to hydrogen peroxide; reductant production including, but not limited to, reduction of carbon dioxide to the carbon dioxide radical; and/or to reduce the overall cell potential required by using oxygen as a sacrificial electron acceptor rather than water. The anode may be used for other processes including, but not limited to, direct metal oxidative precipitation; oxidant production such as oxidation of chloride to the dichloride radical; and/or to reduce the overall cell potential required by using a sacrificial electron donor. A selective catalyst selective may have a significant effect on the electroextraction process and catalyst selection may enable control over the desired metal precipitation process.

The HER catalyst for the porous cathodic material may include, but is not limited to, metals, including but not limited to Pt, Pt/C, TI, In, Cd, Pb, Ga, Zn, Sn, Bi, Ag, Cu, Fe, Co, Ni, Au, Rh, Ir, Re, W, Mo, Nb, Ti, Ta, Al, Pd, Hg, V, Hf, or a combination thereof; alloys, including but not limited to Ni—Ti, Mo—Ni, Mo—Co, Mo—Pt, Ni—Zr, Mo—S, Ni—Co, Ni—Fe, Ni—Mo—Cd, Ni—Mo—Fe, LasNi alloys, or a combination thereof; carbon based materials, including, but not limited to graphene, doped(B,N,S,P)-graphene, CNT, doped(B,N,D.P)-CNT, black carbon, activated carbon, or a combination thereof; metal oxides, including, but not limited to, $IrO_2$—$RuO_2$, $Sr_xNbO_3$-δ or a combination thereof; 2D nanomaterials including, but not limited to, $MoS_2$, $FeS_2$, FeNiS, $TaS_2$, $NbS_2$, $Mo_2C$, $MoSe_2$, $CoMoS_2$, $WS_2$ doped(Fe,Co,Ni,Cu,Pt)—$MoS_2$, doped-$MoS_3$, or a combination thereof; molecular/porphyrins/corroles including, but not limited to, Co-porphyrins, Rh-porphyrins, Fe-porphyrins, Ni-porphyrins, Cu-corroles, bisorganometallic diporphyrins, Ni-diphosphines, or a combination thereof; hydrogenase and hydrogenase mimics; phosphides, including, but not limited to CoP, $MoP_2$, or a combination thereof; carbides, including, but not limited to, WC; sulfides, including, but not limited to, $MoS_2$, $NiS_2$, ZnS, CdS, or a combination thereof; polyoxometalates, including, but not limited to, R—$SiW_{12}O_4O^{4-}$, $H_3PMo_{12}O_{40}$, or a combination thereof; or a combination thereof.

An oxygen evolution catalyst (OEC) may be used at the anode and may include, but is not limited to, metal oxides, including, but not limited to, $TiO_2$, ZnO, $WO_3$, Ir $O_2$, $MnO_2$, $Mn_2O_3$, CoO, $Co_2O_3$, $CoO_2$, $Co_3O_4$, $Fe_2O_3$, CuO, NiO, $Ni_2O_3$, CoOOH, $RuO_2$, PtO, FeOOH, $PbO_2$, $PtO_2$, $Fe_3O_4$, $NiO_x$, $SnO_2$, $Ta_2O_5$, $ZrO_2$, $WO_3$, or a combination thereof; metal chalcogenides, including, but not limited to, $CoSe_2$, NiSe, $Co_3S_4$, $MoS_2$, $TaS_2$, or a combination thereof; bi-metal oxides, including, but not limited to, $SrTiO_2$, $BiVO_4$, $InSnO_2$, $Co_3V_2O_8$, $ZnCo_2O_4$, $CaMn_4O_5$, $CaMn_3O_4$, $CoNiO_x$, $NiCuO_x$, $CoMoO_x$, $FeMoO_x$, $CuCoO_x$, $IrO_2$—$Ta_2O_3$, $NiCo_2O_4$, or combination thereof; bi-metal chalcogenides, including, but not limited to, NiFeS, $NiCo_2Se_4$, or a combination thereof; multi-metal oxides, including, but not limited to, $NiFeAlO_4$, $BiCu_2VO_6$, CoNiFe-hydroxide, $CoCrFeO_x$, or a combination thereof; doped-metal oxides, including, but not limited to, N—$TiO_2$, Ni—$IrO_2$, Ni—$RuO_2$, or a combination thereof; perskovites, including, but not limited to, La:$NaTaO_3$, $LaSrCrO_3$, $Ba_{0.5}Sr_{0.5}Co_{0.8}Fe_{0.2}O_3^{-\delta}$, $LaNiO_3$, $SrCoO_3$, $Ba_2NdIrO_6$, $SrIrO_2$, $LaNiO_3$, $LaMnO_3$, $LaCuO_3$, $LaCrO_3$, $LaCoO_3$, $SrFeO_3$, $NiLa_2O_4$, or a combination thereof; polyoxometallates; layered double hydroxides, including, but not limited to, $Ni(OH)_2$—CNT, Ni—Ti, Ni—Fe, Co—Fe, Co—Mn, Ni—V, Fe—Ni—Co, or a combination thereof; 2D Nanomaterials, including, but not limited to, $CoO_x$, $NiO_x$, $FeO_x$, NiyCo1-yOx, $NiFeO_x$, $MoS_2$, or a combination thereof; metal-organic framework (MOF), including, but not limited to, NiFe, NiCo, or a combination thereof; nitrides, including, but not limited to, $Ni_3N$, $C_3N_4$, or a combination thereof; carbides, including, but not limited to, $Ti_3C_2$; carbonate hydroxides; borates; phosphides; graphenes, including, but not limited to, N-doped or S-doped graphenes, or a combination thereof; molecular/porphyrins/corroles, including, but not limited to, Mn-corroles, Co-porphyrins, Ni-porphyrins, Mn-porphyrins, Ru-polypyrridines, Ru-ammines, Ir-complexes, or a combination thereof; or a combination thereof.

The catalyst may also be used for oxygen reduction reaction, with the production of 2-electrons being preferred through the reaction $O_2+2e^-+2H^+4H_2O_2$. The catalyst used to achieve the preferred oxygen reduction may include, but is not limited to, metals, including, but not limited to, Pt; carbon-based materials, including, but not limited to, graphene, doped(B,N,S,P)-graphene, CNT, doped(B,N,D.P)-CNT, black carbon, activated carbon; or a combination thereof; porphyrin/corroles, including, but not limited to, cytochrome C (4 e−), cytochrome C oxidase, Fe-porphyrins, Co-porphyrins, Mn-porphyrins, Cr-porphyrins, Cu-porphyrins; or a combination thereof; or a combination thereof.

The catalyst may comprise a general oxidation catalyst. The general oxidation catalyst may include, but is not limited to, metal oxide, including, but not limited to, $RuO_2$, $IrO_2$, $SnO_2$, $PbO_2$, or a combination thereof; mixed metal oxide, including, but not limited to, Sb—Sn—$RuO_2$, $Ru_{0.3}Ti_{0.7}O_2$, $Ru_{0.3}Sn_{0.7}O_2$, $IrO_2/SnO_2$, $SnO_2$—$Sb_2O_5$, $Bi_2O_5$—$PbO_2$, Ti—Ru—$SnO_x$, or a combination thereof; doped-metal oxide, including, but not limited to, (B, Bi, F, Cl, P, Sb)-doped $SnO_2$, (Fe, Co, Bi, F, etc.)-doped $PbO_2$, or a combination thereof; metals, including, but not limited to, Pt; carbon, including, but not limited to, boron-doped diamond, graphite, carbon pellet, carbon felt, carbon black slurry, carbon fiber, glassy carbon, graphite particles, or a combination thereof; or a combination thereof.

The catalyst may comprise a general reduction catalyst. The general reduction catalyst may include, but is not limited to, polyoxometalates including, but not limited to, $\alpha$-$PMo_{12}O_{40}^{3-}$, $P_2W_{18}O_{62}^{6-}$, $P_2W_{17}O_{61}Fe(III)(H_2O)^{8-}$ $SiW_{11}O_{39}Fe(II)(H_2O)^{6-}$, $PW_{11}O_{39}Ru(III)(H_2O)^{4-}$, $K_{17}[Ln(As_2W_{17}O_{61})_2]$â$_xH_2O$, $Nd(SiMo_7W_4O_{39})_2^{13-}$, a-$SiMo_{12}O_{40}^{4-}$, or a combination thereof; carbon-based material (coated and uncoated), including, but not limited to, CNT, carbon felts, carbon foams, carbon meshes, carbon nanofibers, or a combination thereof; metal-based material (coated and uncoated), including, but not limited to, foams, felts, meshes from Ni, Cu, Al, or Ti, or a combination thereof; or a combination thereof.

A voltage may be applied to the porous cathodic material. Feed may be flowed through the porous cathodic material of the electrochemical deposition apparatus while a voltage is applied to the porous cathodic material. The voltage may include, but is not limited to, at least about 0.25 V, about 0.25 V to about 5.0 V, about 0.5 V to about 4.75 V, about 0.75 V to about 4.5 V, about 1.0 V to about 4.25 V, about 1.25 V to about 4.0 V, about 1.5 V to about 3.75 V, about 1.75 V to about 3.5 V, about 2.0 V to about 3.25 V, about 2.25 V to about 3.0 V, or about 5.0 V.

Metals may be electroprecipitated, i.e. deposited, onto the surface of the cathodic material. Deposited metals may comprise, but are not limited to, neodymium ("Nd"), praseodymium ("Pr"), dysprosium ("Dy), copper ("Cu"), lithium ("Li"), sodium ("Na"), magnesium ("Mg"), potassium ("K"), calcium ("Ca"), titanium ("Ti"), vanadium ("V"), chromium ("Cr"), manganese ("Mn"), iron ("Fe"), cobalt ("Co"), nickel ("Ni"), cadmium ("Cd"), zinc ("Zn"), aluminum ("Al"), silicon ("Si"), silver ("Ag"), tin ("Sn"), platinum ("Pt"), gold ("Au"), bismuth ("Bi"), lanthanum ("La"), europium ("Eu"), gallium ("Ga"), scandium ("Sc"), strontium ("Sr"), yttrium ("Y"), zirconium ("Zr"), niobium ("Nb"), molybdenum ("Mo"), ruthenium ("Ru"), rhodium ("Rh"), palladium ("Pd"), indium ("In"), hafnium ("Hf"), tantalum ("Ta"), tungsten ("W"), rhenium ("Re"), osmium ("Os"), iridium ("Ir"), mercury ("Hg"), lead ("Pb"), polonium ("Po"), cerium ("Ce"), samarium ("Sm"), erbium ("Er"), ytterbium ("Yb"), thorium ("Th"), uranium ("U"), plutonium ("Pu"), terbium ("Tb"), promethium ("Pm"), tellurium ("Te"), or a combination thereof. Deposited metals may be of the chemical formula $M^{n+}(OH)_n$ or $(M^{n+})_m O_{(n\times m)/2}$. Deposited metals may also be metal carbonates. Metals may be deposited in their non-ionic form. Deposited non-ionic metals may be of the form M°. Metals may be deposited according to a particular stoichiometry. For example, where a first metal is M1, a second metal is M2, and a third metal is M3, the metals may be deposited in a stoichiometric ratio M1:M2:M3. The metals may be deposited in any stoichiometric ratio including, but not limited to, a 1:1:1, 1:2:1, 1:1:2, or 2:1:1 stoichiometric ratio. The metals deposited in a stoichiometric ratio may be extracted from e.g., a Co-bearing material. A metal deposited in a stoichiometric ratio may be deposited as a metal hydroxide. The metals deposited in a stoichiometric ratio may be used as a cathode material. For example, Ni—Mn—Co hydroxides deposited in a stoichiometric ratio may be used to produce cathodes for Li ion batteries.

The electrochemical deposition apparatus and method may change the oxidation state of one or more metals. Alkali metals, including, but not limited to, H, Li, Na, K, Rb, Cs, or a combination thereof, may only be found in aqueous solution as the +1 oxidation. Native metal in the 0 oxidation state is the only other common form and this oxidation state reacts vigorously with water to produce hydrogen and an oxidized metal. Alkali metal ions may have high water solubilities and tend not to precipitate during electroextraction.

Alkali metals, including, but not limited to, Be, Mg, Ca, Sr, Ba, or a combination thereof, may be only found in aqueous solution as the +2 oxidation. The native metal in the 0 oxidation state is the only other common form and reacts vigorously with water to produce hydrogen and the oxidized metal. These metals ions have high water solubilities and tend not to precipitate during electroextraction.

TABLE 1

Transition Metal Common Oxidation States

| | | | | | | | | | | | | |
|---|---|---|---|---|---|---|---|---|---|---|---|---|
| | | | | | | | | | | Al | Si | |
| | | | | | | | | | | 0, +3 | −4, 0, +4 | |
| Sc | Ti | V | Cr | Mn | Fe | Co | Ni | Cu | Zn | Ga | Ge | As |
| 0, +3 | 0, +2, +3, +4 | 0, +2, +3, +4, +5 | 0, +2, +3, +6 | 0, +2, +3, +4, +6, +7 | 0, +2, +3 | 0, +2, +3 | 0, +2 | 0, +1, +2 | 0, +2 | 0, +3 | −4, 0, +2, +4 | −3, 0, +3, +5 |
| Y | Zr | Nb | Mo | Tc | Ru | Rh | Pd | Ag | Cd | In | Sn | Sb |
| 0, +3 | 0, +4 | 0, +5 | 0, +4, +6 | 0, +3, +7 | 0, +3, +4 | 0, +3 | 0, +2, +4 | 0, +1 | 0, +2 | 0, +3 | 0, +2, +4 | 0, +3, +5 |
| | Hf | Ta | W | Re | Os | Ir | Pt | Au | Hg | Tl | Pb | Bi |
| | 0, +4 | 0, +5 | 0, +4, +6 | 0, +4 | 0, +4 | 0, +3, +4 | 0, +2, +4 | 0, +1, +3 | 0, +1, +2 | 0, +1, +3 | 0, +2, +4 | 0, +3 |

Metal hydroxides with higher transition metal oxidation states may have more thermodynamically favorable metal cation-hydroxide anion bonds and may have a greater tendency to precipitate as a metal hydroxide. For example, metal ions with oxidation states of ≥+4 tend to precipitate at pH <2 (or [HO—]<$10^{-12}$ M). Metal ions with an oxidation state of +3 tend to precipitate in the pH range of 1-6 (or $10^{-13}$<[HO—]<$10^{-8}$). Metals ions with an oxidation state of +2 precipitate in the pH range of 6-10 (or $10^{-8}$<[HO—]<$10^{-4}$). Metal ions with an oxidation state of +1 precipitate at pH >10 (or $10^{-4}$<[HO—]). Native metals will spontaneously precipitate in water.

Oxidizing one metal to a higher oxidation state such that it would precipitate out at a lower pH may allow for selective precipitation of a single metal ion. For example, four primary metals in black mass may be nickel, manganese, cobalt, and lithium. The standard reduction (reverse for oxidation) potentials for $Ni^{2+}$, $Mn^{2+}$, and $Co^{2+}$ are listed in Table 2, and there is no potential listed for $Li^{+}$ as it cannot be further oxidized. Mn has a lower oxidation potential than either Co or Ni, and there may be a number of electroextraction strategies that may be used to selectively oxidize $Mn^{2+}$ and precipitate Mn as manganese dioxide ($MnO_2$).

TABLE 2

Standard Reduction Potentials of Black Mass Metals and Chloride

| Reaction Stoichiometry | Standard Reduction Potential* |
|---|---|
| $MnO_2 + 4H^+ + 2e^- \rightarrow Mn^{2+} + 2H_2O$ | 1.224 V |
| $HClO + H^+ + 2e^- \rightarrow Cl^- + H_2O$ | 1.482 V |
| $MnO_4^- + 8H^+ + 5e^- \rightarrow Mn^{2+} + 4H_2O$ | 1.507 V |
| $Co^{3+} + e^- \rightarrow Co^{2+}$ | 1.92 V |
| $Ni^{3+} + e^- \rightarrow Ni^{2+}$ | >>2.0 V |
| $Fe^{3+} + e^- \rightarrow Fe^{2+}$ | 0.77 V |
| $Cu^{2+} + 2e^- \rightarrow Cu^0$ | 0.34 V |

*Standard T and P, pH 0, and 1M concentration. From CRC Handbook-Electrochemical Series.

A low-pH mixed Ni/Mn/Co feed may first pass through a porous cathodic material where water reduction may produce hydroxide to increase the pH. The solution may then pass through the anode at a sufficient anode potential to oxidized $Mn^{2+}$, but not $Co^{2+}$. The oxidized $Mn^{4+}$ may then precipitate as $MnO_2$, which is collected by filtration. An exemplary embodiment of this process is shown in FIG. 24.

A moderate-pH mixed Ni/Mn/Co feed may first pass through an anode at a sufficient anode potential to oxidize $Mn^{2+}$, but not $Co^{2+}$. The oxidized Mn then precipitates as $MnO_2$, which is either filtered by the porous anode or a separate filter placed between the anode and porous cathodic material. The remaining Ni/Co solution may then pass through the porous cathodic material where water reduction produces hydroxide thereby increasing the pH and precipitating a mixed NiCo hydroxide product. The mixed NiCo hydroxide product may then be collected by filtration. An exemplary embodiment of this process is shown in FIG. 25.

A moderate-pH mixed Ni/Mn/Co feed may first flow by an anode and an NaCl electrolyte feed may flow between the anode and a porous cathodic material. The NaCl electrolyte feed may separately flow out through both the anode and the porous cathodic material. As the NaCl flows through the anode, the chloride may be oxidized to chlorine, and the chlorine may then react selectively with $Mn^{2+}$ in the anode flow-by stream to produce $MnO_2$ as a precipitate. The $MnO_2$ may then be filtered out and the remaining Ni/Co solution may then flow by the porous cathodic material. As the NaCl solution flows through the porous cathodic material, water reduction producing hydroxide occurs and the hydroxide reacts with the Ni/Co in solution to produce a NiCo mixed metal hydroxide (MHP product). An exemplary embodiment of this process is shown in FIG. 26.

A low-pH mixed Ni/Mn/Co feed may be passed outside-in through the anode and an electrolyte feed is passed outside-in through the porous cathodic material, with both reacted solutions mixed in-between the electrodes. As the mixed Ni/Mn/Co feed passes through the anode with a potential sufficient to oxidize $Mn^{2+}$ but not $Co^{2+}$, Mn is selectively oxidized to $Mn^{4+}$, which precipitates as $MnO_2$. As the electrolyte passes through the porous cathodic material where water is reduced to hydrogen and hydroxide, the produced hydroxide mixing in the center chamber may increase the pH to enhance the precipitation of $MnO_2$. The produced $MnO_2$ may then be collected by filtration. An exemplary embodiment of this process is shown in FIG. 27.

If it is desired to separate all three metals individually, then various electrochemical deposition chambers may be used in series to achieve separation of more than one metal individually. For example, the anode potential of a second metal separation process may be higher than a first process such that $Co^{2+}$ oxidation to $Co^{3+}$ is achieved. The $Co^{3+}$ may then react with hydroxide produced by the porous cathodic material and precipitate as $Co(OH)_3$ or CoOOH. The CoOOH may be collected by filtration. The remaining Ni solution may then flow by a porous cathodic material to further increase the pH to allow for $Ni(OH)_2$ precipitation. An exemplary embodiment of this process is shown in FIG. 28.

Another flow regime to separate more than one individual metal may be to flow a moderate-pH mixed Ni/Mn/Co solution by an anode with a sufficient anode potential to oxidize electrolyte chloride to chlorine as it flows through the anode. The produced chlorine then oxidizes the $Mn^{2+}$ to $Mn^{4+}$ that precipitates as $MnO_2$. The $MnO_2$ is then collected on a filter. The remaining Ni/Co solution then flows by another anode at a sufficient potential to oxidize chloride to the dichloride radical anion as it flows through the anode. The produced dichloride radical anion then oxidizes the $Co^{2+}$ to $Co^{3+}$ that precipitates as CoOOH, which is then collected by filtration. The remaining Ni solution flows by the porous cathodic material which reduces the water flowing through the porous cathodic material to produce hydroxide. Hydroxide may react with the Ni to precipitate as $Ni(OH)_2$ which may then be collected by filtration. An exemplary embodiment of this process is shown in FIG. 29.

To precipitate all three metals Ni, Mn, and Co at once, a slightly acidic mixture of dissolved Ni/Mi/Co ("NMC") solution flows by the porous cathodic material, while an electrolyte solution flows between and through the anode and porous cathodic material. As the electrolyte flows through the porous cathodic material, water is reduced to produce hydrogen and hydroxide anion, and the hydroxide anion reacts with the dissolved $Ni^{2+}/Mn^{2+}/Co^{2+}$ flowing by to yield a mixed NMC hydroxide precipitate. If bicarbonate is used as the electrolyte rather than sulfate, then a mixed NMC carbonate precipitate may be produced since the bicarbonate may react with the hydroxide to produce carbonate, which will precipitate the NMC. Similar strategies may be used to produce other NMC salts. The electrolyte flowing through the anode may undergo water oxidation producing oxygen and protons/acid, which may then be recycled back to the initial leach step. An exemplary embodiment of this process is shown in FIG. 30.

Flow schemes may be used for other metal mixtures, including, but not limited to, of Fe, Cu, Ni, Co, PGM, or combinations thereof found e.g., in sulfidic ores. In Table 1, the numbers below the element are the common, e.g., typically observed, oxidation states. Multiple oxidation states indicate that the oxidation state may be manipulated by an electrochemical redox process. This process may be performed directly at the anode or porous cathodic material, or indirectly through generation of a reactive reductant including, but not limited to, a carbon dioxide radical or oxidant such as chlorine. For example, reduction of $Cu^{1+}$ to $Cu^0$ may occur at the porous cathodic material, or oxidation of $Mn^{2+}$ to $Mn^{4+}$ may occur directly at the anode or indirectly through chlorine production.

Multiple metals with multiple oxidation states (e.g., the black mass extract initially has Ni, Co, Mn all in 2+ state, but the individual metals have multiple oxidation states Ni(2+), Co(2+,3+), Mn(2+,4+,7+)), then the applied electrochemical potential may be rationally manipulated to selectively oxidize only one of the metals, according to Table 2. For example, in the case of black mass, $Mn^{2+}$ may be selectively oxidized to $Mn^{4+}$ first by applying an anode potential between 1.25 and 1.85 V (or the appropriate range according to the Nernst Equation for a particular Mn concentration) to selectively precipitate as $MnO_2$ for subsequent removal by filtration. Then $Co^{2+}$ may be selectively oxidized by applying a potential >1.9 V (or the appropriate range according to the Nernst Equation for a particular Co concentration) to precipitate as $Co(OH)_3$ or CoOOH for subsequent removal by filtration. Finally $Ni^{2+}$, which cannot be oxidized further, may precipitated as $Ni(OH)_2$ by increasing the hydroxide concentration of the solution.

A metal, e.g., Ni, within an ore/concentrate (e.g., chalcopyrite) may be leached. The leached concentrate would be a slightly acidic mixed metal solution of e.g., $Fe^{2+}$, $Cu^{1+/2+}$, and $Ni^{2+}$. The solution would first flow through a flow regime where dissolved Cu is first reduced to metallic copper at a porous cathodic material. Dissolved $Fe^{2+}$ may then be oxidized at the anode to $Fe^{3+}$. The $Fe^{3+}$ would precipitate to form $Fe(OH)_3$ or $Fe_2O_3$ that may be collected by filtration. The remaining $Ni^{2+}$ solution may pass through another flow regime where the $Ni^{2+}$ may flow by a porous cathodic material producing hydroxide to be precipitated as $Ni(OH)_2$ and collected by filtration. An exemplary embodiment of this process is shown in FIG. 31.

Low electroextraction reactivity metal, e.g., $Li^+$, may be collected as a product. $Li^+$ may be concentrated into transportable brine or even precipitate after concentration, likely as a carbonate. The electroextraction technology may be hybridized, and electrodialysis technology may be used to selectively concentrate and/or precipitate a species such as Lit During electrodialysis, a bipolar electrode system may be used in combination with an anion-exchange membrane, located near the anode, and a cation-exchange membrane, located near the porous cathodic material, with the membranes placed between the two electrodes. Electrodialysis may then separate anions and cations in the electrolyte by using the electric field generated by the electrodes and the produced ions (cathodic anionic hydroxides and (anodic cationic protons) during water splitting. For example, if a lithium sulfate solution flows between the ion-exchange membranes, then the positive lithium ion will electromigrate through the cation-exchange membrane toward the porous cathodic material, and the negative sulfate ion will electromigrate through the anion-exchange membrane toward the anode. Ion-exchange membranes may only allow ions to pass and prevent passage of water. Thus, ions that do electromigrate through the membrane may be concentrated in the membrane permeate. If there are cation contaminants in the lithium sulfate solution, these may be rejected by using an Li-ion-specific cation exchange membrane that only allows $Li^+$ to pass. Finally, if a Li precipitate rather than a Li concentrate is the end-product, then a sodium bicarbonate electrolyte may be used to cathodically produce carbonate ion. Lithium carbonate ($Li_2CO_3$) has a significantly lower STP solubility that lithium hydroxide (LiOH) at 13 g/L (0.18 M) as compared to 130 g/L (5.4 M), respectively. The hybrid electroextraction-electrodialysis system may be further merged to use the produced acid and/or base for alternative leach and precipitation processes, respectively. The anodic/cathodic reactions may be used for oxidation/reduction of metals where the increased/decreased charge of the metals may drive the electromigration process similar to protons/hydroxides during water splitting. An exemplary embodiment of this process is shown in FIG. 32.

Metals may be deposited as metal hydroxides. The deposited metal hydroxides may be of the form $M^{n+}(OH)_n$. The porous cathodic material may electrocatalyze the reduction of water. The electrocatalyzed reduction of water occurs according to chemical reaction $2H_2O + 2e^- \rightarrow H_2 + 2HO^-$. Hydroxide anion from reduced water may react with metal ions to yield metal hydroxides. Hydroxide concentration near the cathodic material may be high relative to at other locations in the feed. The high relative hydroxide concentrations near the cathodic material enhances homogeneous metal or metal oxide precipitation and deposition onto the porous cathodic material. Metal hydroxides may form according to the following chemical formulae:

$$2e^- + 2H_2O \rightarrow H_2 + 2OH^-$$

$$M^{n+} + (OH)_n \rightarrow M(OH)_{n(s)}$$

$$M^{n+} + 2e^- + 2H_2O \rightarrow H_2 + M(OH)_{n(s)}.$$

For example, cobalt hydroxide may be formed according to the following formulae where hydroxide ions are in stoichiometric excess compared to Co:

$$2e^- + 2H_2O \rightarrow H_2 + 2OH^-$$

$$Co^{2+} + 2OH^- \rightarrow Co(OH)_{2(s)}$$

$$Co^{2+} + 2e^- + 2H_2O \rightarrow H_2 + Co(OH)_{2(s)}.$$

A single metal may be deposited onto the surface of the porous cathodic material. A single metal may be deposited onto the surface of a plurality of porous cathodic materials. Depositing a single metal onto the surface of a plurality of porous cathodic materials may comprise sequentially reducing the amount of metal in a feed, for example, by passing a feed through a first porous cathodic material to deposit e.g., 90% of the metal in the feed onto the first porous cathodic material to form a depleted solution; and passing this depleted solution through a second porous cathodic material to deposit e.g., 90% of the metal in the depleted solution onto the second porous cathodic material. The porous cathodic material may have an extended lifetime of use. The lifetime of the porous cathodic material may include, but is not limited to, at least about 50 hours, about 50 hours to about 1000 hours, about 100 hours to about 900 hours, about 200 hours to about 800 hours, about 300 hours to about 700 hours, about 400 hours to about 600 hours, about 500 hours to about 1200 hours, about 1200 hours to about 2000 hours, about 1500 hours to about 3000 hours, about 2200 hours to about 4000 hours, or about 5000 hours.

A plurality of metals may be deposited onto the surface of a plurality of porous cathodic materials. For example, a first metal, for example Nd, may be deposited onto a first porous cathodic material and a second metal, for example Pr, may be deposited onto a second porous cathodic material. In another example, Cu may be deposited onto a first porous cathodic material at 1.5 V, and then Ni or Co may be deposited onto a second porous cathodic material at 3.0 V.

Metals may be deposited on a porous cathodic material to remove impurities from the feed and allow a metal of interest, e.g., Li, to pass through the electrochemical deposition apparatus for collection. Metal deposition onto a porous cathodic material yields a permeate. The permeate may be metal free or depleted of metal. The metal depleted permeate may be recycled back into the electrochemical deposition apparatus as feed. Metal deposition onto a porous cathodic material may yield a plurality of permeates.

Deposited metals are removed from the porous cathodic material and may form a concentrate and/or extract comprising metals. The concentrate and/or extract may be recycled back into the electrochemical deposition apparatus as feed. Deposited metals removed from the porous cathodic material may form a plurality of concentrates and/or extracts.

Deposited metals are removed from the porous cathodic material. Deposited metals may be removed from the porous cathodic material by an increased cross flow over the surface of the porous cathodic material and/or an air scour. Deposited metals may also be removed from the porous cathodic material by a reverse flow through the electrochemical deposition apparatus. Deposited metals may be removed from the porous cathodic material by a pulsed current that repels deposited metals from the porous cathodic material. Deposited metals may also be removed from the porous cathodic material by increased cross flow over the surface of the porous cathodic material in combination with a pulsed current. Additionally, deposited metals may be removed from the porous cathodic material by a reverse flow through the electrochemical deposition apparatus in combination with a pulsed current.

The electrochemical deposition method may comprise a solvent extractant. The solvent extractant may be non-covalently bound to the cathodic material. The solvent extractant may include, but is not limited to, tributyl phosphate, tri-octyl amine, tri-decyl amine, di(2-ethyl-hexyl) phosphoric acid, dialkyl sulfides, hydroxyoximes, or a combination thereof. The solvent extractant may be dissolved in the feed solution that may be aqueous or non-aqueous. The solvent extractant may facilitate an in situ reversible electrochemical metal solid phase extraction process. The electrochemical deposition apparatus may comprise a plurality of solvent extractants.

The electrochemical deposition apparatus may comprise a center flow design. The center flow design may comprise a region for receiving feed; a region for receiving feed electrolyte; a first outlet; a porous cathodic material; and an anode. The porous cathodic material may be in communication with the region for receiving feed. The hydroxide ions may traverse across the porous cathodic material, form at the surface of the porous cathodic material, and/or form within the porous cathodic material and enter the region for receiving feed. Metal ions may be deposited at the porous cathodic material and may be converted to metal hydroxides. Converted metal hydroxides may form a metal hydroxide concentrate within the region for receiving feed. The metal hydroxide concentrate may flow from the electrochemical deposition apparatus from the first outlet. Water may be electrolyzed at the anode to form hydrogen ions and oxygen. Water may be electrolyzed at the porous cathodic material to form hydrogen and hydroxide ions. The electrochemical deposition apparatus may further comprise a second outlet. Feed electrolyte may flow from the electrochemical deposition apparatus through the second outlet. Feed electrolyte may be recycled into a leach solution (e.g., an acidic leach solution). The electrochemical deposition apparatus may also comprise an anode permeate region, a feed region, and an electrolyte feed region. Optionally, there may be cross flows between the anode permeate region, the feed region, and the electrolyte feed region. The electrochemical deposition apparatus may comprise a surface to prevent outflow from the electrolyte feed region. The surface may be e.g., a rigid wall, valve, flexible membrane, or a combination thereof. The electrochemical deposition apparatus may also comprise a third outlet. The first, second, and third outlets may be disposed on the electrochemical deposition device to allow flow through from the anode permeate region, the feed region, and the electrolyte feed region.

The center flow design may create positive pressure perpendicular to, and moving away from the porous cathodic material and anode. The metal hydroxide generated at or near the porous cathodic material may be resuspended and/or gathered by cross flow through the center flow design.

The method of the present invention may comprise contacting or passing a feed comprising metal ions through an electrochemical deposition apparatus; contacting the feed with a porous cathodic material; depositing a metal onto the surface of the porous cathodic material; and converting the metal ions to metal hydroxides to form a metal hydroxide concentrate. The method may further comprise recovering the metal hydroxides from the metal hydroxide concentrate. Recovering the metal hydroxides from the metal hydroxide concentrate may comprise passing the metal hydroxide concentrate through a device, including but not limited to, a filter, filtration device, sedimentation process, centrifuge, press, or a combination thereof. The method may further comprise electrolyzing water to form hydrogen gas and hydroxide ions. The method may further comprise electrolyzing water to form oxygen gas and hydrogen ions. Water may be electrolyzed at the porous cathodic material and/or anode. The method may further comprise contacting an electrolyte feed across a porous cathodic material and/or an anode. The electrolyte feed may comprise, but not be limited to, HCl, $HNO_3$, or other salts. The electrolyte feed may comprise, but not be limited to, electrolytic protons and electrolytic hydroxide. The electrolyte feed flow may transport electrolytic protons across the anode and electrolytic hydroxides across the porous cathodic material. The method may also comprise recycling the electrolyte solution into a leach solution (e.g., an acidic leach solution). Output from the feed region and/or anode permeate region may also be recycled.

The present invention may further comprise a filtration device. The filtration device may receive metal hydroxide concentrate. The filtration device may comprise an inlet; an outlet; a housing; and a filter. The inlet may receive metal hydroxide concentrate. Metal hydroxide-depleted solution may flow out of the filtration device by the outlet. The filter may comprise pores, a membrane, an exchange column, or a combination thereof. The filter may be capable of capturing metal hydroxides. The present invention may further comprise a vessel or containing feed to be flowed into the electrochemical deposition device. The present invention may also include a user interface. The user interface may comprise a screen. The screen may be a touch screen. The user interface may comprise an automated control system. The automate control system may be used for cleaning, in situ cleaning, or for cleaning cycles using a feedback loop.

The electrochemical deposition apparatus may generate a gas. The gas may comprise, but not be limited to, oxygen, hydrogen, chlorine, $NO_x$, wherein X is an integer from 1 to 4, or a combination thereof. The electrochemical deposition apparatus may also comprise a gas release valve. The gas release valve may release gas generated by the electrochemical deposition apparatus. The gas release valve may comprise a vent, a manual valve, or a combination thereof.

The electrochemical deposition apparatus may comprise a filter press. The filter press may comprise a filter plate; filter press cylinder; a porous cathodic material; an anode; an inlet; and an outlet. The filter press may also comprise a mesh, a gasket, a current collector, a collar gasket, or a combination thereof. Pairs of the mesh, gasket, current collector, and collar gasket may be at least partially disposed on either side of the filter plate. The mesh may be at least partially disposed within the filter plate. The current collector may comprise an elongated current collector. The elongated current collector may comprise a perforated metal sheet. The elongated current collector may comprise, but not be limited to, Ti, stainless steel, or other metal. The filter plate may be at least partially disposed between two gaskets. The porous cathodic material may be at least partially disposed between a first current collector and a first collar. The anode may be at least partially disposed between a second current collector and a second collar. The collar may be at least partially disposed between the current collector and the collar gasket. Electrolyte solution may flow through and/or across the filter plate. The porous cathodic material may separate the feed and electrolyte feed, including, for example, by preventing the feed and electrolyte feed from mixing.

The electrochemical deposition apparatus may comprise a filter press, and may comprise a plurality of plates arranged in parallel. The plates arranged in parallel may form at least two channels. Each plate in the plurality of plates may receive an electrolyte solution. An electrode and an anode may be at least partially disposed around a plate. At least one channel formed by the plates arranged in parallel may be in contact with two porous cathodic materials. Feed may be received by the at least one channel in contact with two porous cathodic materials. At least one channel formed by the plates arranged in parallel may be in contact with two anodes. Anode permeate may be received by the at least one channel in contact with two anodes.

The electrochemical deposition apparatus comprising a filter press may operate at a feed flow rate and/or electrolyte feed flow rate including, but not limited to, at least about 50 mL/min per plate, about 50 mL/min per plate to about 10 L/min per plate, about 100 mL/min per plate to about 9 L/min per plate, about 200 mL/min per plate to about 8 L/min per plate, about 300 mL/min per plate to about 7 L/min per plate, about 400 mL/min per plate to about 6 L/min per plate, about 500 mL/min per plate to about 5 L/min per plate, about 600 mL/min per plate, to about 4 L/min per plate, 700 mL/min per plate to about 3 L/min per plate, about 800 mL/min per plate to about 2 L/min per plate, about 900 mL/min per plate to about 1 L/min per pate or about 10 L/min per plate. The total feed flow rate and/or electrolyte feed flow rate may include, but is not limited to, at least about 500 L/min, about 500 L/min to about 1500 L/min, about 600 L/min to about 1400 L/min, about 700 L/min to about 1300 L/min, about 800 L/min to about 1200 L/min, about 900 L/min to about 1100 L/min, or about 1500 L/min. The anode permeate flow rate may include, but is not limited to, at least about 18 L/min, about 18 L/min to about 99 L/min, about 27 L/min to about 90 L/min, about 36 L/min to about 81 L/min, about 45 L/min to about 72 L/min, about 54 L/min to about 63 L/min, or about 99 L/min. The anode permeate may include, but is not limited to, at least about 10%, about 10% to about 50%, about 20% to about 40%, or about 50% of the electrolyte feed. The anode permeate flow rate per plate may include, but is not limited to, at least about 1 L/min, about 1 L/min to about 36 L/min, about 9 L/min to about 27 L/min, or about 36 L/min.

The electrochemical deposition apparatus may comprise a computerized control system. The computerized control system may evaluate the performance of the electrochemical deposition apparatus to design extractants with improved cathodic material binding and/or metal selectivity. The computerized control system also may evaluate the performance of the electrochemical deposition apparatus for real-time optimization of operational conditions.

The electrochemical deposition method may further comprise a leach. The leach may be run at a range of current densities ($A/m^2$). The current density may include, but is not limited to, at least 1 $A/m^2$, about 1 $A/m^2$ to about 7000 $A/m^2$, about 10 $A/m^2$ to about 6500 $A/m^2$, about 50 $A/m^2$ to about 6000 $A/m^2$, about 100 $A/m^2$ to about 5000 $A/m^2$, about 200 $A/m^2$ to about 4500 $A/m^2$, about 300 $A/m^2$ to about 4000 $A/m^2$, about 400 $A/m^2$ to about 3500 $A/m^2$, about 500 $A/m^2$ to about 3000 $A/m^2$, about 600 $A/m^2$ to about 2500 $A/m^2$, about 700 $A/m^2$ to about 2000 $A/m^2$, about 800 $A/m^2$ to about 1500 $A/m^2$, or about 7000 $A/m^2$.

The leach may generate an acid and/or reagent. The generation rate may be a function of the current density ($A/m^2$), the area of the electrode ($m^2$), and the current efficiency of the reaction (q; the fraction of the electrons flowed that result in the desired reaction). In the case of acid generation from water, the reaction may be anodic water oxidation ($2H_2O \rightarrow 4H^+ + 4e- + O_2$), which may occur at 100% current efficiency. The anodic water oxidation may produce $1H^+$ for every 1 electron flowed. For example, an area of 1 $m^2$ with at max current density of 7000 $A/m^2$, the current at a single electrode is 7000 A or (7000 C/s)/(Faraday's constant; 96845 C/mol e−), indicating that protons may be produced at a maximum rate of $+d[H+]/dt=0.072$ moles/s, e.g., that 1 mole of protons can be produced in 13.8 s. The total production rate may be increased electrodes in parallel.

The range of acid production rates for a single electrode ($1\ m^2$) may be dependent upon both the steady-state current density and the current efficiency of the process. The steady-state current density may be lowered by decreasing a feedstock input rate. The current efficiency may be lowered by operating simultaneous anodic oxidation reactions that may lower the fraction of total current going towards a water oxidation reaction. For example, a black mass leach may use 3 L of 4M sulfuric acid for every kg of black mass. Sulfuric acid has a pKa of −2.8 and 2, and sulfuric acid at a concentration of 4M may yield a pH between −1 and 0. This pH range indicates that in aqueous solution at this concentration every sulfuric acid molecule dissociates to produce a proton and a bisulfate. Thus, for every kg of black mass leached, 12 moles of H+ may be used. At a current density of $1000\ A/m^2$, and $+d[H+]/dt=0.01$ moles/s, it would take 1200 s or 20 min to produce the 12 moles of H+ required to leach 1 kg of black mass. The time for the required H+ production may be decreased if the current density is increased.

The timescale for the leach may range from seconds to minutes to hours to days. The leach timescale may depend on the acid production rate and/or the particle dissolution rate. Particle dissolution may be a surface-limited process, and the surface area to volume ratio of the particle may affect the overall dissolution or leach rate. Leached particles may have a range of sizes tens to hundreds of microns for ore concentrates and tailings, to millimeters for crushed ore particles. Leached particles may have a diameter including, but not limited to, at least 100 microns, about 100 microns to about 50 mm, about 300 microns to about 25 mm, about 500 microns to about 10 mm, about 1 mm to about 5 mm, or about 50 mm. Nanoparticle catalysts may also be used to accelerate the leach timescale. Larger particles may be further processed, e.g., milled, ground, crushed, sonicated, or a combination thereof to achieve smaller particle size distributions and increase the leaching rate. The leached particles may also be agglomerated before leaching. The amount of material that needs to be dissolved may also affect the timescale of the leach with larger masses requiring longer leach times. Particle sorting, including, but not limited to, magnetic separation, flotation, density separation, or a combination thereof may be used to reduce total mass and increase the leaching rate.

The type of particle and oxidation state of the metal may also affect the timescale of the leach. Metal oxides and hydroxides may be directly leached into acid ($Mn^{+}O_{(n/2)(s)}+nH^{+}_{(aq)}\rightarrow M^{n+}_{(aq)}+(n/2)H_2O$) where the higher the initial oxidation state (higher $n^{+}$) may result in slower dissolution and decreased leaching rate. The oxide and/or hydroxide may be reduced by addition of a reductant (e.g., hydrogen peroxide, bisulfite, etc.) to reduce the oxidation state and increase the leach rate. For example, a reducing acid (hydrogen peroxide plus sulfuric acid) leach may be used for black mass. If the material to be dissolved is metallic or a metal sulfide, then an oxidizing acid leach may be required. An initial oxidation of either the metal to an aqueous soluble metal ion (e.g., $Pt^{0}+Cl_2\rightarrow Pt^{2+}+2Cl^{-}$) or of the sulfide to a higher oxidation state ($S^{2-}+2O_2\rightarrow SO_4^{2-}$) may be required to reduce the sulfide-metal bond strength for the overall dissolution process. This additional step may limit the overall rate of the leach.

The leach efficacy may include, but is not limited to, at least about 0.5%, about 0.5% to about 99%, about 1% to about 97%, about 5% to about 95%, about 10% to about 90%, about 20% to about 80%, about 30% to about 70%, about 40% to about 60%, or about 99%. Low leach efficacy may be preferable when a trace amount of high value material or a trace amount of deleterious material is present in the leach. A high leach efficacy may be preferable when most the metal in the leached material are valuable. An intermediate leach efficacy is preferable if only target metal or deleterious metal is dissolved.

An acid may be used as a lixiviant. The acid may comprise, but is not limited to, sulfuric acid, nitric acid, other acids, or a combination thereof. The acid may comprise, but is not limited to, a mineral acid (or inorganic acid) acid derived from one or more inorganic compounds (compounds that are not carbon based). The inorganic acid may include, but is not limited to, hydrofluoric acid; hydrochloric acid; hydrobromic acid; sulfuric acid, sulfurous acid; nitric acid; perchloric acid; perbromic acid; phosphorous acid; pyrophosphoric acid; sulfamic acid; fluosilicic acid; selenous acid; phosphoric acid; hypophosphorous acid; phosphomolybdic acid; polyphosphoric acid; periodic acid; iodic acid; boric acid; molybdic acid; tungstosilicic acid; phosphotungstic acid; chlorosulfonic acid; chloroplatinic acid; meta-phosphoric acid; hexafluorophosphoric acid; tetrafluoroboric acid; nitrosylsulfuric acid; hydroxylamine-O-sulfonic acid; hydrogen cyanide; hydrogen azide; chromic acid; water; hydrogen sulfide; carbonic acid; hydrogen peroxide; ammonium; arsenous acid; arsenic acid; or a combination thereof.

The acid may comprise an organic acid. An organic acid is an organic compound (organic compounds are generally any chemical compounds that contain carbon-hydrogen bond(s)) with acidic properties. The organic acid may include, but is not limited to, formic acid; acetic acid; chloroacetic acid; dichloroacetic acid; trichloroacetic acid; benzene sulfonic acid; bromoacetic acid; dibromoacetic acid; tribromoacetic acid; glycolic acid; trifluoromethanesulfonic acid; peracetic acid; ethylenediaminetetraacetic acid; maleic acid; phthalic acid; succinic acid; aminomethanesulfonic acid; bromochloroacetic acid; salicylic acid; thioacetic acid; sulfanilic acid; oxalic acid; thioglycolic acid; malonic acid; chlorodifluoroacetic acid; propionic acid; anthranilic acid; fluoroacetic acid; difluoroacetic acid; trifluoroacetic acid; formic acid; lactic acid; tartaric acid; gallic acid; barbituric acid; lipic acid; tannic acid; malic acid; fumaric acid; benzoic acid; amino acids; fatty acids; sulfosalicylic acid; citric acid; toluenesulfonic acid; sorbic acid; nitrilotriacetic acid; pyruvic acid; iodoacetic acid; dehydroquinic acid; phenol and substituted phenols; thiophenol and substituted thiophenols; aminophenol and substituted aminophenols; aniline; picric acid; pyridine and substituted pyridines; methyl ammonium and other alkyl ammonium; any carboxylic acid, or a combination thereof. Carboxylic acid is an organic acid that contains a carboxyl group (C(═O)OH) attached to an R-group. The general formula of a carboxylic acid is R—COOH or R—$CO_2H$, with R referring to the alkyl, alkenyl, aryl, or other group.

Leaches may be carried out over a range of pH values. The pH may include, but is not limited to, at least about −3.0, about −3.0 to about 5.0, about −2.5 to about 2.5, about −2.0 to about 2.0, about −1.5 to about 1.5, about −1.0 to about 1.0, or about 5.0. The leach may also be carried out under basic conditions.

Various types of material may be leached. The material that may leached includes, but is not limited to, a black mass; an agglomerated particle; a concentrate, a slurry, a mixture of metal, plastic, glass, fiber, polymers or a combination thereof; battery material including, but not limited to, Li-ion batteries and/or NiMH batteries; catalyst scrap including, but not limited to, catalytic converters, magnets, oil refining catalysts, or combination thereof; manufacturing scrap; scrap and solutions for the plating industry; metal filter cake; non-ferrous scrap; alloy scrap including, but not limited to, Ni—Co alloy scrap; shredded and/or fragmentized mixed non-ferrous scrap; Ni scrap; electric motors; precious metal solutions and/or sweeps; electronic waste including, but not limited to, circuit boards; wiring; mine tailings; metal-containing think film and/or coating; crushed and/or milled metal materials; metal-containing particulate captured by filters; or a combination thereof.

The leach may comprise an oxidizing agent. An oxidizing agent, also known as an oxidant or oxidizer, is a substance that has the ability to oxidize other substances. An oxidant may be used in combination with an acid for metal dissolution when the metal particulate is found in the metallic state or as a sulfide. In the metallic state, an oxidant may transform from the metallic to cationic state to enable metal ion dissolution. In a metal sulfide, an oxidant may be used to transform the sulfur into a higher oxidation state that has a lower bond energy with the metal ion enabling its release and dissolution from the solid. When an oxidant is used with a metal sulfide, the in situ production of sulfuric acid from the sulfide oxidation may be used as the leaching acid. The oxidant may include, but is not limited to, fluorine, chlorine, bromine, iodine, hydroxyl radical, hydrogen peroxide, superoxide, hydroperoxide radical, oxygen, hypochlorous acid, hypofluorous acid, hypobromous acid, hypoiodous acid, dichloride radical, dibromide radical, diiodide radical, ozone, O-atom, carbonate radical, azide radical, amino radical, nitrogen dioxide radical, nitrogen trioxide radical, phosphite radical, phosphate radical, sulfite radical, sulfate radical, peroxomonosulfate radical, selenite radical, dithiocyanate radical, chlorine dioxide, permanganate, ferrate, bromine dioxide, perborate, lead dioxide, aqua regia ($3HCl+HNO_3$), concentrated nitric acid, $HNO_3+H_2SO_4$, persulfate, Caro's Acid, perchlorate, chromic acid, chromium trioxide, nitrous oxide, nitrogen dioxide, peroxides, or a combination thereof.

The leach may comprise a reducing agent. A reducing agent (also knowns as a reductant, reducer, or electron donor) is an element or compound that loses or "donates" an electron to an electron recipient (known as the oxidizing agent, oxidant, or oxidizer) in a redox chemical reaction. A reductant may be used when the metal to be leached is found in high oxidation states (>2+) that is resistant to dissolution. The reductant reacts with the high-valent metal ion to yield a lower valent metal ion that is easily dissolved (e.g., $Fe^{3+}+e \rightarrow Fe^{2+}$). The reductant may include, but is not limited to, aqueous electron, H-atom, carbon dioxide radical, phosphite radical, sulfur dioxide radical, sulfite, hydrogen peroxide, hydrazine, hydrogen, sodium borohydride, sodium aluminum hydride, ferrous ion, stannous ion, sulfur dioxide, dithionates, thiosulfates, ascorbic acid, reducing sugars, phosphites, dithiothreitol, carbon monoxide, cyanides, reduced carbon, hydroquinones, or a combination thereof.

Various types of metal, minerals, and/or ore concentrates may be leached. An ore concentrate is ore material that has been crushed, grinded, and/or milled to a small particle size and then concentrated in regard to the desired metal by a separation process such as magnetic separation, density separation, flotation, size separation, etc. An ore concentrate may include, but is not limited to, copper concentrate; nickel concentrate; cobalt concentrate; titanium concentrate; base metal concentrate; gold concentrate; silver concentrate; RE concentrate; precious metal concentrate; mixed concentrates including, but not limited to, Ni—Cu, Ni—Co, Co—Cu, Ni—Co—Cu, Ni—Co—Cu with platinum group metals (PGM). The mineral to be leached may include, but is not limited to, ilmenite; coal or coal by-products including, but not limited to, fly ash, bauxite, acanthite, barite, beryl, bornite, cassitertie, chromite, cinnabar, columbite-tantalite, galena, molybdenite, pentlandite, scheelite, sperrylite, sphalerite, uraninite, wolframite, taconite, pyrolusite, braunite, psilomelane, and rhodochrosite, or a combination thereof; Li in spomudene, pegmatites, petalite, lepidolite, hectorite clay and other clays; Cu ore including, but not limited to, chalcopyrite, chalcocite, covellite, bornite, tetrahedrite, digenite, malachite, azurite, cuprite, chrysocolia, tennantite, dioptase, enargite; Fe ore including, but not limited to, magnetite, hematite, goethite, limonite, siderite, taconite; Co ore including, but not limited to, cobaltite; Ni in millerite, nickeline, pentlandite, kamacite, taenite, laterite, nickeliferous limonite, garnierite; Zn in sphalerite, smithsonite, hemimorphite, wurtzite, hydrozincite; Nb in columbite, pyrochlore, euxenite, carbonatites; Mo in wulfenite, powellite, molybdenite; Ru in pentlandite and pyroxenite; Rh as free metal; Pd in cooperate, polarite, and free metal; Ag in acanthite, argentite, free metal, chlorargyrite, pnictides, and chalcogenides; Sn in cassiterite, stannite, cylindrite, franckeite, canfieldite, and teallite; Ta in tantalite, microlite, wodginite, euxenite, polycrase, samarskite, and fergusonite; W in wolframite, scheelite, ferberite, and hubnerite; Re in molybdenite, PGM metals as sulfides, tellurides, antimonides, and arsenides, and in alloys with nickel and copper; Pt as free metal, alloy, sulfides, tellurides, antimonides, arsenides, sperrylite, and cooperate; Au as free/native metal, alloy such as Ag, Hg or Te, electrum, lode deposites, nuggets, calaverite, krennerite, nagyagite, petzite, sylvanite, maldonite, aurostibite, auricupride, novodneprite, and weishanite; Pb in galena, boulangerite, anglesite, cerussite; Bi as bismuthinite, bismite; Rare earth elements (Sc, Y, La, Ce, Pr, Nd, Pm, Sm, Eu, Gd, Tb, Dy, Ho, Er, Yb) in xenotime, monazite, gadolinite, samarskite, euxenite, yttrotantalite, yttrotungstite, yttrofluorite, thalenite, yttrialite, eudialyte, bastanasite, allanite, loparite, ancylite, parasite, lanthanite, chevkinite, cerite, stillwellite, britholite, fluocerite, cerianite, carbonatites, pegmatites; U in carnotite, autunite, uranophane, torbernite, coffinite, lignite, monazite; or a combination thereof.

The leach may include counterions. If the reagent and/or buffer is anionic, then the cationic counterion may include, but is not limited to, $H^+$, $Na^+$, $K^+$, $Rb^+$, $Cs^+$, $NH^{4+}$, $Be^{2+}$, $Mg^{2+}$, $Ca^{2+}$, $Sr^{2+}$, $Ba^{2+}$, $Al^{3+}$, $Bi^{2+}$, tetraphenylphosphonium, tetraalkylammonium, 1-ethyl-3-methylimidazolium and derivatives, ionic liquid cations, or a combination thereof. If the reagent/buffer listed is cationic, then the anionic counterion may include, but is not limited to, $F^-$, $Cl^-$, Br, $I^-$, borate, nitrate, sulfate, phosphate, bromate, chlorate, iodate, acetate, formate, tetrafluoroborate, hexafluorophosphate, tetraphenylborate, tetrakis(pentafluorophenyl) borate, ionic liquid anions, or a combination thereof.

INDUSTRIAL APPLICABILITY

The invention is further illustrated by the following non-limiting examples.

Example 1

Cobalt filter cake or 'black mass' was acquired from a vendor. The black mass was produced by first isolating an end-of-life Li-ion battery mixture, inertly shredding this mixture, and then mechanically separating the bulk plastic and metals (current collectors) from the active anode (graphite) and porous cathodic material (metal, i.e., Ni, Mn, Co) powders. The latter was the black mass. The primary metal weight of the black mass was calculated. The remainder of the mass was oxide oxygen, anode graphite, and polymer binders. A general procedure to leach the metals from the black mass was developed following reported literature on low pH reductive Co dissolution methods.

The metal leach was completed in a 2 L Erlenmeyer flask by addition of 500 mL of 4 M sulfuric acid, 200 mL of 30% hydrogen peroxide, and 120 g of black mass. The black mass was added in smaller aliquots of 10-20 g with vigorous stirring to prevent formation of a graphite stabilized foam from oxygen gas formation. The black mass addition caused the reaction solution to heat. Once the black mass solution had stabilized, it was heated to 60-80 C for 2-3 h under magnetic stirring. Then, the solution was diluted to 1 L with DI water and filtered through an 0.3 micron nylon membrane to remove any undissolved material. The pinkish tan filtrate was then measure for pH (typically 1-2) and UV-vis for metal content (typically 100-150 mM for Co/Ni). The procedure was determined to leach >90% of the metal in the received black mass and was successful on the first attempt.

The pH of the acidic metal leach solution was then increased to 4-5 by addition of small aliquots of 2M NaOH. Upon reaching this pH, a tannish precipitate began to form in the solution (lower mid left Scheme 1). The pH adjusted solution was then filtered through a 0.3 micron membrane to remove precipitated material. At this point, the black mass extract had an Ni:Mn:Co:Li metal ion ratio of 3:2:4:1. Trace metals such as Fe, Cu, and Al were mostly removed by the pH adjustment and filtration steps. The NMC BME was ready for electrochemical deposition apparatus to recycle the active porous cathodic materials as metal hydroxides.

The preceding examples can be repeated with similar success by substituting the generically or specifically described components and/or operating conditions of embodiments of the present invention for those used in the preceding examples.

Although certain metals, reagents, acids, pre-processes, types of materials, and operating parameters are described in reference to particular embodiments, other metals, reagents, acids, pre-processes, types of materials and operating parameters may be used in accordance with the present invention, particularly because each material or metal to be recycled or processed will require customized reagents, processes, and operating parameters. Variations and modifications of the present invention for such customizations will be obvious to those skilled in the art and it is intended to cover all such customizations.

Note that in the specification and claims, "about" or "approximately" means within twenty percent (20%) of the amount or value given.

Although the invention has been described in detail with particular reference to the disclosed embodiments, other embodiments can achieve the same results. Variations and modifications of the present invention will be obvious to those skilled in the art and it is intended to cover all such modifications and equivalents. The entire disclosures of all references, applications, patents, and publications cited above and/or in the attachments, and of the corresponding application(s), are hereby incorporated by reference. Unless specifically stated as being "essential" above, none of the various components or the interrelationship thereof are essential to the operation of the invention. Rather, desirable results can be achieved by substituting various components and and/or reconfiguration of their relationships with one another.

What is claimed is:

1. A method for electrochemically depositing metal, the method comprising:

passing a solution comprising a metal into a cavity;

applying a first voltage charge to a porous cathodic material at least partially disposed within the cavity;

contacting the solution with a porous cathodic material having the applied first voltage charge;

applying a second voltage charge to select the metal, wherein the first voltage charge is different than the second voltage charge;

changing an oxidation state of the metal; and selectively depositing at least a portion of the metal onto the porous cathodic material.

2. The method of claim 1 further comprising contacting the solution with an anode.

3. The method of claim 1 further comprising contacting the porous cathodic material with an acid.

4. The method of claim 1 further comprising contacting the porous cathodic material with a buffer.

5. The method of claim 1 further comprising generating a gas.

6. The method of claim 1 further comprising leaching.

7. The method of claim 1 wherein changing the oxidation state of the metal comprises increasing the oxidation state of the metal.

8. The method of claim 1 wherein contacting the solution with a porous cathodic material comprises passing the solution across the porous cathodic material.

9. The method of claim 1 wherein contacting the solution with a porous cathodic material comprises passing the solution through the porous cathodic material.

10. The method of claim 1 further comprising removing the selectively deposited metal from the porous cathodic material.

* * * * *